US009551207B2

(12) United States Patent
Swist

(10) Patent No.: US 9,551,207 B2
(45) Date of Patent: Jan. 24, 2017

(54) PRESSURE ASSISTED OIL RECOVERY

(76) Inventor: Jason Swist, Edmonton (CA)

( * ) Notice: Subject to any disclaimer, the term of this patent is extended or adjusted under 35 U.S.C. 154(b) by 490 days.

(21) Appl. No.: 13/371,729

(22) Filed: Feb. 13, 2012

(65) Prior Publication Data

US 2012/0292055 A1 Nov. 22, 2012

Related U.S. Application Data

(60) Provisional application No. 61/487,770, filed on May 19, 2011.

(51) Int. Cl.

| | |
|---|---|
| ***E21B 43/24*** | (2006.01) |
| ***E21B 43/18*** | (2006.01) |
| ***E21B 43/30*** | (2006.01) |

(52) U.S. Cl.

CPC ..... *E21B 43/2408* (2013.01); *E21B 43/18* (2013.01); *E21B 43/305* (2013.01)

(58) Field of Classification Search

CPC ..... E21B 43/2408
USPC ..... 166/270, 401, 402, 272.3, 313, 52, 245, 166/268, 303
See application file for complete search history.

(56) References Cited

U.S. PATENT DOCUMENTS

| | | | |
|---|---|---|---|
| 3,129,758 | A | 4/1964 | Closmann |
| 4,166,501 | A | 9/1979 | Korstad |
| 4,257,650 | A | 3/1981 | Allen |
| 4,344,485 | A | 8/1982 | Butler |
| 4,368,781 | A | 1/1983 | Anderson |
| 4,385,662 | A | 5/1983 | Mullins |

(Continued)

FOREIGN PATENT DOCUMENTS

| | | |
|---|---|---|
| CA | 1130201 | 8/1982 |
| CA | 1304287 | 6/1992 |

(Continued)

OTHER PUBLICATIONS

Yee, C.-T. and Stroich, A., "Flue Gas Injection Into a Mature SAGD Steam Chamber at the Dover Project (Formerly UTF)", Journal of Canadian Petroleum Technology, pp. 54-61, vol. 43, No. 1, Jan. 2004.

(Continued)

*Primary Examiner* — Kenneth L Thompson
*Assistant Examiner* — Steven MacDonald
(74) *Attorney, Agent, or Firm* — Clifford Kraft

(57) ABSTRACT

Estimates of global total "liquid" hydrocarbon resources are dominated by structures known as oil sands or tar sands which represent approximately two-thirds of the total recoverable resources. This is despite the Canadian Athabasca Oil Sands, which dominate these oil sand based reserves at 1.7 trillion barrels, are calculated at only 10% recovery rate. However, irrespective of whether it is the 3.6 trillion barrels recoverable from the oil sands or the 1.75 trillion barrels from conventional oil reservoirs worldwide, it is evident that significant financial return and extension of the time oil is available to the world arise from increasing the recoverable percentage of such resources. According to embodiments of the invention pressure differentials are exploited to advance production of wells, adjust the evolution of the depletion chambers formed laterally between laterally spaced wells to increase the oil recovery percentage, and provide recovery in deeper reservoirs.

23 Claims, 33 Drawing Sheets

(56) References Cited

U.S. PATENT DOCUMENTS

| | | | | |
|---|---|---|---|---|
| 4,510,997 | A | 4/1985 | Fitch | |
| 4,522,260 | A | 6/1985 | Wolcott | |
| 4,577,691 | A | 3/1986 | Huang | |
| 4,598,770 | A | 7/1986 | Shu | |
| 4,633,948 | A | 1/1987 | Closmann | |
| 4,637,461 | A | 1/1987 | Hight | |
| 4,653,583 | A | 3/1987 | Huang | |
| 4,700,779 | A | 10/1987 | Huang et al. | |
| 4,727,937 | A | 3/1988 | Shum | |
| 4,834,179 | A | 5/1989 | Kokolis | |
| 5,215,146 | A * | 6/1993 | Sanchez | C09K 8/592 166/272.3 |
| 5,273,111 | A | 12/1993 | Brannan | |
| 5,456,315 | A | 10/1995 | Kisman | |
| 5,860,475 | A | 1/1999 | Ejiogu | |
| 6,158,510 | A | 12/2000 | Bacon | |
| 6,257,334 | B1 * | 7/2001 | Cyr et al. | 166/272.7 |
| 7,556,099 | B2 | 7/2009 | Arthur | |
| 8,327,936 | B2 * | 12/2012 | Coskuner | 166/272.3 |
| 2009/0272532 | A1 * | 11/2009 | Kuhlman | E21B 43/2406 166/268 |
| 2009/0288827 | A1 * | 11/2009 | Coskuner | 166/272.3 |
| 2010/0326656 | A1 | 12/2010 | Menard | |
| 2011/0288778 | A1 * | 11/2011 | Pavlovich | E21B 47/065 702/12 |
| 2014/0166280 | A1 * | 6/2014 | Stone | E21B 43/12 166/268 |

FOREIGN PATENT DOCUMENTS

| | | | | |
|---|---|---|---|---|
| CA | 2251157 | | 4/2000 | |
| CA | 2577680 | | 8/2007 | |
| CA | 2591498 | | 12/2007 | |
| CA | 2631977 | | 6/2009 | |
| CA | 2714646 | | 3/2012 | |
| CA | 2778135 | A1 * | 11/2012 | E21B 43/162 |
| WO | 2007143845 | | 12/2007 | |

OTHER PUBLICATIONS

Butler, R.M., Jiang, Q. and Yee, C.-T., "Steam and Gas Push (SAGP)—4; Recent Theoretical Developments and Laboratory Results Using Layered Models", Journal of Canadian Petroleum Technology, pp. 54-61, vol. 40, No. 1 Jan. 2001.

Butler, R.M., Jiang, Q. and Yee, C.-T., "Steam and Gas Push (SAGP)—3; Recent Theoretical Developments and Laboratory Results", Journal of Canadian Petroleum Technology, pp. 51-60, vol. 39, No. 8, Aug. 2000.

Jiang, Q., Butler, R. and Yee, C.-T., "The Steam and Gas Push (SAGP)—2: Mechanism Analysis and Physical Model Testing", Journal of Canadian Petroleum Technology, pp. 52-61, vol. 39, No. 4, Apr. 2000.

H. Shin and M. Polikar, "Review of Reservoir Parameters to Optimize SAGD and Fast-SAGD Operating Conditions", JCPT vol. 46, No. 1, Jan. 2007.

Butler et al, "Theoretical Studies on the Gravity Drainage of Heavy Oil During In-Situ Steam Heating", The Canadian Journal of Chemical Engineering, vol. 59, Aug. 1981 at 455.

Butler et al in "The gravity drainage of steam-heated heavy oil to parallel horizontal wells" (J. of Canadian Petroleum Technology, pp. 90-96, 1981).

Butler in "Rise of interfering steam chambers" (J. of Canadian Petroleum Technology, pp. 70-75, vol. 26, No. 3, 1986).

Butler et al in "Theoretical Estimation of Breakthrough Time and Instantaneous Shape of Steam Front During Vertical Steamflooding," (AOSTRA J. of Research, pp. 359-381, vol. 5, No. 4, 1989).

Chan et al, "Effects of Well Placement and Critical Operating Conditions on the Performance of Dual Well SAGD Well Pair in Heavy Oil Reservoir" (1997), SPE 39082.

Ferguson et al in "Steam-assisted gravity drainage model incorporating energy recovery from a cooling steam chamber" (J. of Canadian Petroleum Technology, pp. 75-83, vol. 27, No. 5, 1988).

Joshi et al, "Laboratory Studies of Thermally Aided Gravity Drainage Using Horizontal Wells" (AOSTRA J. of Research, pp. 11-19, vol. 2, No. 1, 1985).

Polikar, M., Cyr, T.J. and Coates, R.M., "Fast-SAGD: Half the Wells and 30% Less Steam", Paper No. SPE 65509/PS2000-148, Proc. 4th International Conference on Horizontal Well Technology, Calgary, Alberta (Nov. 6-8, 2000).

Chan, M. Y. S., Fong, J., and Leshchyshyn, T., "Effects of Well Placement and Critical Operating Conditions on the Performance of Dual Well Pair SAGD Well Pairs in Heavy Oil Reservoir," (1997), SPE-39082.†

* cited by examiner
† cited by third party

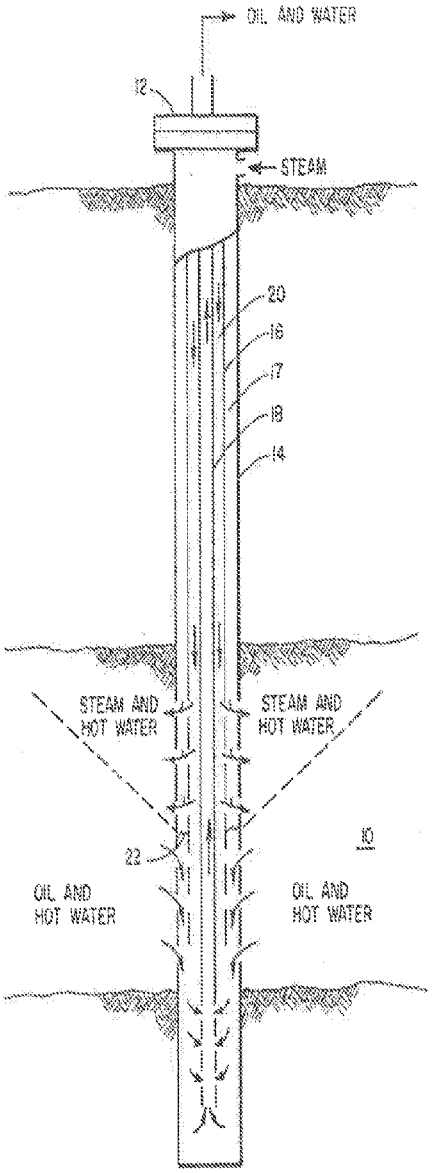
Figure 2
PRIOR ART
Figure 3A PRIOR ART
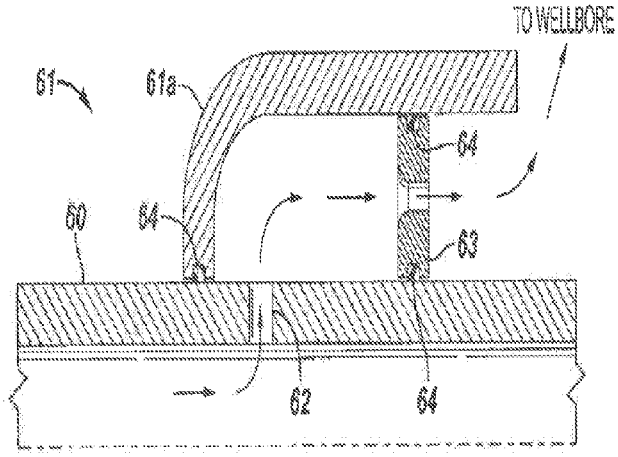
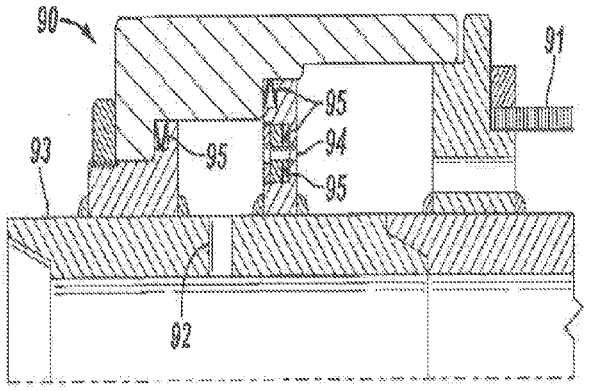
Figure 3B
PRIOR ART Figure 1C
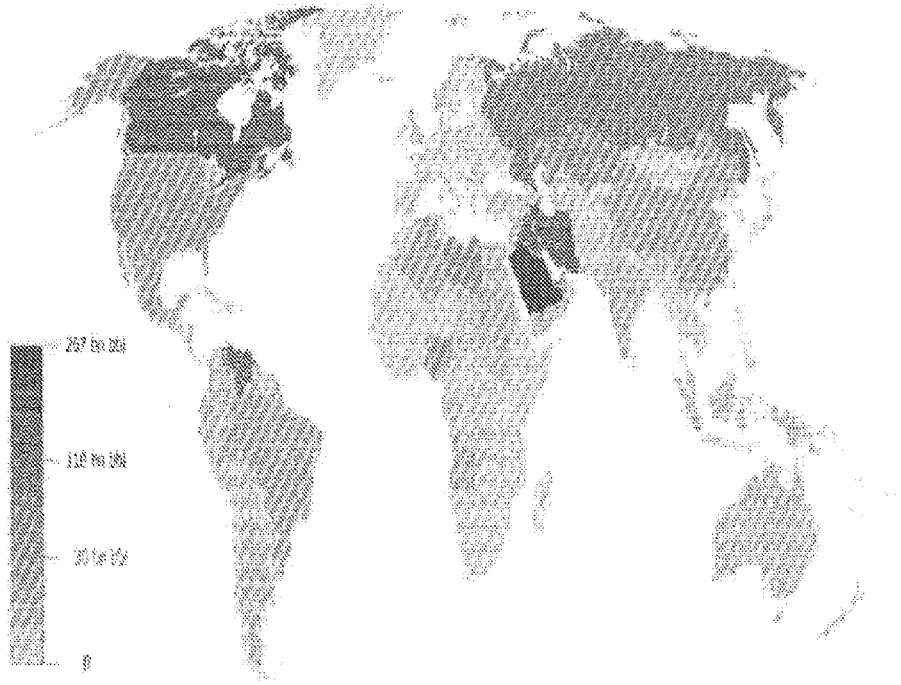
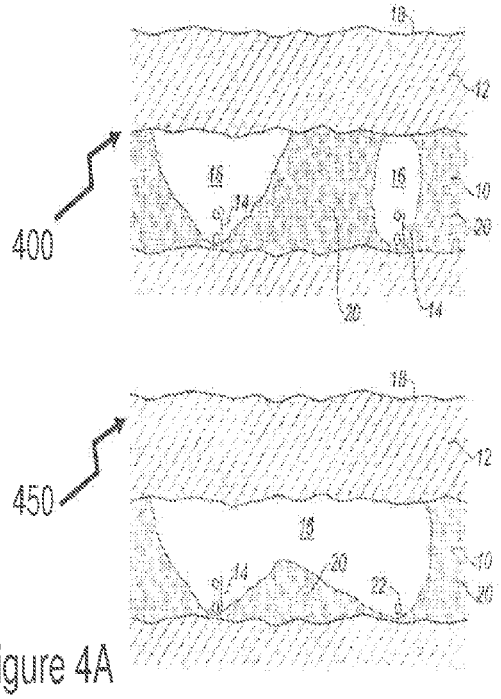
Figure 4A
PRIOR ART
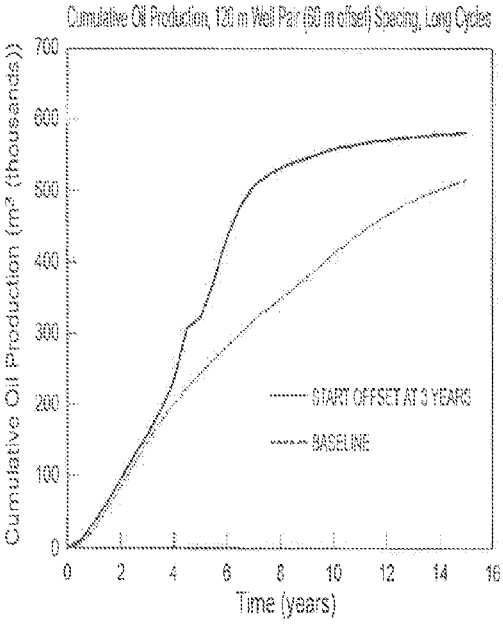
Figure 4B
PRIOR ART

PRIOR ART

PRESSURE ASSISTED OIL RECOVERY

CROSS-REFERENCE TO RELATED APPLICATIONS

This patent application claims the benefit of U.S. Provisional Patent Application 61/487,770 filed May 19, 2011 entitled "Pressure Assisted Oil Recovery."

FIELD OF THE INVENTION

This invention relates to oil recovery and more specifically to exploiting pressure in oil recovery.

BACKGROUND OF THE INVENTION

Over the last two centuries, advances in technology have made our civilization completely oil, gas & coal dependent. Whilst gas and coal are primarily use for fuel oil is different in that immense varieties of products are and can be derived from it. A "brief" list of some of these products includes gasoline, diesel, fuel oil, propane, ethane, kerosene, liquid petroleum gas, lubricants, asphalt, bitumen, cosmetics, petroleum jelly, perfume, dish-washing liquids, ink, bubble gums, car tires, etc. In addition to these oil is the source of the starting materials for most plastics that form the basis of a massive number of consumer and industrial products.

Table 1 below lists the top 15 consuming nations based upon 2008 data in terms of thousands of barrels (bbl) and thousand of cubic meters per day. FIG. 1A presents the geographical distribution of consumption globally.

TABLE 1

2008 Oil Consumption for Top 15 Consuming Nations

| | Nation | (1000 bbl/day) | (1000 $m^3$/day) |
|---|---|---|---|
| 1 | United States | 19,497.95 | 3,099.9 |
| 2 | China | 7,831.00 | 1,245.0 |
| 3 | Japan | 4,784.85 | 760.7 |
| 4 | India | 2,962.00 | 470.9 |
| 5 | Russia | 2,916.00 | 463.6 |
| 6 | Germany | 2,569.28 | 408.5 |
| 7 | Brazil | 2,485.00 | 395.1 |
| 8 | Saudi Arabia | 2,376.00 | 377.8 |
| 9 | Canada | 2,261.36 | 359.5 |
| 10 | South Korea | 2,174.91 | 345.8 |
| 11 | Mexico | 2,128.46 | 338.4 |
| 12 | France | 1,986.26 | 315.8 |
| 13 | Iran (OPEC) | 1,741.00 | 276.8 |
| 14 | United Kingdom | 1,709.66 | 271.8 |
| 15 | Italy | 1,639.01 | 260.6 |

In terms of oil production Table 1B below lists the top 15 oil producing nations and the geographical distribution worldwide is shown in FIG. 1B. Comparing Table 1A and Table 1B shows how some countries like Japan are essentially completely dependent on oil imports whilst most other countries such as the United States in the list whilst producing significantly are still massive importers. Very few countries, such as Saudi Arabia and Iran are net exporters of oil globally.

TABLE 2

Top 15 Oil Producing Nations

| | Nation | (1000 bbl/day) | Market Share |
|---|---|---|---|
| 1 | Saudi Arabia | 9,760 | 11.8% |
| 2 | Russia | 9,934 | 12.0% |

TABLE 2-continued

Top 15 Oil Producing Nations

| | Nation | (1000 bbl/day) | Market Share |
|---|---|---|---|
| 3 | United States | 9,141 | 11.1% |
| 4 | Iran (OPEC) | 4,177 | 5.1% |
| 5 | China | 3,996 | 4.8% |
| 6 | Canada | 3,294 | 4.0% |
| 7 | Mexico | 3,001 | 3.6% |
| 8 | UAE (OPEC) | 2,795 | 3.4% |
| 9 | Kuwait (OPEC) | 2,496 | 3.0% |
| 10 | Venezuela (OPEC) | 2,471 | 3.0% |
| 11 | Norway | 2,350 | 2.8% |
| 12 | Brazil | 2,577 | 3.1% |
| 13 | Iraq (OPEC) | 2,400 | 2.9% |
| 14 | Algeria (OPEC) | 2,126 | 2.6% |
| 15 | Nigeria (OPEC) | 2,211 | 2.7% |

In terms of oil reserves then these are dominated by a relatively small number of nations as shown below in Table 3 and in FIG. 1C. With the exception of Canada the vast majority of these oil reserves are associated with conventional oil fields. Canadian reserves being dominated by Athabasca oil sands which are large deposits of bitumen, or extremely heavy crude oil, located in northeastern Alberta, Canada. The stated reserves of approximately 170,000 billion barrels are based upon only 10% of total actual reserves, these being those economically viable to recover in 2006.

TABLE 3

Top 15 Oil Reserve Nations

| | Nation | Reserves (1000 bbl) | Share |
|---|---|---|---|
| 1 | Saudi Arabia | 264,600,000 | 19.00% |
| 2 | Canada | 175,200,000 | 12.58% |
| 3 | Iran | 137,600,000 | 9.88% |
| 4 | Iraq | 115,000,000 | 8.26% |
| 5 | Kuwait | 104,000,000 | 7.47% |
| 6 | United Arab Emirates | 97,800,000 | 7.02% |
| 7 | Venezuela | 97,770,000 | 7.02% |
| 8 | Russia | 74,200,000 | 5.33% |
| 9 | Libya | 47,000,000 | 3.38% |
| 10 | Nigeria | 37,500,000 | 2.69% |
| 11 | Kazakhstan | 30,000,000 | 2.15% |
| 12 | Qatar | 25,410,000 | 1.82% |
| 13 | China | 20,350,000 | 1.46% |
| 14 | United States | 19,120,000 | 1.37% |
| 15 | Angola | 13,500,000 | 0.97% |

Therefore in the vast majority of wells are drilled into oil reservoirs to extract the crude oil. An oil well is created by drilling a hole 5 to 50 inches (127.0 mm to 914.4 mm) in diameter into the earth with a drilling rig that rotates a drill string with a bit attached. After the hole is drilled, sections of steel pipe (casing), slightly smaller in diameter than the borehole, are placed in the hole. Cement may be placed between the outside of the casing and the borehole to provide structural integrity and to isolate high pressure zones from each other and from the surface. With these zones safely isolated and the formation protected by the casing, the well can be drilled deeper, into potentially more unstable formations, with a smaller bit, and also cased with a smaller size casing. Typically wells have two to five sets of subsequently smaller hole sizes drilled inside one another, each cemented with casing.

Oil recovery operations from conventional oil wells have been traditionally subdivided into three stages: primary, secondary, and tertiary. Primary production, the first stage of production, produces due to the natural drive mechanism existing in a reservoir. These "Natural lift" production methods that rely on the natural reservoir pressure to force the oil to the surface are usually sufficient for a while after reservoirs are first tapped. In some reservoirs, such as in the Middle East, the natural pressure is sufficient over a long time. The natural pressure in many reservoirs, however, eventually dissipates such that the oil must then be pumped out using "artificial lift" created by mechanical pumps powered by gas or electricity. Over time, these "primary" methods become less effective and "secondary" production methods may be used.

The second stage of oil production, secondary recovery, is usually implemented after primary production has declined to unproductive levels, usually defined in economic return rather than absolute oil flow. Traditional secondary recovery processes are water flooding, pressure maintenance, and gas injection, although the term secondary recovery is now almost synonymous with water flooding. Tertiary recovery, the third stage of production, commonly referred to as enhanced oil recovery ("EOR") is implemented after water flooding. Tertiary processes use miscible and/or immiscible gases, polymers, chemicals, and thermal energy to displace additional oil after the secondary recovery process becomes uneconomical.

Enhanced oil recovery processes can be classified into four overall categories: mobility control, chemical, miscible, and thermal.

- Mobility-control processes, as the name implies, are those based primarily on maintaining a favorable mobility ratio. Examples of mobility control processes are thickening of water with polymers and reducing gas mobility with foams.
- Chemical processes are those in which certain chemicals, such as surfactants or alkaline agents, are injected to utilize interfacial tension reduction, leading to improved displacement of oil.
- In miscible processes, the objective is to inject fluids that are directly miscible with the oil or that generate miscibility in the reservoir through composition alteration. The most popular form of a miscible process is the injection of carbon dioxide.
- Thermal processes rely on the injection of thermal energy or the in-situ generation of heat to improve oil recovery by reducing the viscosity of oil.

In the United States, primary production methods account for less than 40% of the oil produced on a daily basis, secondary methods account for about half, and tertiary recovery the remaining 10%.

Bituminous sands, colloquially known as oil sands or tar sands, are a type of unconventional petroleum deposit. The oil sands contain naturally occurring mixtures of sand, clay, water, and a dense and extremely viscous form of petroleum technically referred to as bitumen (or colloquially "tar" due to its similar appearance, odour, and colour). These oil sands reserves have only recently been considered as part of the world's oil reserves, as higher oil prices and new technology enable them to be profitably extracted and upgraded to usable products. They are often referred to as unconventional oil or crude bitumen, in order to distinguish the bitumen extracted from oil sands from the free-flowing hydrocarbon mixtures known as crude oil Many countries in the world have large deposits of oil sands, including the United States, Russia, and various countries in the Middle East. However, the world's largest deposits occur in two countries: Canada and Venezuela, each of which has oil sand reserves approximately equal to the world's total reserves of conventional crude oil. As a result of the development of Canadian oil sands reserves, 44% of Canadian oil production in 2007 was from oil sands, with an additional 18% being heavy crude oil, while light oil and condensate had declined to 38% of the total.

Because growth of oil sands production has exceeded declines in conventional crude oil production, Canada has become the largest supplier of oil and refined products to the United States, ahead of Saudi Arabia and Mexico. Venezuelan production is also very large, but due to political problems within its national oil company, estimates of its production data are not reliable. Outside analysts believe Venezuela's oil production has declined in recent years, though there is much debate on whether this decline is depletion-related or not.

However, irrespective of such issues the oil sands may represent as much as two-thirds of the world's total "liquid" hydrocarbon resource, with at least 1.7 trillion barrels ($270\times10^9$ $m^3$) in the Canadian Athabasca Oil Sands alone assuming even only a 10% recovery rate. In Oct. 2009, the United States Geological Service updated the Orinoco oil sands (Venezuela) mean estimated recoverable value to 513 billion barrels ($81.6\times10^9$ $m^3$) making it "one of the world's largest recoverable" oil deposits. Overall the Canadian and Venezuelan deposits contain about 3.6 trillion barrels ($570\times10^9$ $m^3$) of recoverable oil, compared to 1.75 trillion barrels ($280\times10^9$ $m^3$) of conventional oil worldwide, most of it in Saudi Arabia and other Middle-Eastern countries.

Because extra-heavy oil and bitumen flow very slowly, if at all, toward producing wells under normal reservoir conditions, the oil sands must be extracted by strip mining and processed or the oil made to flow into wells by in situ techniques, which reduce the viscosity. Such in situ techniques include injecting steam, solvents, heating the deposit, and/or injecting hot air into the oil sands. These processes can use more water and require larger amounts of energy than conventional oil extraction, although many conventional oil fields also require large amounts of water and energy to achieve good rates of production. Accordingly, these oil sand deposits were previously considered unviable until the 1990s when substantial investment was made into them as oil prices increased to the point of economic viability as well as concerns over security of supply, long term global supply, etc.

Amongst the reasons for more water and energy of oil sand recovery apart from the initial energy expenditure in reducing viscosity is that the heavy crude feedstock recovered requires pre-processing before it is fit for conventional oil refineries. This pre-processing is called 'upgrading', the key components of which are:

1. removal of water, sand, physical waste, and lighter products;
2. catalytic purification by hydrodemetallisation (HDM), hydrodesulfurization (HDS) and hydrodenitrogenation (HDN); and
3. hydrogenation through carbon rejection or catalytic hydrocracking (HCR).

As carbon rejection is very inefficient and wasteful in most cases, catalytic hydrocracking is preferred in most cases. All these processes take large amounts of energy and water, while emitting more carbon dioxide than conventional oil.

Amongst the category of known secondary production techniques the injection of a fluid (gas or liquid) into a formation through a vertical or horizontal injection well to drive hydrocarbons out through a vertical or horizontal production well. Steam is a particular fluid that has been used. Solvents and other fluids (e.g., water, carbon dioxide, nitrogen, propane and methane) have also been used. These fluids typically have been used in either a continuous injection and production process or a cyclic injection and production process. The injected fluid can provide a driving force to push hydrocarbons through the formation, or the injected fluid can enhance the mobility of the hydrocarbons (e.g., by reducing viscosity via heating) thereby facilitating the release of the more mobile hydrocarbons to a production location. Recent developments using horizontal wells have focused on utilizing gravity drainage to achieve better results. At some point in a process using separate injection and production wells, the injected fluid may migrate through the formation from the injection well to the production well thereby "contaminating" the oil recovered in the sense that additional processing must be applied before the oil can be pre-processed for compatibility with convention oil refineries working with the light oil recovered from conventional oil well approaches.

Therefore, a secondary production technique injecting a selected fluid and for producing hydrocarbons should maximize production of the hydrocarbons with a minimum production of the injected fluid, see for example U.S. Pat. No. 4,368,781. Accordingly, the early breakthrough of the injected fluid from an injection well to a production well and an excessive rate of production of the injected fluid is not desirable. See for example Joshi et al in "Laboratory Studies of Thermally Aided Gravity Drainage Using Horizontal Wells" (AOSTRA J. of Research, pages 11-19, vol. 2, no. 1, 1985). It has also been disclosed that optimum production from a horizontal production well is limited by the critical velocity of the fluid through the formation. This being thought necessary to avoid so-called "fingering" of the injected fluid through the formation, see U.S. Pat. No. 4,653,583, although in U.S. Pat. No. 4,257,650 it is disclosed that "fingering" is not critical in radial horizontal well production systems.

The foregoing disclosures have been within contexts referring to various spatial arrangements of injection and production wells, which can be classified as follows: vertical injection wells with vertical production wells, horizontal injection wells with horizontal production wells, and combinations of horizontal and vertical injection and production wells. Whilst embodiments of the invention described below can be employed in all of these configurations the dominant production methodology today relates to the methods using separate, discrete horizontal injection and production wells. This arises due to the geological features of oil sands wherein the oil bearing are typically thin but distributed over a large area. Amongst the earliest prior art for horizontal injection wells with horizontal production well arrangements are U.S. Pat. Nos. 4,700,779; 4,385,662; and 4,510,997.

Within the initial deployments the parallel horizontal injection and production wells vertically were aligned a few meters apart as disclosed in the aforementioned article by Joshi. Associated articles include:

- Butler et al in "The gravity drainage of steam-heated heavy oil to parallel horizontal wells" (J. of Canadian Petroleum Technology, pages 90-96, 1981);
- Butler in "Rise of interfering steam chambers" (J. of Canadian Petroleum Technology, pages 70-75, vol. 26, no. 3, 1986);
- Ferguson et al in "Steam-assisted gravity drainage model incorporating energy recovery from a cooling steam chamber" (J. of Canadian Petroleum Technology, pages 75-83, vol. 27, no. 5, 1988);
- Butler et al in "Theoretical Estimation of Breakthrough Time and Instantaneous Shape of Steam Front During Vertical Steamflooding," (AOSTRA J. of Research, pages 359-381, vol. 5, no. 4, 1989); and
- Griffin et al in "Laboratory Studies of the Steam-Assisted Gravity Drainage Process," (5$^{th}$ Advances in Petroleum Recovery & Upgrading Technology Conference, June 1984, Calgary, Alberta, Canada (session 1, paper 1).

Vertically aligned horizontal wells are also disclosed in U.S. Pat. Nos. 4,577,691; 4,633,948; and 4,834,179. Staggered horizontal injection and production wells, wherein the injection and production wells are both laterally and vertically spaced from each other, are disclosed in Joshi in "A Review of Thermal Oil Recovery Using Horizontal Wells" (In Situ, Vol. 11, pp 211-259, 1987); Change et al in "Performance of Horizontal-Vertical Well Combinations for Steamflooding Bottom Water Formations," (CIM/SPE 90-86, Petroleum Society of CIM/Society of Petroleum Engineers) as well as U.S. Pat. Nos. 4,598,770 and 4,522,260.

Amongst other patents addressing such recovery processes are U.S. Pat. Nos. 5,456,315' 5,860,475; 6,158,510; 6,257,334; 7,069,990; 6,988,549; 7,556,099; 7,591,311 and US Patent Applications 2006/0,207,799; 2008/0,073,079; 2010/0,163,229, 2009/0,020,335; 2008/0,087,422; 2009/0,255,661; 2009/0,260,878; 2009/0,260,878; 2008/0,289,822; 2009/0,044,940; 2009/0,288,827; and 2010/0,326,656. Additionally there are literally hundreds of patents relating to the steam generating apparatus, drilling techniques, sensors, etc associated with such production techniques as well as those addressing combustion assisted gravity drainage etc.

The first commercially applied process was cyclic steam stimulation, commonly referred to as "huff and puff", wherein steam is injected into the formation, commonly at above fracture pressure, through a usually vertical well for a period of time. The well is then shut in for several months, referred to as the "soak" period, before being re-opened to produce heated oil and steam condensate until the production rate declines. The entire cycle is then repeated and during the course of the process an expanding "steam chamber" is gradually developed where the oil has drained from the void spaces of the chamber, been produced through the well during the production phase, and is replaced with steam. Newly injected steam moves through the void spaces of the hot chamber to its boundary, to supply heat to the cold oil at the boundary.

However, there are problems associated with the cyclic process including:

- fracturing tends to occur vertically along a direction dictated by the tectonic regime present in the formation;
- steam tends to preferentially move through the fractures and heat outwardly therefrom so that developed chamber tends to be relatively narrow;
- low efficiency with respect to steam utilization; and
- there are large bodies of unheated oil left in the zone extending between adjacent wells with their linearly extending steam chambers.

Accordingly, the cyclic process relatively low oil recovery. As such, as described in Canadian Patent 1,304,287, a continuous steam process has become dominant approach, known as steam-assisted gravity drainage ("SAGD"). The approach exploiting:

- a pair of coextensive horizontal wells, one above the other, located close to the base of the formation;

the formation between the wells is heated by circulating steam through each of the wells at the same time to create a pair of "hot fingers";

when the oil is sufficiently heated so that it may be displaced or driven from one well to the other, fluid communication between the wells is established and steam circulation through the wells is terminated;

steam injection below the fracture pressure is initiated through the upper well and the lower well opened to produce draining liquid; and the production well is throttled to maintain steam trap conditions and to keep the temperature of the produced liquid at about 6-10° C. below the saturation steam temperature at the production well.

This ensures a short column of liquid is maintained over the production well, thereby preventing steam from short-circuiting into the production well. As the steam is injected, it rises and contacts cold oil immediately above the upper injection well. The steam gives up heat and condenses; the oil absorbs heat and becomes mobile as its viscosity is reduced. The condensate and heated oil drain downwardly under the influence of gravity. The heat exchange occurs at the surface of an upwardly enlarging steam chamber extending up from the wells. This chamber being constituted of depleted, porous, permeable sand from which the oil has largely drained and been replaced by steam.

The steam chamber continues to expand upwardly and laterally until it contacts the overlying impermeable overburden and has an essentially triangular cross-section. If two laterally spaced pairs of wells undergoing SAGD are provided, their steam chambers grow laterally until they contact high in the reservoir. At this stage, further steam injection is terminated and production declines until the wells are abandoned. The SAGD process is characterized by several advantages, including relatively low pressure injection so that fracturing is not likely to occur, steam trap control minimizes short-circuiting of steam into the production well, and the SAGD steam chambers are broader than those developed by the cyclic process.

As a result oil recovery is generally better and with reduced energy consumption and emissions of greenhouse gases. However, there are still limitations with the SAGD process which need addressing. These include the need to more quickly achieve production from the SAGD wells, the need to heat the formation laterally between laterally spaced wells to increase the oil recovery percentage; and provide SAGD operating over deeper oil sand formations.

In SAGD the velocity of bitumen falling through a column of porous media having equal pressures at top and bottom can be calculated from Darcy's Law, see Equation 1.

$$U_O^q = \frac{k_O P_O g_O}{\mu_O} \tag{1}$$

where $k_O$ is the effective permeability to bitumen and $\mu_O$ is the viscosity of the bitumen. For Athabasca bitumen at about 200° C. and using 5 as the value Darcy's effective permeability, the resulting velocity will be about 40 cm/day. Extending this to include a pressure differential then the equation for the flow velocity becomes that given by Equation 2.

$$U_O^+ = \frac{k_O P_O g}{\mu_O} + \frac{k_O \Delta P}{\mu_O L}$$

where ΔP is the pressure differential between the two well bores and L is the interwell bore separation. For a typical interwell spacing this results in the value given in Table 1 below.

TABLE 1

Increased Bitumen Velocity under Pressure Differential

| ΔP (psia) | $k_o\Delta/\mu_o L$ (cm/day) | $k_o P_o g/\mu_o = U_o q$ (cm/day) | $U_o^+$ (cm/day) | $U_o^{+/U_o} g$ |
|---|---|---|---|---|
| 0.00 | 0.000 | 39.4 | 39.4 | 1.00 |
| 0.01 | 0.046 | 39.4 | 39.5 | 1.00 |
| 0.10 | 0.427 | 39.4 | 39.9 | 1.01 |
| 1.00 | 4.410 | 39.4 | 43.8 | 1.11 |
| 10.00 | 44.200 | 39.4 | 83.6 | 2.12 |
| 50.00 | 220.8 | 39.4 | 260.0 | 6.60 |

It is evident from the data presented in Table 1 that a pressure differential can substantially increase the mobility of the heavy oil in oil sand deposits. Considering the Athabasca oil sands about 20 percent of the reserves are recoverable by surface mining where the overburden is less than 75 m (250 feet). It is the remaining 80 percent of the oil sands that are buried at a depth of greater than 75 m where SAGD and other in-situ technologies apply. Typically, pressure increases at an average rate of approximately 0.44 psi per foot underground, such that the pressure at 250 feet is 110 psi higher than at the surface, at 350 feet it is 154 psi higher. For comparison atmospheric pressure is approximately 14.7 psi, such that the pressure at 350 feet is approximately 10 atmospheres.

Accordingly, the inventor has established that beneficially pressure differentials may be exploited to advance production from SAGD wells by increasing the velocity of heavy oils, that pressure differentials may be exploited to adjust the evolution of the steam chambers formed laterally between laterally spaced wells to increase the oil recovery percentage, and provide SAGD operating over deeper oil sand formations.

SUMMARY OF THE INVENTION

It is an object of the present invention to enhance second stage oil recovery and more specifically to exploiting pressure in oil recovery.

In accordance with an embodiment of the invention there is provided a method comprising:

providing first and second well pairs separated by a first predetermined separation, each well pair comprising:

a first well within an oil bearing structure; and a second well within the oil bearing structure at a first predetermined vertical offset to the first well, substantially parallel to the first well and a first predetermined lateral offset to the first well;

providing a third well within the oil bearing structure at a predetermined location between the first and second well pairs;

selectively injecting a first fluid into the first well of each well pair according to a first predetermined schedule under first predetermined conditions to create a zone of increased mobility within the oil bearing structure; and generating a large singular zone of increased mobility by selectively injecting a second fluid into the third well according to a second predetermined schedule under second predetermined conditions at least one of absent and prior to any communication between the zones of increased mobility.

In accordance with an embodiment of the invention there is provided providing first and second well pairs separated by a first predetermined separation, each well pair comprising:

providing a first well within an oil bearing structure having a predetermined substantially non-parallel relationship to a second well; and the second well within the oil bearing structure having a predetermined portion of the second well at a first predetermined vertical offset and a first predetermined lateral offset to a predetermined portion of the first well;

providing a third well within the oil bearing structure at a predetermined location between the first and second well pairs;

selectively injecting a first fluid into the first well of each well pair according to a first predetermined schedule under first predetermined conditions to create a zone of increased mobility within the oil bearing structure; and generating a large singular zone of increased mobility by selectively injecting a second fluid into the third well according to a second predetermined schedule under second predetermined conditions at least one of absent and prior to any communication between the zones of increased mobility.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 1C depicts the geographical distribution worldwide of oil reserves;

FIG. 2 depicts a secondary oil recovery well structure according to the prior art of Jones in U.S. Pat. No. 5,080,172;

FIGS. 3A and 3B depict outflow control devices according to the prior art of Forbes in US Patent Application 2008/0,251,255 for injecting fluid into an oil bearing structure;

FIGS. 4A and 4B depict a SAGD process according to the prior art of Cyr et al in U.S. Pat. No. 6,257,334;

DETAILED DESCRIPTION

Figure 1A:
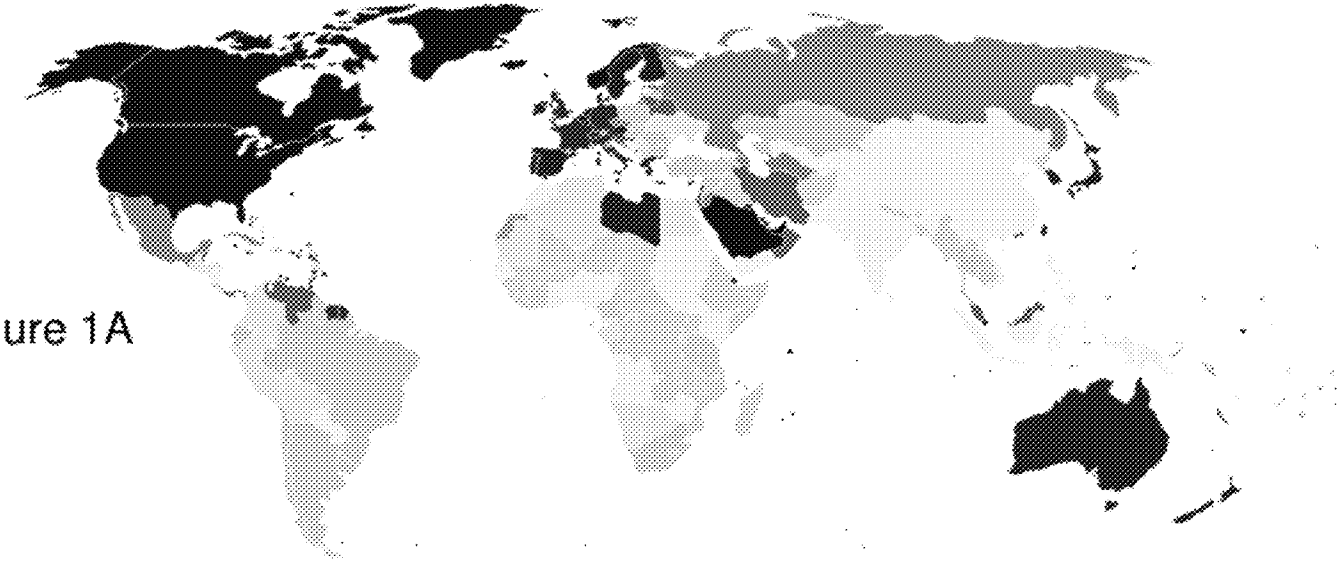
FIG. 1A depicts the geographical distribution of consumption globally.

The present invention is directed to second stage oil recovery and more specifically to exploiting pressure in oil recovery.

Referring to FIG. 2 there is depicted a secondary oil recovery well structure according to the prior art of Jones in U.S. Pat. No. 5,080,172 entitled "Method of Recovering Oil Using Continuous Steam Flood from a Single Vertical Wellbore." Accordingly there is illustrated a relatively thick subterranean, viscous oil-containing formation 10 penetrated by well 12. The well 12 has a casing 14 set below the oil-containing formation 10 and in fluid communication with the full vertical thickness of the formation 10 by means of perforations. Injection tubing 16 is positioned coaxially inside the casing 14 forming an annular space 17. Injection tubing 16 extends near the bottom of the formation 10 and is in fluid communication with that portion of the annulus 17 adjacent to the full vertical thickness of the formation by means of perforations as shown in FIG. 2A or is in fluid communication with the lower portion of the annulus 17 by an opening at its lower end. Production tubing 18 passes downwardly through injection tubing 18 forming an annular space 20 between injection tubing 16 and production tubing 18. Production tubing 18 extends to a point adjacent the bottom, i.e., at the bottom or slightly above or below the bottom, or below the bottom of the oil-containing formation 10, preferably 10 feet or less, and may be perforated in the lower portion to establish fluid flow communication with the lower portion of the formation 10 as shown in FIG. 2A.

Production tubing 18 is axially aligned inside injection tubing 16. In another embodiment the lower end of tubing may simply be open to establish fluid communication with the lower portion of the formation 10. Production tubing 18 can be fixed in the wellbore or preferably provided with means to progressively withdraw or lower the production tubing inside the wellbore to obtain improved steam-oil ratios and/or higher oil production rates. If desirable, the well casing 14 is insulated to about the top of the oil-containing formation 10 to minimize heat losses.

In the first phase, steam is injected into the oil-containing formation 10 via the annular space 20 between injection tubing 16 and production tubing 18 until the oil-containing formation 10 around the casing 14 becomes warm and the pressure in the formation is raised to a predetermined value. The injected steam releases heat to the formation and the oil resulting in a reduction in the viscosity of the oil and facilitating its flow by gravitational forces toward the bottom of the formation where it is recovered along with condensation water via production tubing 18. Production flow rate restriction may be accomplished by use of a choke or a partially closed throttling valve.

As discussed supra SAGD and pressure assisted oil recovery according to embodiments of the invention employ an injection well bore and a production well bore. In VASSOR as described below in respect of FIGS. 6 to 13 an additional bore may be disposed alongside the injection and production well bores or the production well bore may operate during predetermined periods as the pressure bore. Disposed within the production well bore is outflow control device 61 according to the prior art of Forbes in US Patent Application 2008/0,251,255 as shown in FIG. 3A.

Inflow control device 61 as shown comprises a housing 61*a*, formed on tubing 60, which is resident in steam injection pipe string apparatus. Steam may be directed through opening 62 in tubular member 60 and then through orifice 63 and into the injection wellbore. Orifice 63 may, for example, comprise a nozzle. Referring to FIG. 3B there is shown an inflow control device 90 which is utilized with sand screen apparatus 91. An opening 92 is formed in base pipe 93 to permit the flow of steam through nozzle 94 and into the steam injection wellbore via sand screen apparatus 91. The inflow control device 90 utilizes a plurality of C-type metal seals 95. An example of a sand screen for such inflow control device is presented in US Patent Application 2006/0,048,942.

In accordance with the present invention, a steam injection pipe string apparatus according may further comprise Distributed Temperature Sensing (DST) apparatus. Such DST apparatus advantageously utilizes fiber optic cables containing sensors to sense the temperature changes along the length of the injection apparatus and may, for example, provide information from which adjustments to the steam injection process are derived.

Now referring to FIG. 4A there is depicted there are depicted SAGD process cross-sections according to the prior art wherein a pair of groups of wells are viewed in cross-section according to standard process 400 and advanced process 450 according to the prior art of Cyr et al in U.S. Pat. No. 6,257,334. Accordingly in each case there are shown a pair of wells 14, consisting of an upper steam injection well and lower production well. These are disposed to the bottom of the oil sand layer 10. This oil sand layer 10 being disposed beneath rock overburden 12 that extends to the surface 18. In standard process 14 the SAGD process at maturity results in steam chambers 16 which are disconnected within the oil sand layer and generally triangular in cross-section but specific conditions within the oil sand layer 10 may means that oil 20 is not recovered in the same manner from one pair of wells (right hand side) to another pair of wells (left hand side). At maturity there is still significant oil 20 left within the oil sand layer 10.

In advanced process 450 Cyr teaches to exploiting a combination of SAGD with huff-and-puff. Within the advanced process 450, as modeled by Cyr, an initial nine months of injection were followed by three months of production followed by six months of injection followed by three months of production at which time the offset well was converted to full time production under steam trap control. The offset well distance was established at 60 m. Huff-and-puff was started after 3 years of initial SAGD only with a puff duration of nineteen months. For the remainder of the run, SAGD was practiced with the offset well acting as a second SAGD production well. Accordingly to Cyr advanced process 450 resulted in an increased production rate and an increased overall production as evident in FIG. 4B. However, it is evident that there is still unrecovered oil 20 in the region between the groups of wells even under the advanced aggressive conditions considered by Cyr as evident from advanced process 450 in FIG. 4A.

Figure 4C:
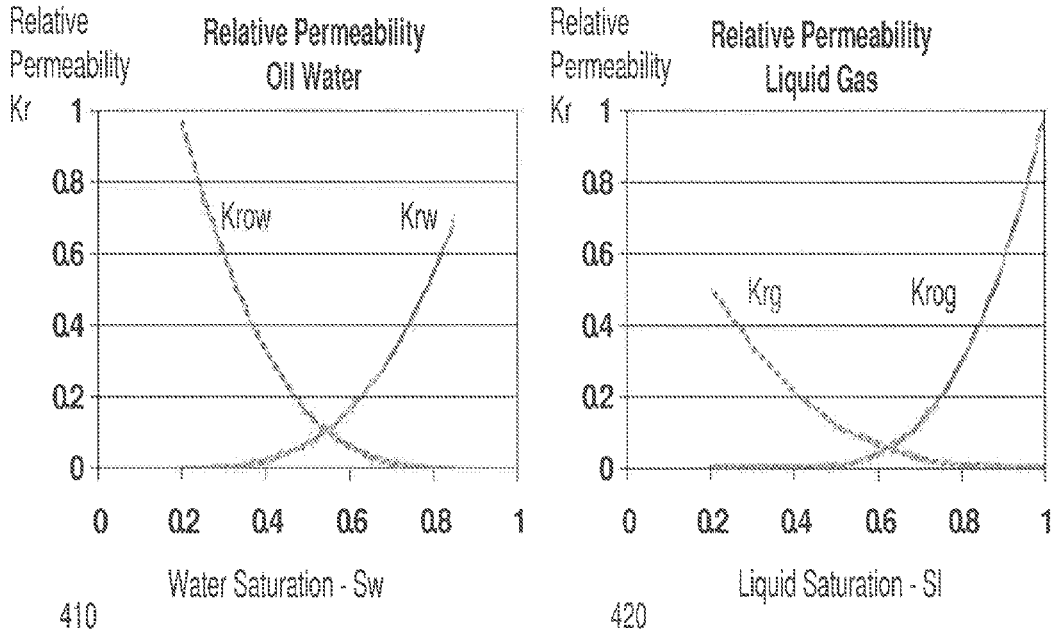
Figure 4C PRIOR ART
FIG. 4C depicts the relative permeability of oil-water and liquid gas employed in the simulations of prior art SAGD and SAGD according to embodiments of the invention together with bitumen viscosity.
Figure 4C:
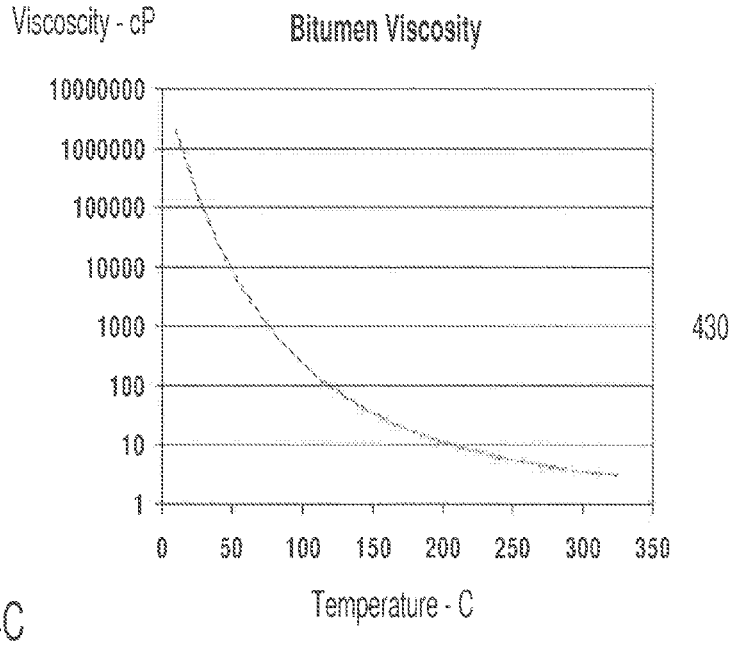
Figure 4C PRIOR ART

In order to evaluate the prior art of Cyr simulations were run of a typical oil-sand scenario as described below in Table 2. The relative permeability of oil-water is depicted in FIG. 4C but first graph 410 whilst second graph 420 depicts the relative permeability of liquid gas. Also depicted in FIG. 4C is third graph 430 depicting the reducing viscosity of bitumen with temperature assumed within the simulations. Data for the simulations was derived from published measurement data filed by Cenovus Energy Inc. in compliance with Canadian Energy Resources Conservation Board requirements for its Christina Lake SAGD activities within the Athabasca oil sands (SAGD 8591 Subsurface, Jun. 15, 2011, (http://www.ercb.ca/portal/server.pt/gateway/PTARGS_0_0_312_249_0_43/http %3B/ercbco ntent/publishedcontent/publish/ercb_home/industry_zone/industry_activity_and_data/in_situ_progress_reports/2011/). The Athabasca oil sands together with the Cold Lake and Peace River oil sands are all in Northern Alberta, Canada and represent the three major oil sands deposits in Alberta that lie under 141,000 square kilometers of boreal forest and peat moss which are estimated to contain 1.7 trillion barrels ($270\times10^9$ $m^3$) of bitumen which are therefore comparable in magnitude to the worlds proven reserves of conventional petroleum.

TABLE 2

Reservoir Characteristics and Key Simulation Parameters:

| Parameter | Value | Parameter | Value |
|---|---|---|---|
| Reservoir Pressure | 2000 kPa | Initial Oil Saturation | 0.85 |
| Reservoir Temperature | 10° C. | Initial Water Saturation | 0.15 |
| Porosity | 0.34 | Initial Gas Saturation | 0 |
| Permeability | 1 D | Reservoir Width | 200 m |
| Kv/Kh | 0.5 | Reservoir Thickness | 30 m |
| | | Simulation Time | 10 years |

Additional operating parameters and constraints plus thermal properties of the modeled structure are presented below in Tables 3 to 5 respectively.

TABLE 3

Operating Parameters used in Simulations

| Parameter | Value | Parameter | Value |
|---|---|---|---|
| Injection Pressure | 1800 kPa | Well Length | 700 m |
| Steam Quality | 0.9 | Preheating Days | 90 |
| Steam Temperature | 200° C. | | |

TABLE 4

Injection and Production Well Constraints

| Injection Well Constraints | | Production Well Constraints | |
|---|---|---|---|
| Operate Min BHP | 800 kPa | Operate Min BHP | 800 kPa |
| Operate Max Total Surface Wafer Injection Rate | 350 $m^3$/day (CWE) | Operate Max Steam | 0.5 $m^3$/day |
| | | Operate Max Total Surface Liquid Rate | 700 $m^3$/day |

TABLE 5

Thermal Properties

| Thermal Properties | | Over-burden/Under-burden | |
|---|---|---|---|
| Rock Volumetric Heat Capacity | 2.347E+06 J/($m^3$ · ° C.) | Volumetric Heat Capacity | 2.35E+06 J/($m^3$ · ° C.) |
| Rock Thermal Conductivity | 2.74E+05 J/(m · day · ° C.) | Thermal Conductivity | 1.50E+05 J/(m · day · ° C. |
| Oil Phase Thermal Conductivity | 1.15E+04 J/(m · day · ° C.) | | |
| Water Phase Thermal Conductivity | 5.35E+06 J/(m · day · ° C.) | | |
| Gas Phase Thermal Conductivity | 2.50E+03 J/(m · day · ° C.) | | |

Figure 4D:
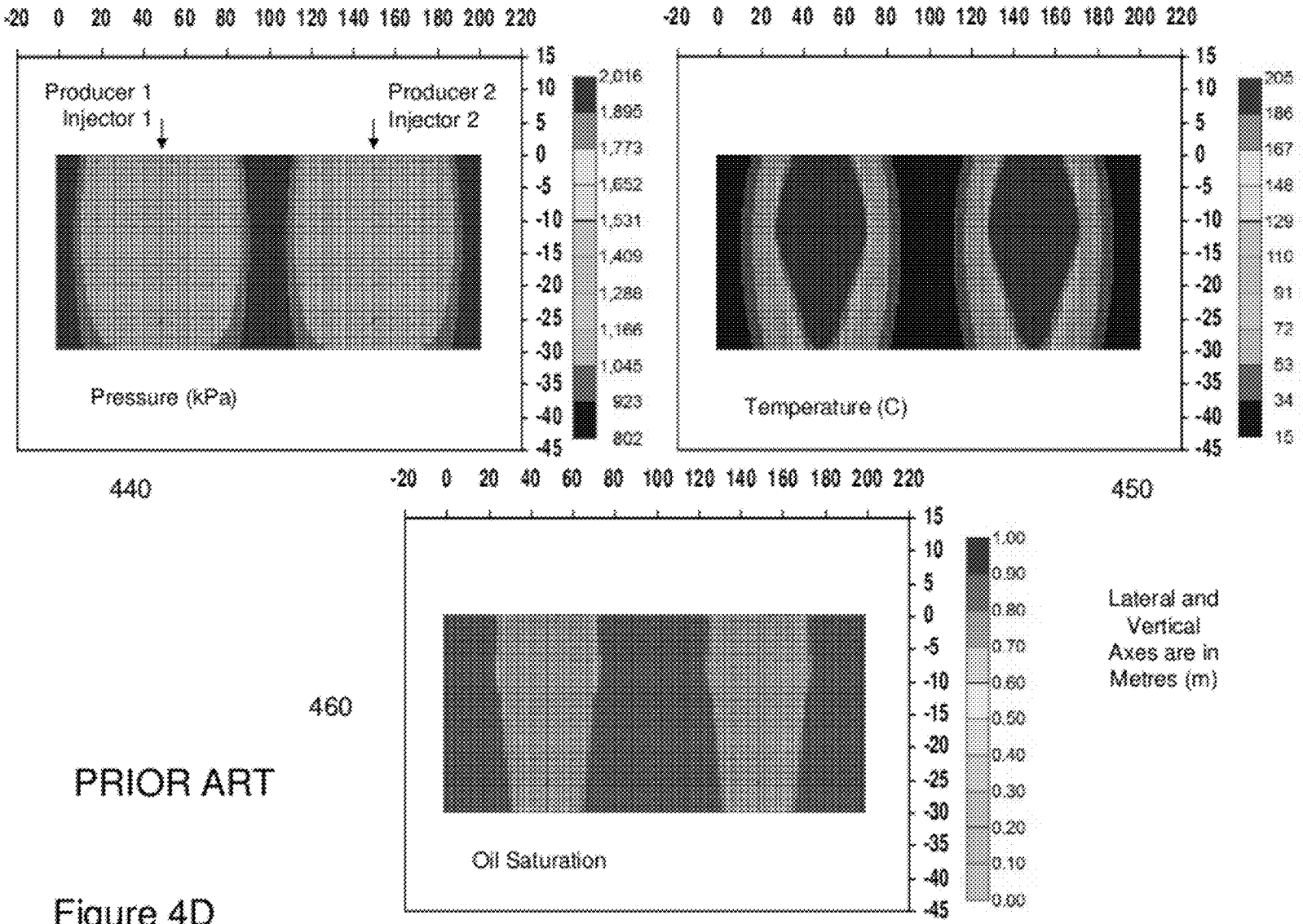
PRIOR ART Figure 4D
FIGS. 4D and 4E depict simulation results for a SAGD process according to the prior art showing depletion and isolation of each SAGD well-pair.
Figure 4E:
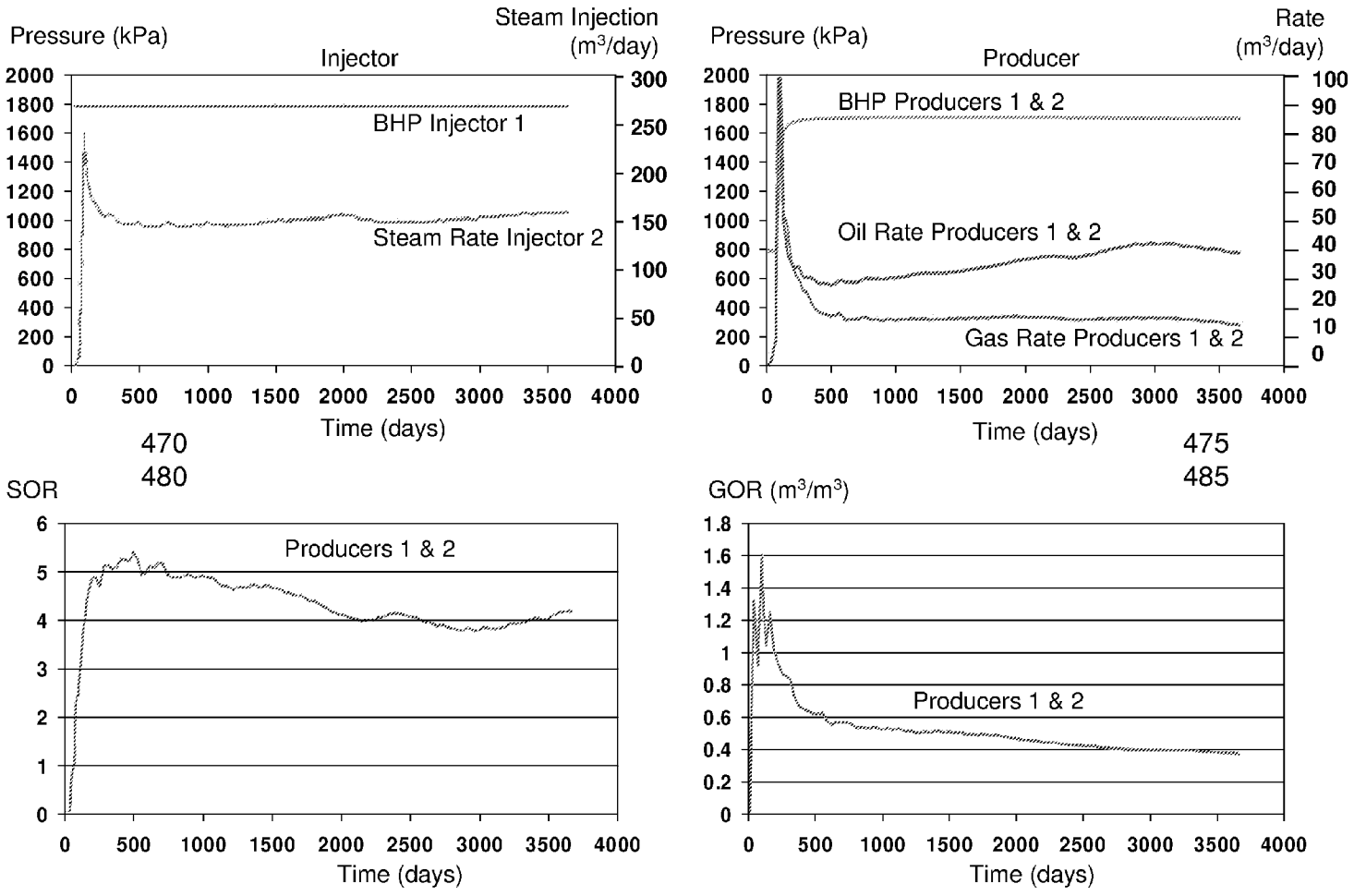
PRIOR ART Figure 4E

Referring to FIGS. 4D and 4E simulation results for a conventional SAGD process according to the prior art of Cyr and others is presented with injector wells disposed vertically above production wells are presented. SAGD well-pair separation of 100 m and vertical injector-producer pair spacing of 4 m are employed with the injector parameters defined above in Table 3 together with the production/injector well constraints and thermal properties presented in Tables 4 and 5. First and second graphs 440 and 450 present contours of pressure and temperature within the simulated oil sand layer after 10 years of SAGD operation. As evident from the temperature profiles in second graph 450 each SAGD well-pair has generated a hot vertical profile that is still cold between them being only approximately 10-20° C. warmer than the original oil sand layer at 10° C. Accordingly as evident from third graph 460 in FIG. 4D the oil saturation has only reduced in these vertical hot zones with an effective zone width of approximately 30 m towards the upper region of the vertical hot zones and tapers towards the lower half of the layer cross-section towards the SAGD well-pair.

Referring to FIG. 4E first to fourth graphs 470 through 485 respectively depict as a function of time over the 10 year modeling cycle:

- the injector pressure (kPa) and steam injection rate ($m^3$/day);
- the producer pressure (kPa) and oil production rate ($m^3$/day);
- steam-to-oil ratio (SOR) which is steam injection rate divided by oil production rate;
- gas-to-oil (GOR) which is the ratio between gas produced through the SAGD well-pairs and the oil produced.

Figure 5A:
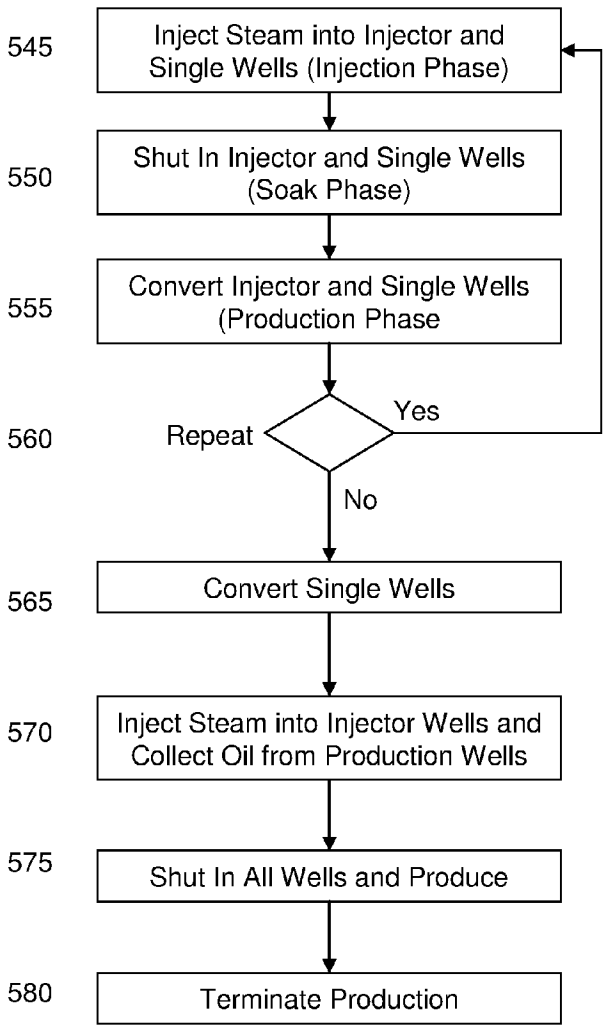
FIG. 5A depicts a CSS-SAGD oil recovery scenario according to the prior art of Coskuner in US Patent Application 2009/0,288,827.
Figure 5A:
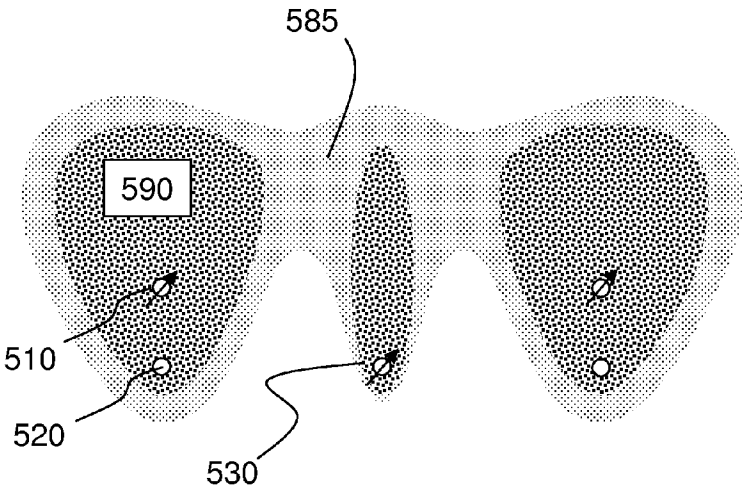

Now referring to FIG. 5A there is depicted an oil recovery scenario according to the prior art of Coskuner in US Patent Application 2009/0,288,827 entitled "In-Situ Thermal Process for Recovering Oil from Oil Sands" wherein groups of wells are disposed across the oil sands. Each group of wells each consisting of a vertically-spaced SAGD well pair, comprising an injector well 510 and a producer well 520, and a single cyclic steam stimulation (CSS) well 530 that is offset from and adjacent to the SAGD well pair comprising injector well 510 and producer well 520. Although FIG. 5 shows two such groups of wells, the combined CSS and SAGD process of Coskuner, referred to as CSS-SAGD, can employ a different number of groups, and can have any number of well groups following this pattern. As taught by Coskuner the single wells 530 are located at the same depth as the producer wells 520 although the single wells 530 are taught as being locatable at depths $d_{PROD}-0.5\times\Delta d\leq d_{CSS}\leq d_{INJ}+0.5\times\Delta d$ where $d_{PROD}$, and $d_{INJ}$ are the depths of the producer well 520 and injector well 510 respectively and $\Delta d=MAG[d_{INJ}-d_{PROD}]$.

Accordingly the CSS-SAGD process of Coskuner employs an array of SAGD well pairs comprising injector wells 510 and producer wells 520 with intermediate CSS wells comprising single wells 530. Coskuner notes that the well configurations of the injector, producer, and injector wells 510, 520, and 530 respectively will depend on the geological properties of the particular reservoir and the operating parameters of the SAGD and CSS processes, as would be known to one skilled in the art. Accordingly the spacing between each SAGD well pair (comprising injector wells 510 and producer wells 520) and offset single well 530 will also depend on the properties of the reservoir and the operating parameters of CSS-SAGD process; in particular, the spacing should be selected such that steam chambers from the injector well of the well pair and the single well can come into contact with each other within a reasonable amount of time so that the accelerated production aspect of the process is taken advantage of.

As taught by Coskuner the CSS-SAGD process comprises four stages:

Initial CSS stage, wherein the injector wells 510 (or producer wells 520) and the single wells 530 are operated as CSS wells for one or more cycles;

Soak stage, wherein all wells are closed off and the reservoir "soaks;"

SAGD production stage, wherein a SAGD operation is applied to the SAGD well pairs comprising injector wells 510 and producer wells 520 and the single wells 530 are operated as production wells, i.e. where steam is injected into injector wells 510 and the bitumen, and other mobilized elements of the reservoir, is produced from either one or both of the producer wells and single wells 520 and 530 respectively under gravity assisted displacement; and Blowdown stage, wherein steam injection is terminated and the reservoir is produced to economic limit.

As shown in FIG. 5A a flow chart illustrates the different steps of the CSS-SAGD process according to Coskuner. Steps 545 to 555 comprise the initial CSS stage wherein in step 545, steam is injected into the injector and single wells 510 and 530 respectively under the same pressure and for a selected period of time (injection phase). In step 550, the injector and single wells 510 and 530 respectively are shut in to soak (soak phase). In step 555, the injector and single wells 510 and 530 respectively are converted into production wells and oil is extracted (producing phase). If additional CSS cycles are desired then steps 545 to 555 are repeated as determined in step 560. Subsequently the offset single wells 530 are converted to dedicated production wells in step 565 and steam is injected into the injector wells 510 in step 570. Subsequently when a decision is made regarding the economics of the steam injection in the injector wells 510 these are shut off and the injector wells shut in as identified in step 575 wherein gravity driven production occurs for a period of time as the reservoir cools until production is terminated in step 580.

Accordingly, the well pairs 510, 520 and single well initially create early steam chamber structure 590 but evolve with time to expand to later steam chamber 585 wherein the region between the SAGD triangular steam chambers and the essentially finger like steam chamber from the single well 530 merge at the top of the oil sand structure adjacent the overburden. Apart from the region near single well 530 the overall structure of the oil sand reservoir addressed is similar to that of Cyr.

Figure 5B:
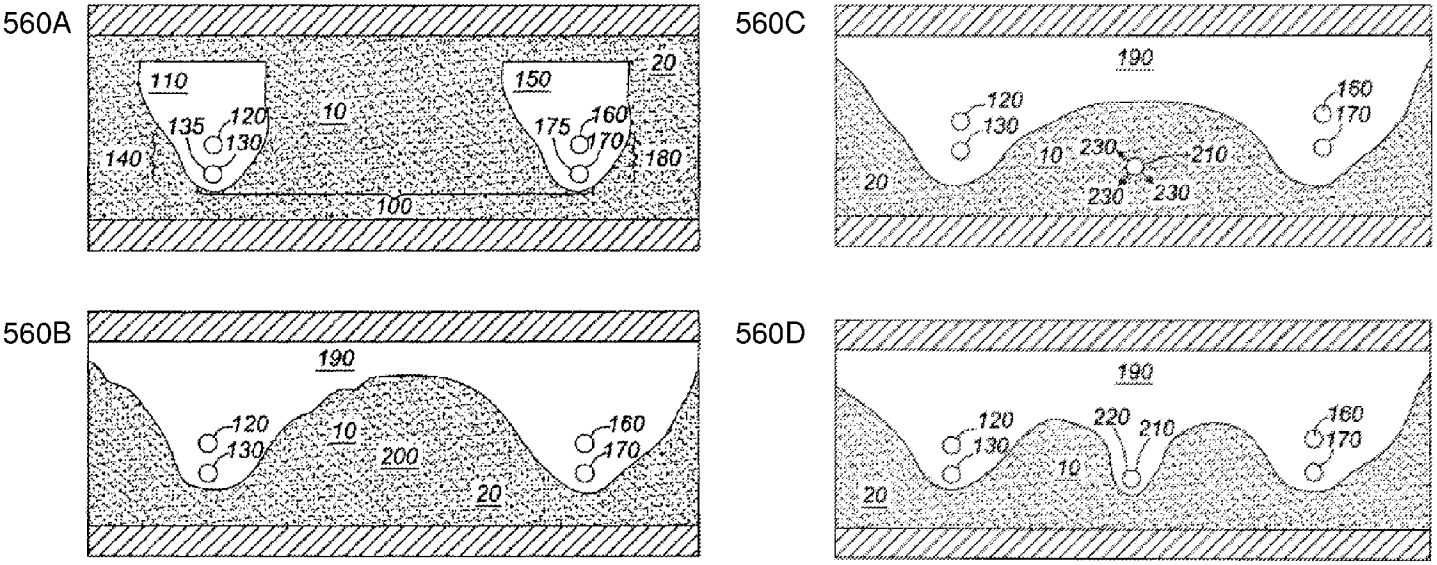
FIG. 5B depicts a SAGD oil recovery scenario according to the prior art Arthurs et al in U.S. Pat. No. 7,556,099.

Now referring to FIG. 5B there are depicted first to fourth images 560A through 560D according to the prior art of Arthurs et al in U.S. Pat. No. 7,556,099 entitled "Recovery Process" which represent an end-of-life SAGD production system according to the prior art, with the insertion of a horizontal in-fill well into the end-of-life SAGD production system and subsequent end-of-life position for the SAGD plus in-fill well combination. Accordingly in first image 560A the typical progression of adjacent horizontal well pairs 100 as an initial SAGD controlled process is depicted wherein a first mobilized zone 110 extends between a first injection well 120 and a first production well 130 completed in a first production well completion interval 135 and into the subterranean reservoir 20, the first injection well 120 and the first production well 130 forming a first SAGD well pair 140. A second mobilized zone 150 extends between a second injection well 160 and a second production well 170 completed in a second production well completion interval 175 and into the subterranean reservoir 20, the second injection well 160 and the second production well 170 forming a second SAGD well pair 180. As illustrated in first image 560A these first and second mobilized zones 110 and 150 respectively are initially independent and isolated from each other.

Over time, as illustrated in second image 560B, lateral and upward progression of the first and second mobilized zones 110 and 150 respectively results in their merger, giving rise to common mobilized zone 190. Accordingly, at some point the economic life of the SAGD recovery process comes to an end, due to an excessive amount of steam or water produced or for other reasons. However, as evident in second image 560B a significant quantity of hydrocarbons in the form of the bitumen heavy oil, etc remains unrecovered in a bypassed region 200. Accordingly Arthur teaches to providing a horizontal infill well 210 within the bypassed region 200 where the location and shape of the bypassed region 200 may be determined by computer modeling, seismic testing, or other means known to one skilled in the art. Arthur teaches that the horizontal infill well 210 will be at a level or depth which is comparable to that of the adjacent horizontal production wells, first production well 130 and second production well 170, having regard to constraints and considerations related to lithology and geological structure in that vicinity, as is known to one ordinarily skilled in the art.

Timing of the inception of operations at the infill well 210 as taught by Arthurs is dictated by economic considerations or operational preferences. However, Arthur teaches that an essential element of the invention is that the linking or fluid communication between the infill well 210 and the common mobilized zone 190 must occur after the merger of the first and second mobilized zones 110 and 150 respectively which form the common mobilized zone 190. Arthur teaches that the infill well 210 is used a combination of production and injection wherein as evident in third image 560C fluid 230 is injected into the bypassed region 200 and then operated in production mode, not shown for clarity, such that over time the injection well is used to produce hydrocarbons from the completion interval 220. Accordingly Arthurs teaches to employing a cyclic steam stimulation (CSS) process to the infill well 210 after it is introduced into the reservoir and after formation of the common mobilized zone 190.

Accordingly Arthurs teaches to operating the infill well 210 by gravity drainage along with continued operation of the adjacent first and second SAGD well pairs 140 and 180 respectively that are also operating under gravity drainage. Accordingly, the infill well 210, although offset laterally from the overlying first injection well 120 and the second injection well 160, is nevertheless able to function as a producer that operates by means of a gravity-controlled flow mechanism much like the adjacent well pairs. This arises through inception of operations at the infill well 210 being designed to foster fluid communication between the infill well 210 and the adjacent well pairs 100 so that the aggregate of both the infill well 210 and the adjacent well pairs 100 is a unit under a gravity-controlled recovery process. Arthurs repeatedly teaches that early activation of the infill well relative to the depletion stage forming the common mobilized zone 190 is to be avoided as it will prevent or inhibit hydraulic communications between the common mobilized zone 190 and the completion interval 220 formed from the CSS operation of the infill well 210 thereby reducing the recovery efficiency of the concurrent CSS—SAGD process taught.

In contrast the inventor has established a regime of operating a reservoir combining SAGD well pairs with intermediate wells wherein recovery efficiency is increased relative to conventional SAGD, the CSS-SAGD taught by Coskuner, and concurrent CSS-SAGD taught by Arthurs, and results in significant recovery of hydrocarbons. According to embodiments of the invention, unlike the prior art, the completion interval extends completely between SAGD pairs.

Figure 1B:
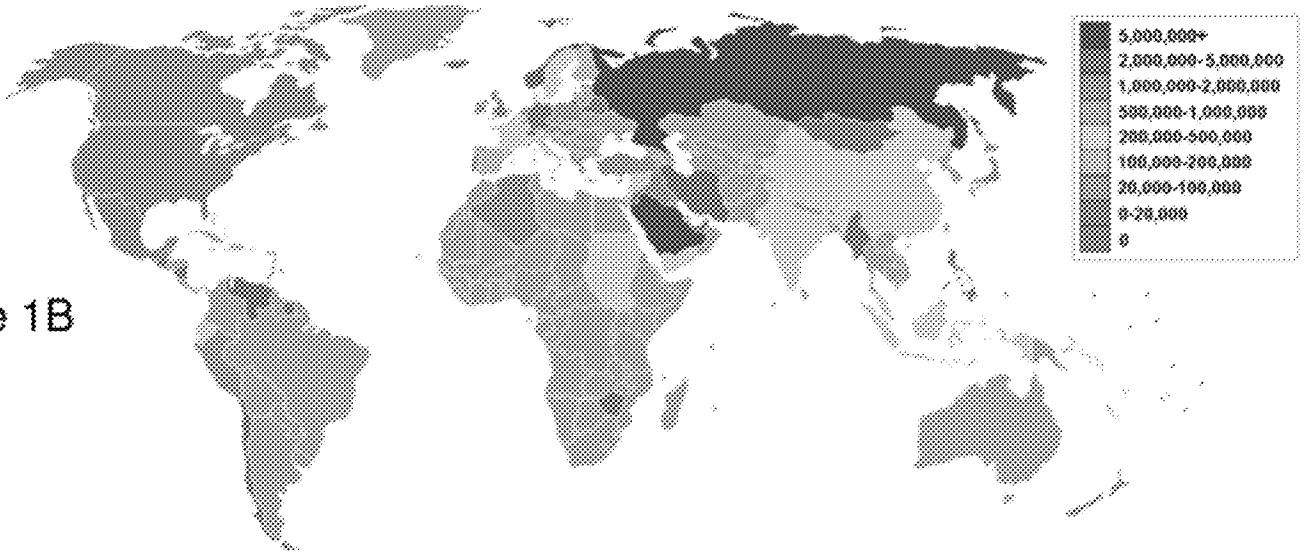
FIG. 1B depicts the geographical distribution worldwide of oil production.
Figure 6:
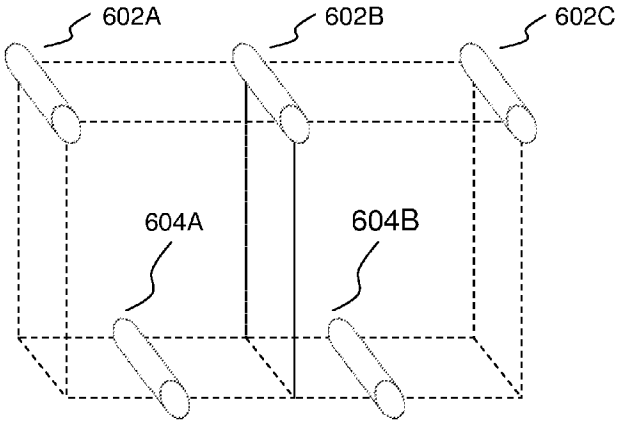
PRIOR ART Figure 6
FIG. 6 depicts an oil recovery scenario and well structure according to an embodiment of the invention.

Referring to FIG. 6 a plurality of wells according to an embodiment of the invention wherein a plurality of wells are shown. Upper wells 602A, 602B, 602C are depicted as substantially parallel and coplanar with each other. Lower wells 604A, 604B are also depicted substantially parallel and coplanar with each other. The lower wells 4 are also substantially parallel to the upper wells 2. However, it is understood variations may arise through the local geology and topography of the reservoir within which the plurality of wells are drilled. Lower well 604A is defined to be adjacent and associated with upper wells 602A, 602B as a functional set, and lower well 604B is similarly adjacent and associated with upper wells 602B, 602C as a second set of wells within the overall array depicted in FIG. 1. Thus, upper well 602B is common to both sets. Additional upper and lower wells can be similarly disposed in the array. Accordingly according to embodiments of the invention such as will be described below in respect of FIGS. 7 through 24 upper wells 602A and 602C are referred to as injector wells, primary injectors, and alike whereas upper well 602B is referred to as intermediate well, secondary injector, and alike and is operated under different conditions to upper wells 602A and 602C such that a pressure differential exists between upper well 602B and each of the upper wells 602A and 602C.

The wells 602, 604 are formed in a conventional manner using known techniques for drilling horizontal wells into a formation. The size and other characteristics of the well and the completion thereof are dependent upon the particular structure being drilled as known in the art. In some embodiments slotted or perforated liners are used in the wells, or injector structures such as presented supra in respect of FIGS. 3A and 3B. The upper horizontal wells 602 may be established near an upper boundary of the formation in which they are disposed, and the lower horizontal wells 604 are disposed towards a lower boundary of the formation.

Each lower horizontal well 604 is spaced a distance from each of its respectively associated upper horizontal wells 602 (e.g., lower well 604A relative to each of upper wells 602A, 602B) for allowing fluid communication, and thus fluid drive to occur, between the two respective upper and lower wells. Preferably this spacing is the maximum such distance, thereby minimizing the number of horizontal wells needed to deplete the formation where they are located and thereby minimizing the horizontal well formation and operation costs. The spacing among the wells within a set is established to enhance the sweep efficiency and the width of a chamber formed by fluid injected through the implementation of the method according to embodiments of the present invention.

The present invention is not limited to any specific dimensions because absolute spacing distances depend upon the nature of the formation in which the wells are formed as well as other factors such as the specific gravity of the oil within the formation. Accordingly, in initiating the wells to production a fluid is flowed into the one or more upper wells 602 in a conventional manner, such as by injecting in a manner known in the art. The fluid is one which improves the ability of hydrocarbons to flow in the formation so that they more readily flow both in response to gravity and a driving force provided by the injected fluid. Such improved mobility can be by way of heating, wherein the injected fluid has a temperature greater than the temperature of hydrocarbons in the formation so that the fluid heats hydrocarbons in the formation.

A particularly suitable heated fluid is steam having any suitable quality and additives as needed. Other fluids can, however, be used. Noncondensable gas, condensible (miscible) gas or a combination of such gases can be used. In limited cases, liquid fluids can also be used if they are less dense than the oil, but gaseous fluids (particularly steam) are typically preferred. Examples of other specific substances which can be used include carbon dioxide, nitrogen, propane and methane as known in the art. Whatever fluid is used, it is typically injected into the formation below the formation fracture pressure, as with SAGD.

At the same time the lower well(s) 604 associated with the upper well(s) 602 into which the liquid is being injected, to increase the temperature in the region around the upper well(s) 602 so that the viscosity of the oil is reduced, are placed under pressure so that a pressure differential is provided between the wells thereby providing in this embodiment of the invention an increase in mobility of the oil. Accordingly within the embodiment of the invention depicted in FIG. 6 the pressure differential increase results in an increase oil velocity as shown in Table 1 thereby reducing the time between initial fluid injection and initial production.

Figure 7A:
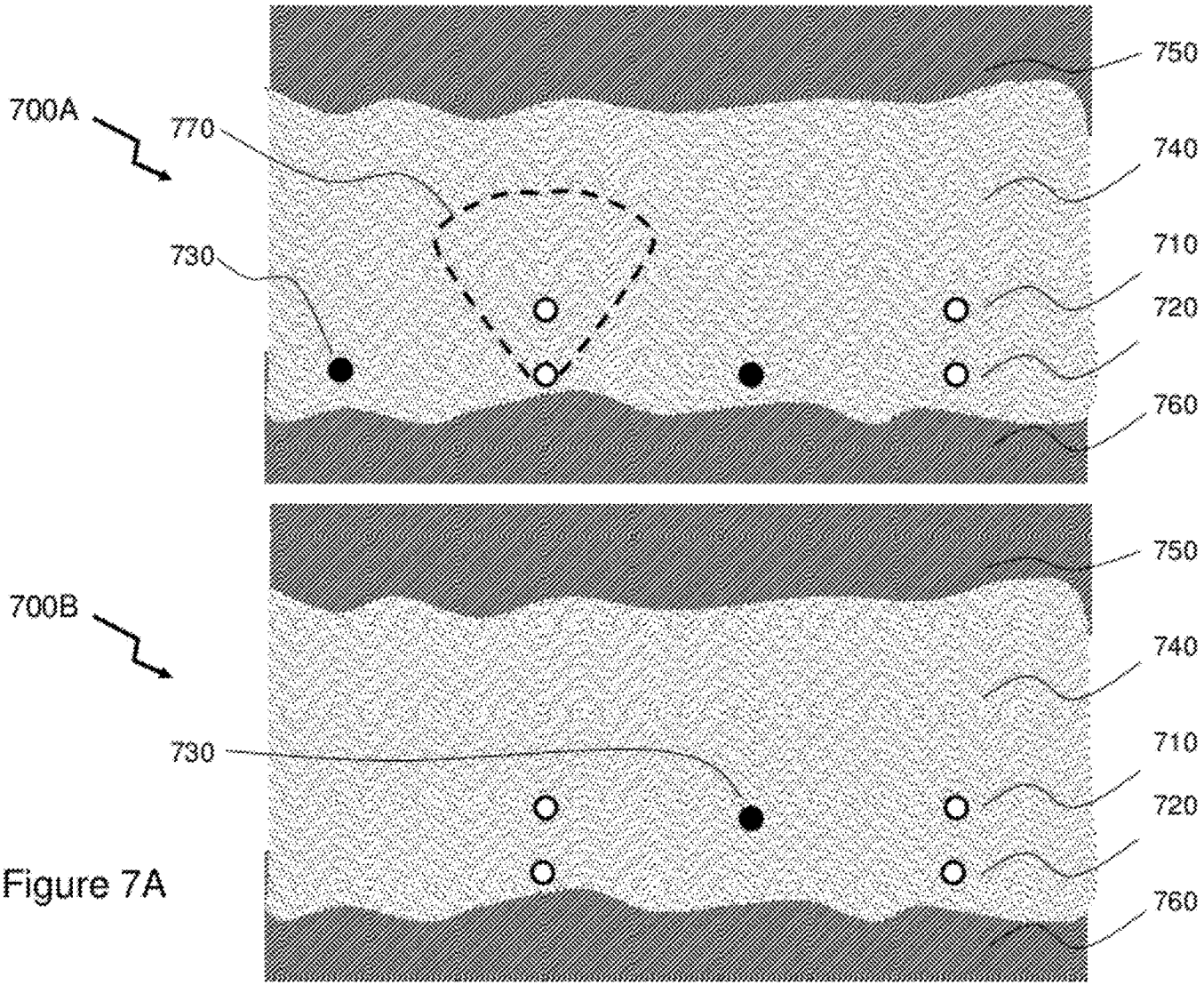
FIGS. 7A and 7B depict oil recovery scenarios and well structure according to an embodiment of the invention.

Referring to FIG. 7A there are depicted first and second oil well structures 700A and 700B respectively according to embodiments of the invention. As depicted in first oil well structure 700A an oil bearing structure 740 is disposed between an overburden 750 and rock formation 760. Drilled into the oil bearing structure 740 towards the lower boundary with the rock formation 760 are pairs of injection wells 710 and production wells 720. Drilled between these pairs are pressure wells 730. In operation fluid is injected into the injection wells 710, such as described supra wherein the fluid, for example, is intended to increase the temperature of the oil bearing structure 740 so that the viscosity of oil is reduced.

As operation continues the fluid injected from the injection wells 710 forms an evolving mobilization region above the pairs of wells and recovery of the oil subsequently begins from production wells 720, this being referred to as the mobilized fluid chamber 770. According to embodiments of the invention as the mobilized fluid chamber 770 increases in size then pressure wells 730 are activated thereby providing a pressure gradient through the oil bearing structure towards the mobilized fluid chamber 730 thereby providing impetus for the movement of injected fluid and heated oil towards the pressure well 730 as well as to the production well 720. Accordingly with time the mobilized fluid chamber 770 expands to the top of the oil bearing structure 740 and may expand between the injection wells 710 and pressure wells 730 to recover oil from the oil bearing structure 740 in regions that are left without recovery in conventional SAGD processes as well as those such as CSS-SAGD as taught supra by Coskuner.

Optionally the pressure wells 730 may be activated at the initiation of fluid injection into the injection wells 710 and subsequently terminated or maintained during the period of time that the injection wells 710 are terminated and production is initiated through the production wells 720 as time has been allowed for the oil to move under gravitational and pressure induced flow down towards them through the oil bearing structure. Optionally the pressure wells 730 may be operated under low pressure during one or more of the periods of fluid injection, termination, and production within the injection wells 710 and production wells 720. It would be apparent that with periods of fluid injection, waiting, and production that many combinations of fluid injection, low pressure, production may be provided and that the durations of these within the different wells may not be the same as that of the periods of fluid injection, waiting, and production.

Figure 7B:
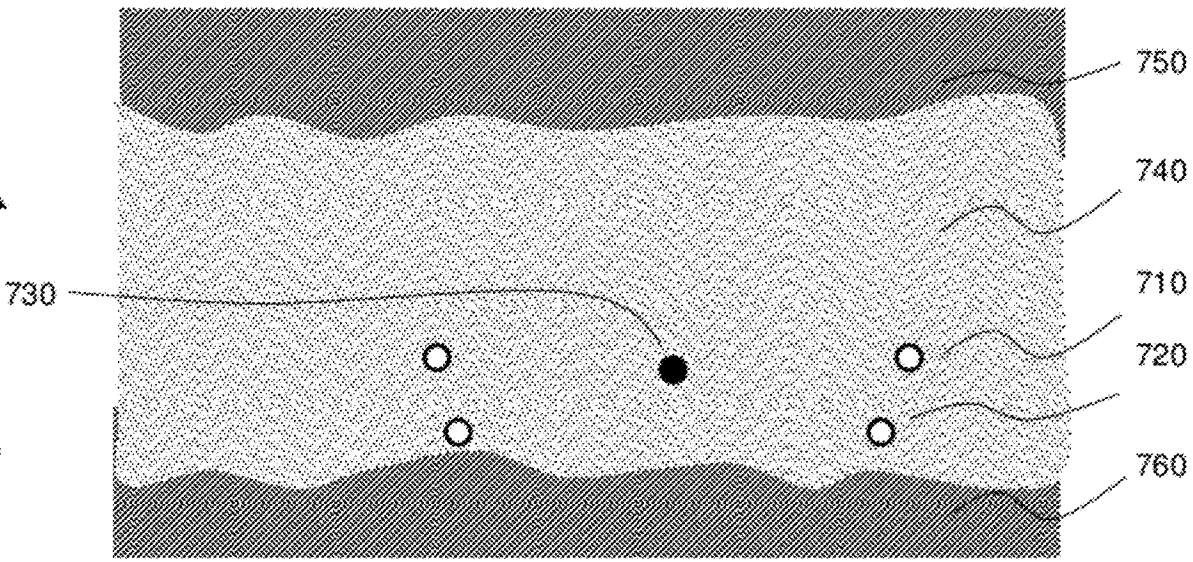

Referring to first oil well structure 700A the pressure wells 730 are shown at the same level as the production wells 720. In contrast in second oil well structure 700B the pressure wells 730 are shown at the same level as the injection wells 710. In FIG. 7B the production wells 710 are shown offset towards the pressure well 730. In a variant of FIG. 7B where the oil bearing structure 740 has a width that supports multiple sets of injector—pressure—pressure wells then each injection well 710 may be associated with a pair of production wells 720 wherein the production wells are offset laterally each to a different injector well.

Figure 8:
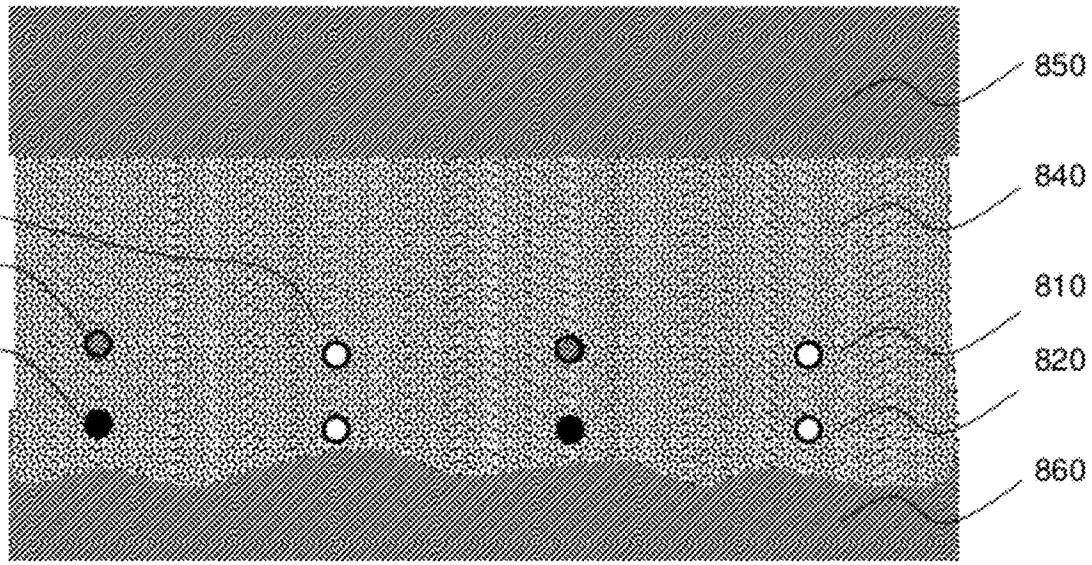
FIG. 8 depicts an oil recovery scenario and well structure according to an embodiment of the invention.

Referring to FIG. 8 there is depicted an oil well structure 800 according to an embodiment of the invention. As depicted an oil bearing structure 840 is disposed between an overburden 850 and rock formation 860. Drilled into the oil bearing structure 840 towards the lower boundary with the rock formation 860 are pairs of primary injection wells 810 and production wells 820. Drilled between these pairs are pressure wells 830 and secondary injection wells 880. During an initial phase fluid is injected into the primary injection wells 810, such as described supra wherein the fluid is intended, for example, to increase the temperature of the oil bearing structure 840 so that the viscosity of oil is reduced.

As operations continue the fluid injected from the primary injection wells 810 forms an evolving region above the pairs of wells and recovery of the oil subsequently begins from production wells 820 wherein the mobility of the oil has been increased within this evolving region through the fluid injected into primary injection wells 810. As the mobilized fluid chamber 870 increases in size then pressure wells 830 are activated providing a pressure gradient through the oil bearing structure towards the mobilized fluid chamber 870 thereby providing impetus for the movement of injected fluid and heated oil towards the pressure well 830 as well as to the production wells 820. Accordingly with time the mobilized fluid chamber 870 expands to the top of the oil bearing structure 840 and may expand between the injection wells 810 and pressure wells 830 to recover oil from the oil bearing structure 840 in regions that are usually left in conventional SAGD processes as well as others such as CSS-SAGD as taught supra by Coskuner.

However, unlike first oil well structure 700 the oil well structure 800 includes secondary injection wells 880 that can be used to inject fluid into the oil bearing structure 840 in conjunction with primary injections wells 810 and pressure wells 830. Accordingly during an exemplary first recovery stage the primary injection wells 810 are employed and the pressure wells 830 may be activated to help draw oil towards and through the region of the oil bearing structure 840 that is left without recovery from conventional SAGD. Subsequently during recovery from the production well 820 with injection halted through the primary injection wells 810 the pressure wells 830 may be engaged to draw oil towards the pressure wells 830. Subsequently when injection re-starts into the primary injection wells 810 a fluid may also be injected into the secondary injection wells 880. This fluid may be the same as that injected into the primary injection wells 810 but it may also be different.

It would be apparent that the timing of the multiple stages of the method according to embodiments of the invention may be varied according to factors such as oil bearing structure properties, spacing between production and injection wells, placement of pressure wells etc. For example, conventional SAGD operates with an initial period of fluid injection followed by production phase, then cyclic injection/production stages. According to some embodiments of the invention the pressure wells may be held at pressure during the injection phase, during the production phase, during portions of both injection and production phases or during periods when both injection and production wells are inactive. This may also be varied according to the use of the primary and secondary injection wells. It would be further evident that ultimately the pressure wells become production wells as oil pools around them. According to another embodiment of the invention fluid may be injected continuously through the primary injection wells 810 and secondary injection wells 880 or alternatively through the primary injection wells 810 and pressure wells 830. Similarly primary injection wells 810 may be injected continuously whilst pressure wells 830 are operated continuously under low pressure.

Figure 9:
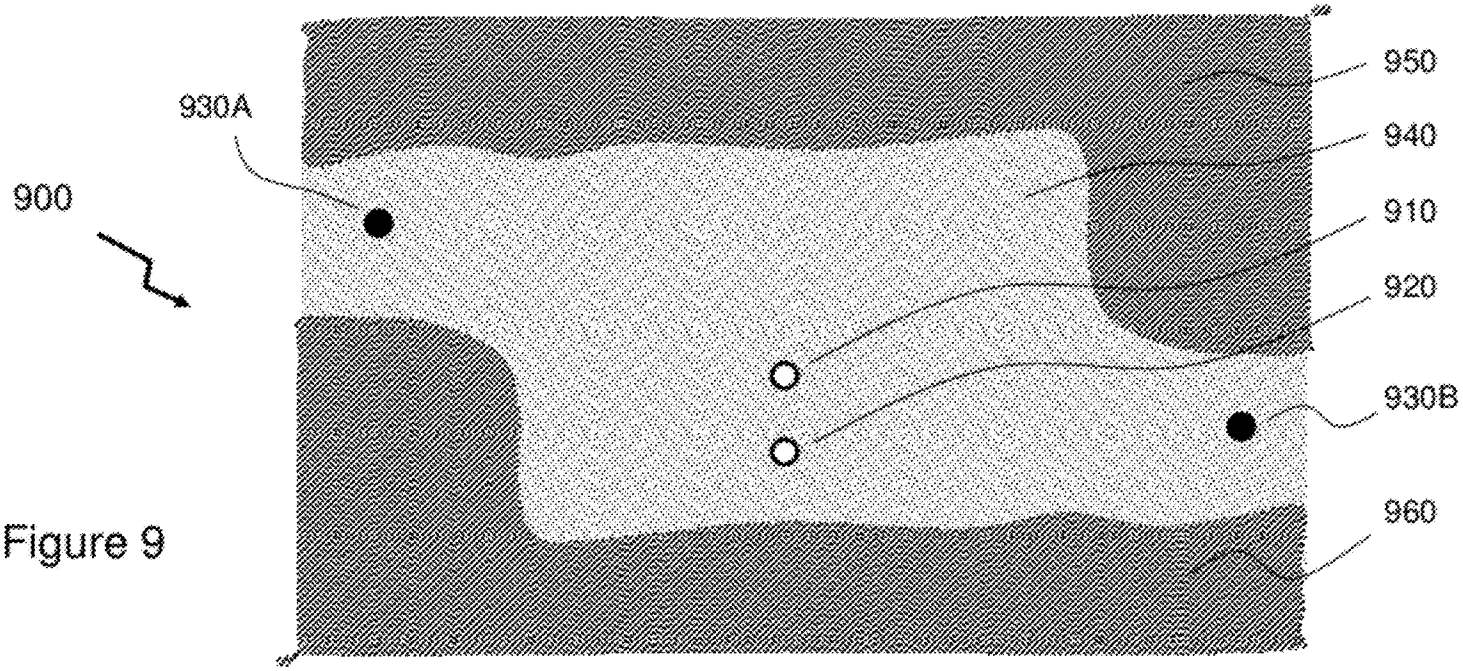
FIG. 9 depicts an oil recovery scenario and well structure according to an embodiment of the invention.

Referring to FIG. 9 there is depicted second oil well structure 900 according to an embodiment of the invention. As depicted an oil bearing structure 940 is disposed between an overburden 950 and rock formation 960. Drilled into the oil bearing structure 940 towards the lower boundary with the rock formation 960 are pairs of primary injection wells 910 and production wells 920. However, unlike the oil bearing structures considered above in respect of FIGS. 7 and 8 the overburden 950 and rock formation 960 result in an oil bearing structure 940 of varying thickness such that deploying injection/production pairs is either not feasible or economical in regions where the separation from overburden 950 to rock formation 960 are relatively close together. Accordingly in the regions of reduced thickness additional wells, being pressure wells 930A and 930B are drilled. In this configuration pressure wells 930A and 930B induce the depletion chamber, also referred to supra as the mobilized fluid chamber, formed by the injection of the fluid through the injection well 910 to extend towards the reduced thickness regions of oil bearing structure 940. Subsequently the pressure wells 930A and 930B may also be employed as production wells as the reduced velocity oil reaches them. In some scenarios pressure wells 930A and 930B may be operated under low pressure and in others under pressure to inject a fluid at elevated temperature.

Figure 10:
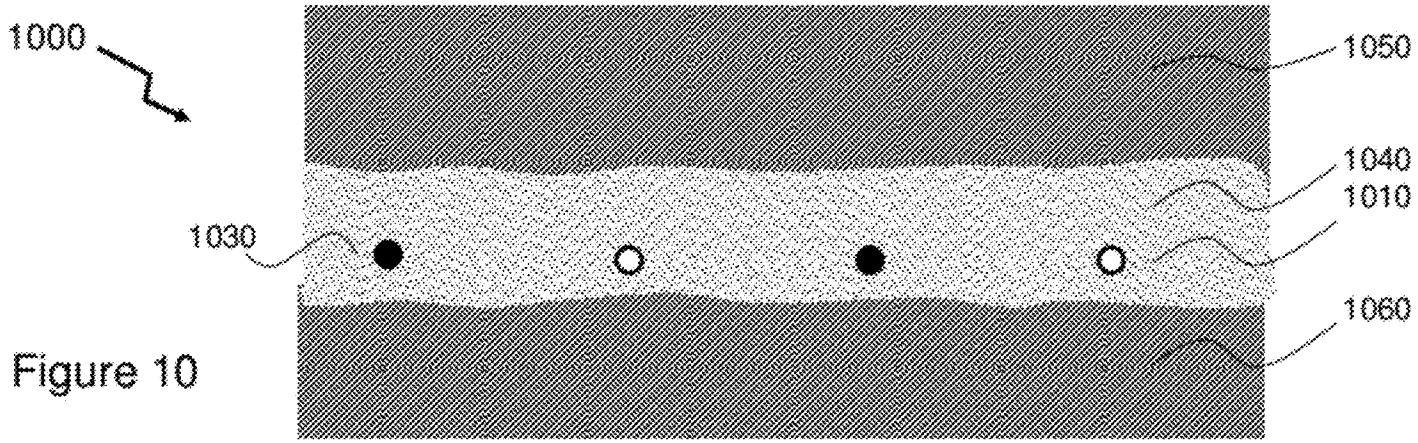
FIG. 10 depicts an oil recovery scenario and well structure according to an embodiment of the invention.

This may be extended in other embodiments such as presented in FIG. 10 according to an embodiment of the invention to provide recovery within a thin oil bearing structure 1040 as depicted within oil structure 1000. As such there are depicted injection wells 1010 with pressure wells 1030 disposed between pairs of injection wells 1010. As fluid injection occurs within the injection wells 1010 the pressure wells 1030 provide a "pull" expanding the chambers towards them whilst they also propagate vertically within the oil bearing structure 1040. Accordingly as there are no vertically aligned production wells with the injections wells 1010 as in conventional or modified SAGD processes within the oil structure 1000 then the injection may be terminated and extraction undertaken from the injection wells 1010 and pressure wells 1030. As depicted the pressure wells 1030 are at a level similar to that of the injection wells 1010 but it would be evident that alternatively the pressure wells 1030 may be at a different level to the injection wells 1010, for example closer to the overburden 1050 than to the bedrock 1060, and operating under injection rather than a lower pressure scenario.

Whilst within the embodiments presented in respect of FIGS. 6 to 10 the configurations have been with essentially horizontal oil well configurations in addressing oil bearing structures such as oil sands (tar sands) the approaches identified within these embodiments of the invention may be applied to vertical well configurations as well as others.

Figure 11:
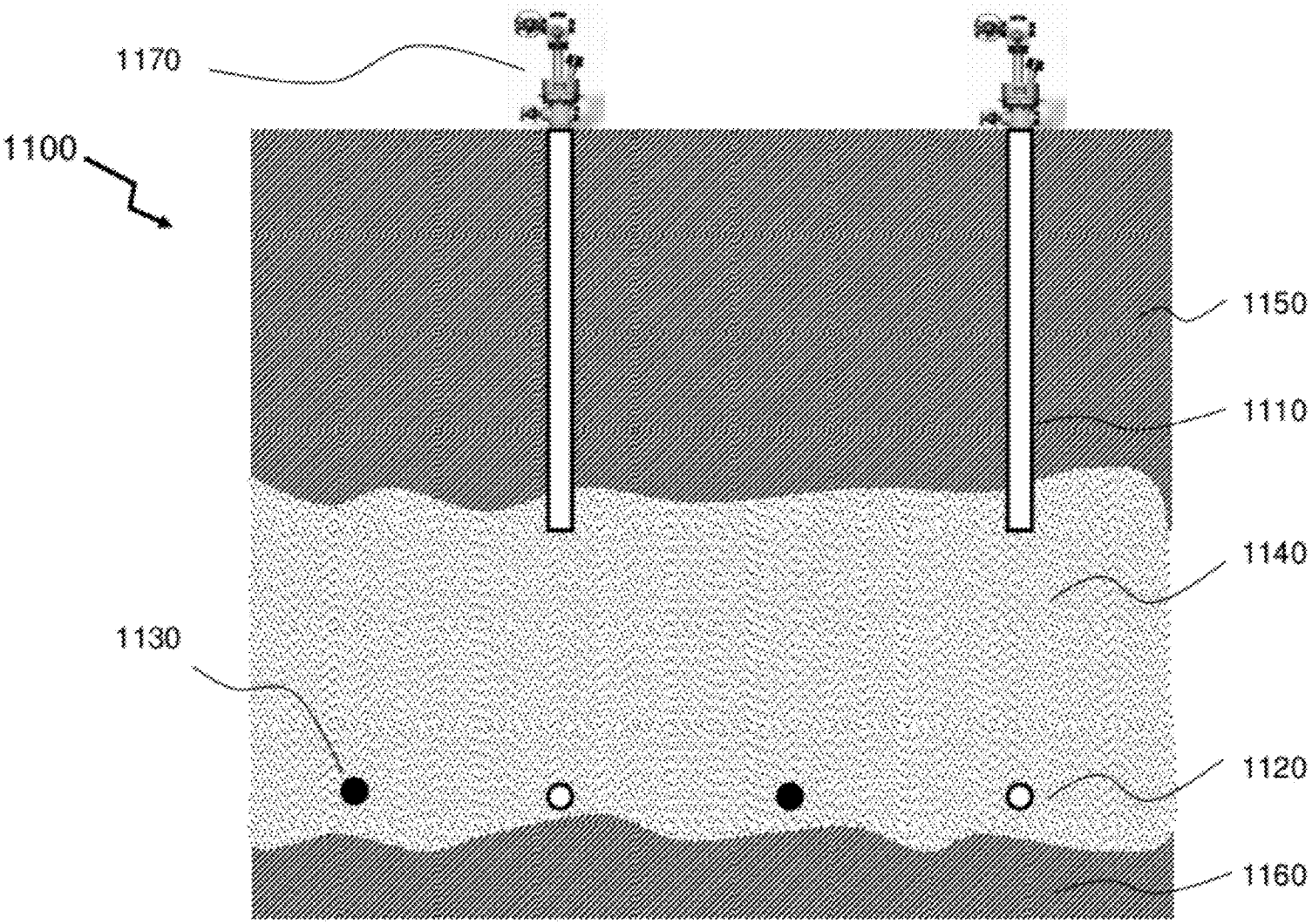
FIG. 11 depicts an oil recovery scenario and well structure according to an embodiment of the invention.

Referring to FIG. 11 there is shown a combined oil recovery structure 1100 employing both vertical and horizontal oil well geometries. Accordingly there is shown a geological structure comprising overburden 1150, oil bearing layer 1140, and sub-rock 1160. Shown are vertical injection wells 1110 coupled to steam injectors 1170 that are drilled into the geological structure to penetrate into the upper portion of the oil bearing layer 1140. Drilled into the lower portion of the oil bearing layer 1140 are production wells 1120 and pressure wells 1130. In operation the vertical injection wells 1110 inject a fluid into the upper portion of the oil bearing structure 1140 with the intention of lowering the viscosity of the oil within the oil bearing layer 1140. In an initial stage of operation operating the vertical injection wells 1110 and production wells 1120 results in a SAGD-type structure resulting in oil being recovered through the production wells. However, in common with other SAGD structures the resulting oil-depleted chamber formed within the oil bearing layer 1140 results in regions that are not recovered besides these oil-depleted chambers. Accordingly the pressure wells 1130 are activated to create a pressure gradient within the oil bearing layer 1140 such that the oil-depleted chamber expands into these untapped regions resulting in increased recovery from the oil bearing layer 1140. Optionally, the pressure wells 1130 may inject a fluid into the oil bearing layer 1140. Within another embodiment of the invention the vertical injection wells 1110 may be disposed between the production wells 1120 either with or without the pressure wells 1130.

According to an alternate embodiment of the invention between the initial SAGD-type recovery through the production wells 1120 and subsequent engagement of the pressure wells 1130 the steam injection process may be adjusted. During the initial SAGD-type recovery steam injection may be performed under typical conditions such that the injected fluid pressure is below the fracture point of the oil bearing layer 1140. However, as the initial SAGD-type recovery is terminated with the production wells 1120 the fluid injection process may be modified such that fluid injection is now made at pressures above the fracture point of the oil bearing layer 1140 so that the resulting fluid flow from subsequent injection is now not automatically within the same oil-depleted chamber. In some embodiments of the invention the fluid injector head at the bottom of the injection well 1110 may be replaced or modified such that rather than injection being made over an extended length of the injection well 1110 the fluid injection is limited to lateral injection.

Optionally the injection well 1110 may be specifically modified between these stages so that the fluid injection process occurs higher within the geological structure and into the overburden 1150. Alternatively the injection wells 1110 may be terminated within the overburden 1150 and operated from the initial activation at a pressure above the fracture pressure. Such a structure being shown in FIG. 12 with recovery structure 1200.

Figure 12:
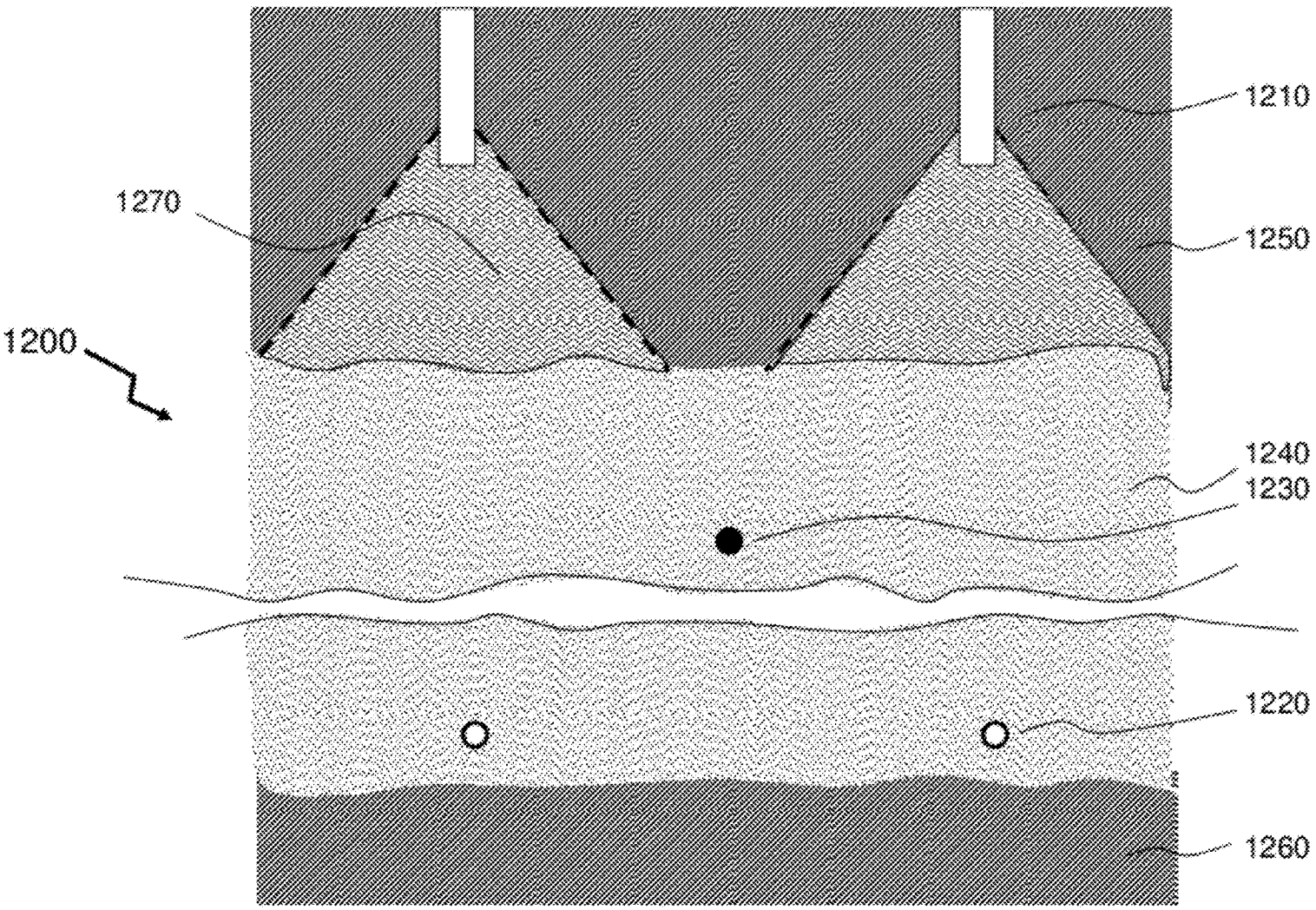
FIG. 12 depicts an oil recovery scenario and well structure according an embodiment of the invention.

As shown in FIG. 12 injection wells 1210 terminate within the overburden 1250 of an oil reservoir comprising the overburden 1250, oil bearing layer 1240, and under-rock 1260. Drilled within the oil bearing layer 1240 are production wells 1220 and pressure wells 1230. Injection of fluid at pressures above the fracture limit of the overburden 1250 results in the overburden fracturing and forming a fracture zone 1270 through which the fluid penetrates to the surface of the oil bearing layer 1240. The injected fluid thereby reduces the viscosity of the oil within the oil bearing layer 1240 and a SAGD-type gravity feed results in oil flowing towards the lower portion of oil bearing layer 1240 wherein the production wells 1220 allow the oil to be recovered. Also disposed within the oil bearing layer 1240 are pressure wells 1230 that are disposed higher within the oil bearing layer 1240 than the production wells. The purpose of the pressure wells 1230 being to provide a driving mechanism for widening the dispersal of the injected fluid within the oil bearing layer 1240 such that the spacing of the injection wells 1210 and potentially the production wells 1220 may be increased.

Whilst the pressure wells 1230 and production wells 1230 have been presented as horizontal recovery structures within the oil bearing layer 1240 it would be evident that alternatively vertical wells may be employed for one or both of the pressure wells 1230 and production wells 1230. Likewise, optionally the injection wells 1210 may be formed horizontally within the overburden. It would also be apparent that after completion of a first production phase wherein the fluid injected into the injection well 1210 is one easily separated from the oil at the surface or generated for injection that a second fluid may in injected that provides additional recovery, albeit potentially with increased complexity of separation and injection.

Figure 13:
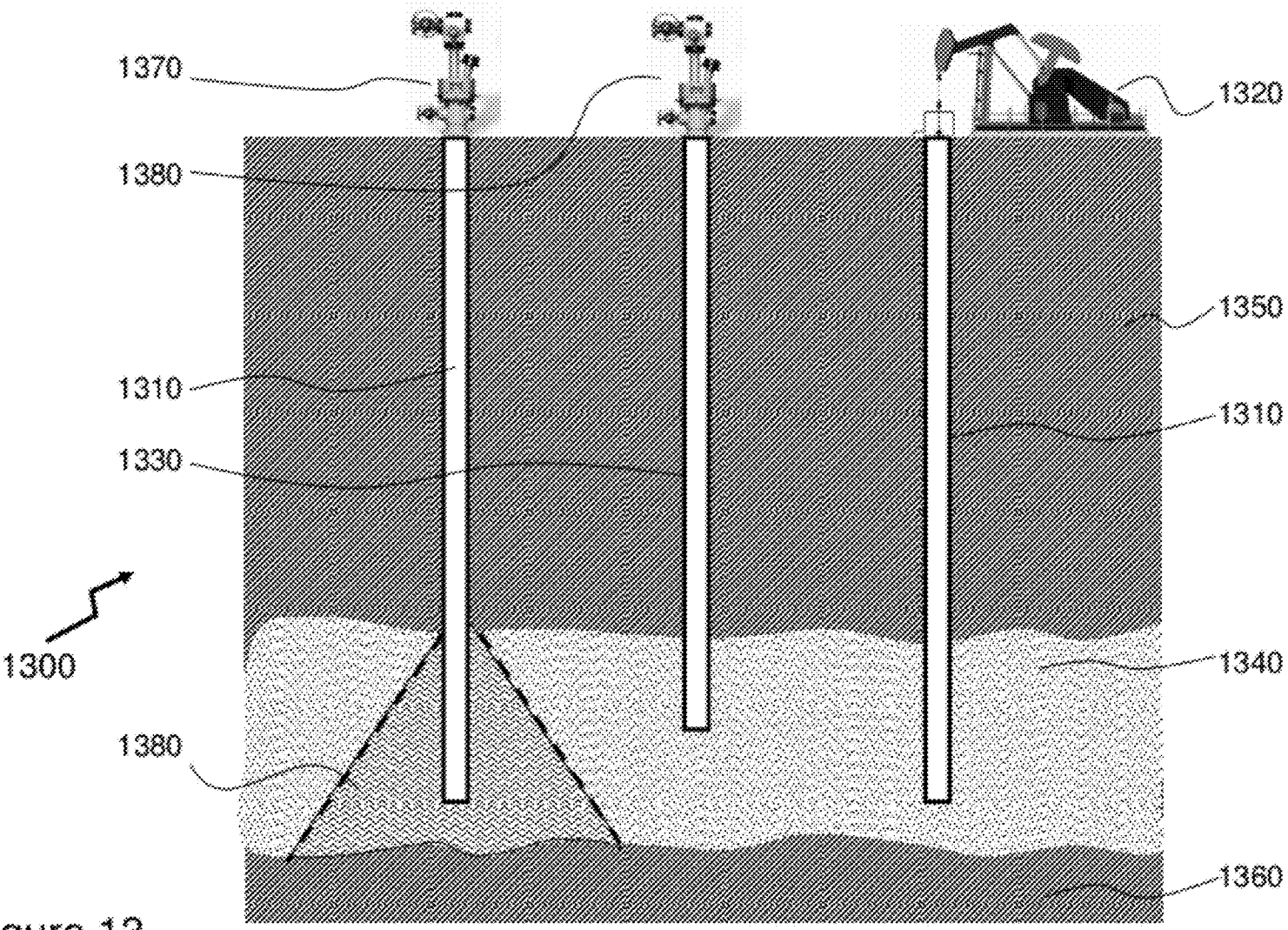
FIG. 13 depicts an oil recovery scenario and well structure according an embodiment of the invention.

Referring to FIG. 13 there is depicted a vertical recovery structure 1300 according to an embodiment of the invention. As shown a production well 1310 is drilled into the oil bearing layer 1340 of a geological structure comprising the oil bearing layer 1340 disposed between overburden 1350 and lower-rock 1360. Production well 1310 has either exhausted the natural pressure in the oil bearing layer 1340 or never had sufficient pressure for free-flowing recovery of the oil without assistance. Accordingly, production from the production well 1310 is achieved through a lifting mechanism 1320, as known in the prior art. Subsequently, production under lift reduces. Accordingly, the well head of the production well is changed such that a fluid injector 1370 is now coupled to the same or different pipe. Accordingly fluid injection occurs within the production well 1310 for a predetermined period of time at which point the fluid injection is terminated, the oil pools and recovery from the lifting process can be restarted by replacing the fluid injector 1370 with the lifting mechanism 1370.

Optionally, the fluid injector and lifting mechanism 1370 may be coupled though a single well head structure to remove requirements for physically swapping these over. During fluid injection additional expansion of the fluid's penetration into the oil bearing layer 1340 may be achieved through the operation of pressure wells 1330 which are disposed in relationship to the production well 1310. During the fluid injection into the production well 1310 the fluid injector may be disposed at a depth closer to the upper surface of the oil bearing structure 1340 rather than the closer to the lower limit during oil recovery. Likewise the lower limit of the pressure well 1330 is closer to the upper surface of the oil bearing structure 1340 as the intention is to encourage fluid penetration into the upper portion of the oil bearing structure 1340 between the oil depleted zones 1380 formed from the injection into the production wells 1310.

Figure 14:
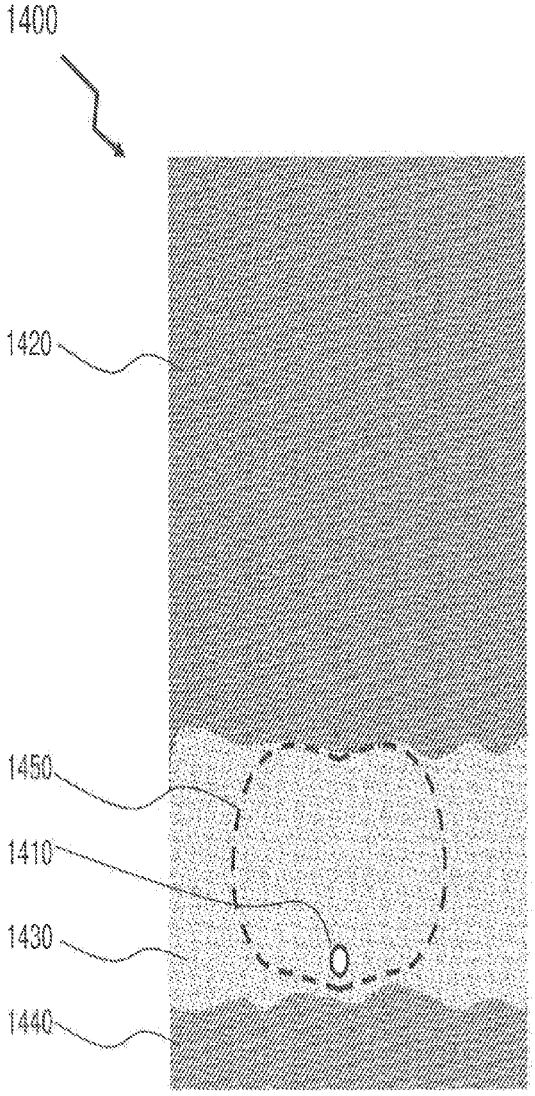
FIG. 14 depicts an oil recovery scenario and well structure according an embodiment of the invention.

According to another embodiment of the invention a single well drilled into an oil bearing structure may be operated through a combination of low pressure, high pressure, fluid injection, and oil extraction or a subset thereof. Referring to FIG. 14 there is shown an oil recovery structure 1400 according to an embodiment of the invention wherein a single well 1410 has been drilled into an oil bearing structure 1430 disposed between an overburden 1420 and bedrock 1440. As such the single well 1410 is for example operated initially under fluid injection, followed by a period of time at low pressure and then extraction of oil. Such a cycle of injection—low pressure—extraction being repeatable with varying durations of each stage according to factors including but not limited to characteristics of oil bearing structure, number of cycles of injection—low pressure—extraction performed, and characteristics of the oil mixture being recovered.

Optionally the fluid injected in the cycles may be changed or varied from steam for example to a solvent or gas. It would also be evident that the cyclic sequence may be extended to include during some cycles, for example towards the later stages of recovery, a stage of high pressure injection such that an exemplary sequence may be high pressure—injection—low pressure—extraction. Further the pressures used in each of high pressure, injection and low pressure may be varied cycle to cycle according to information retrieved from the wells during operation or from simulations of the oil bearing structure.

Figure 15:
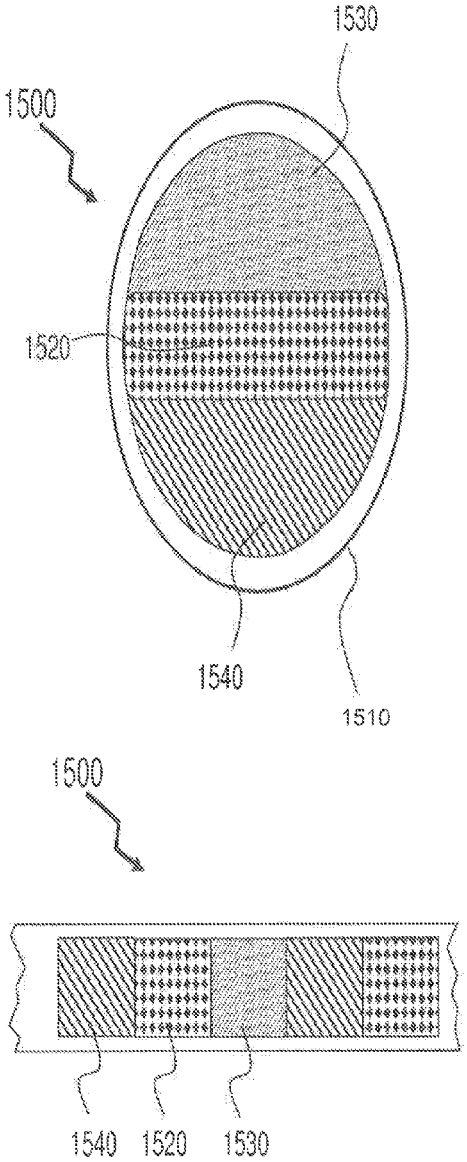
FIG. 15 depicts an oil recovery well structure according to an embodiment of the invention.

Referring to FIG. 15 there is depicted an exemplary drill string according to an embodiment of the invention for use in a multi-function well such as that described supra in respect of FIG. 14. Accordingly rather than requiring replacement of the drill string during each stage of the 3 step (injection—low pressure—extraction) or 4 step (high pressure—injection—low pressure—extraction) process a single drill string is inserted and operated. As discussed supra in respect of SAGD and other prior art approaches the timescales for each stage are typically tens or hundreds of days for each step. Whilst it is possible to consider replacing the drill string in each stage this requires additional effort and cost to be expended including for example deploying personnel to the drill head and maintaining a drilling rig at the drill head or transporting one to it. As such it would be beneficial to provide a single drill string with multiple functionality connected to the required infrastructure at the drill head. Accordingly such a multi-function drill string could be controlled remotely from a centralized control facility allowing multiple drill strings to be controlled without deploying manpower and equipment.

Accordingly in FIG. 15 there is depicted drill string assembly 1500 comprising well 1510 within which the drill string is inserted comprising injector portion 1530, pressure portion 1520 and production portion 1540. For example the exterior surfaces of each of these portions being for example such as described supra in respect of FIGS. 3A and 3B with respect to US Patent Applications 2008/0,251,255 and 206/0,048,942. Accordingly in use the drill string assembly 1500 can provide for fluid injection through injector portion 1530, extraction through production portion 1540 and low pressure through pressure portion 1520.

Optionally pressure portion 1520 may be coupled to a pressure generating system as well as a low pressure generating system allowing the pressure portion 1520 to be used for both high pressure and low pressure steps of a 4 step sequence. It would be evident to one skilled in the art that the exterior surfaces may be varied according to other designs within the prior art and other designs to be established. Alternatively the drill string assembly 1500 may be a structure such as depicted in sequential string 1550 wherein the injector portion 1530, pressure portion 1520 and production portion 1540 are sequentially distributed along the length of the sequential string 1550.

Figure 16A:
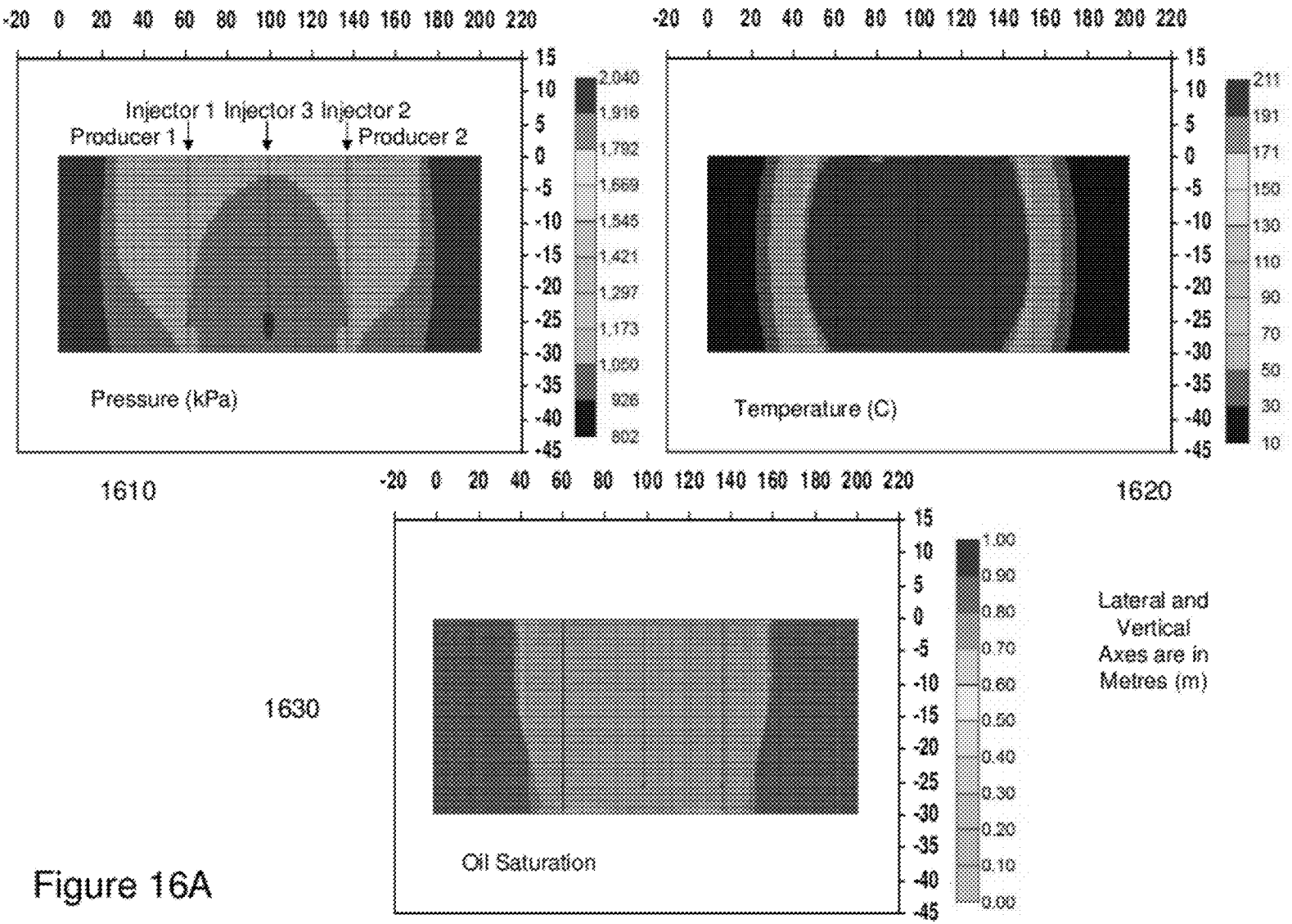
FIGS. 16A and 16B depict simulation results for a pressure assisted oil recovery process according to an embodiment of the invention with primary injectors within SAGD well pairs operated at a lower pressure than intermediate wells acting as secondary injectors.
Figure 16B:
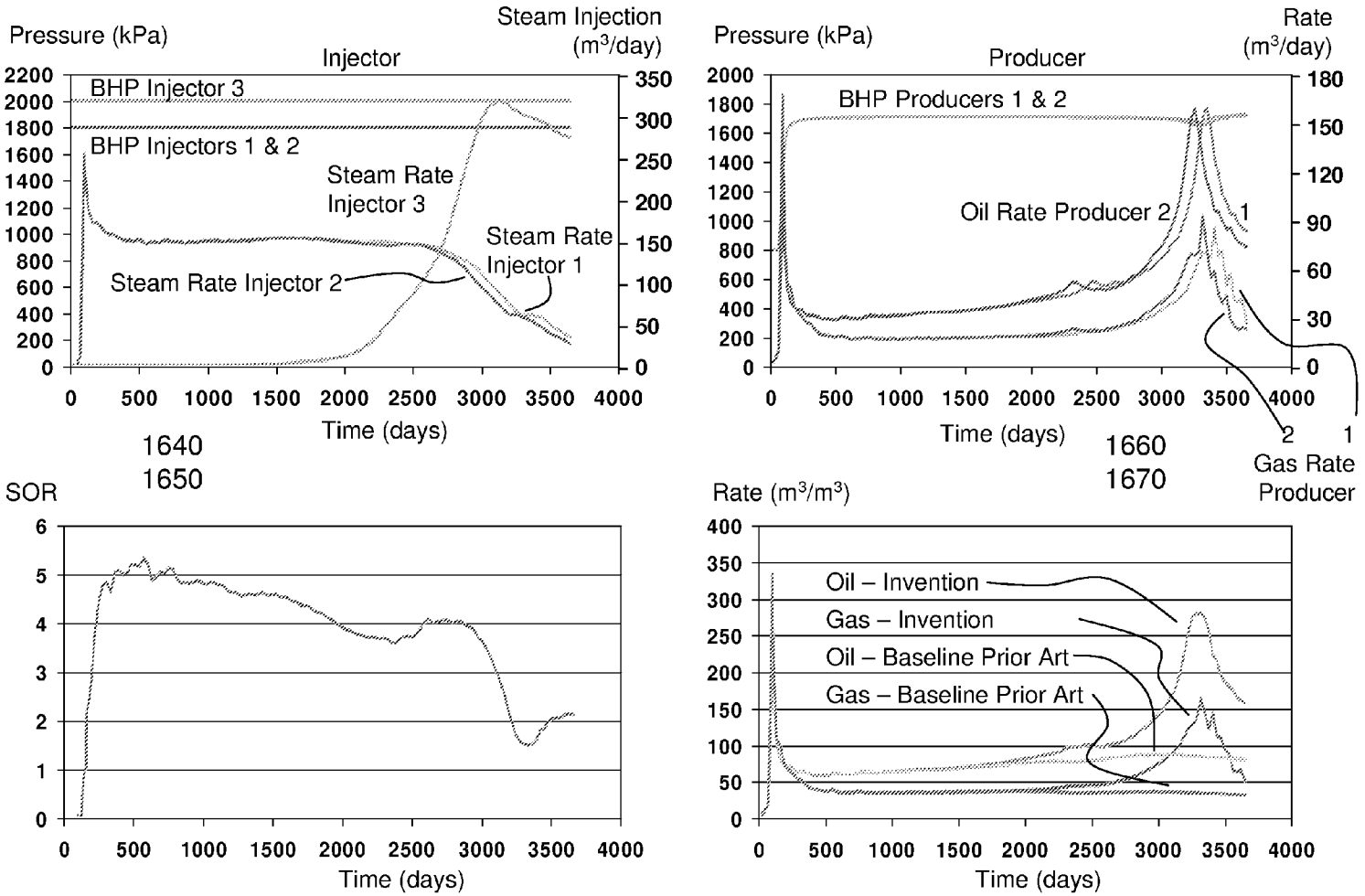

Now referring to FIG. 16A there are depicted first to third images 1610 through 1630 respectively depicting the pressure, temperature and oil depletion for a SAGD process according to an embodiment of the invention with a 75 m well-pair separation, 0 m offset between injector and producer wells within each well-pair, and intermediate pressure wells. Extracted data from the simulations was used to generate the first to fourth graphs 1640 through 1670 that depict injector and producer pressure and steam injection rates together with SOR and field production comparison. Within this embodiment injection into the intermediate pressure well was initiated from the beginning of the simulation with an injection pressure of 2000 KPa and steam quality of 0.99. As evident from first graph 1640 in FIG. 16B no steam injectivity was evident until approximately 2350 days. After 2500 days, considerable rates steam rates were achieved, which also resulted in significant increase in bitumen production as evident in third graph 1660 in FIG. 16B. The entire zone between the well pairs was swept, which could be seen from the oil saturation profile in third image 1630 of FIG. 16A and the increased production against a baseline SAGD process evident in fourth graph 1670. The rise in SOR in second graph 1750 after 3500 days indicates that the intermediate injector could be turned off, as it is has completed its objective and there is no point of injecting steam from it anymore.

Figure 17A:
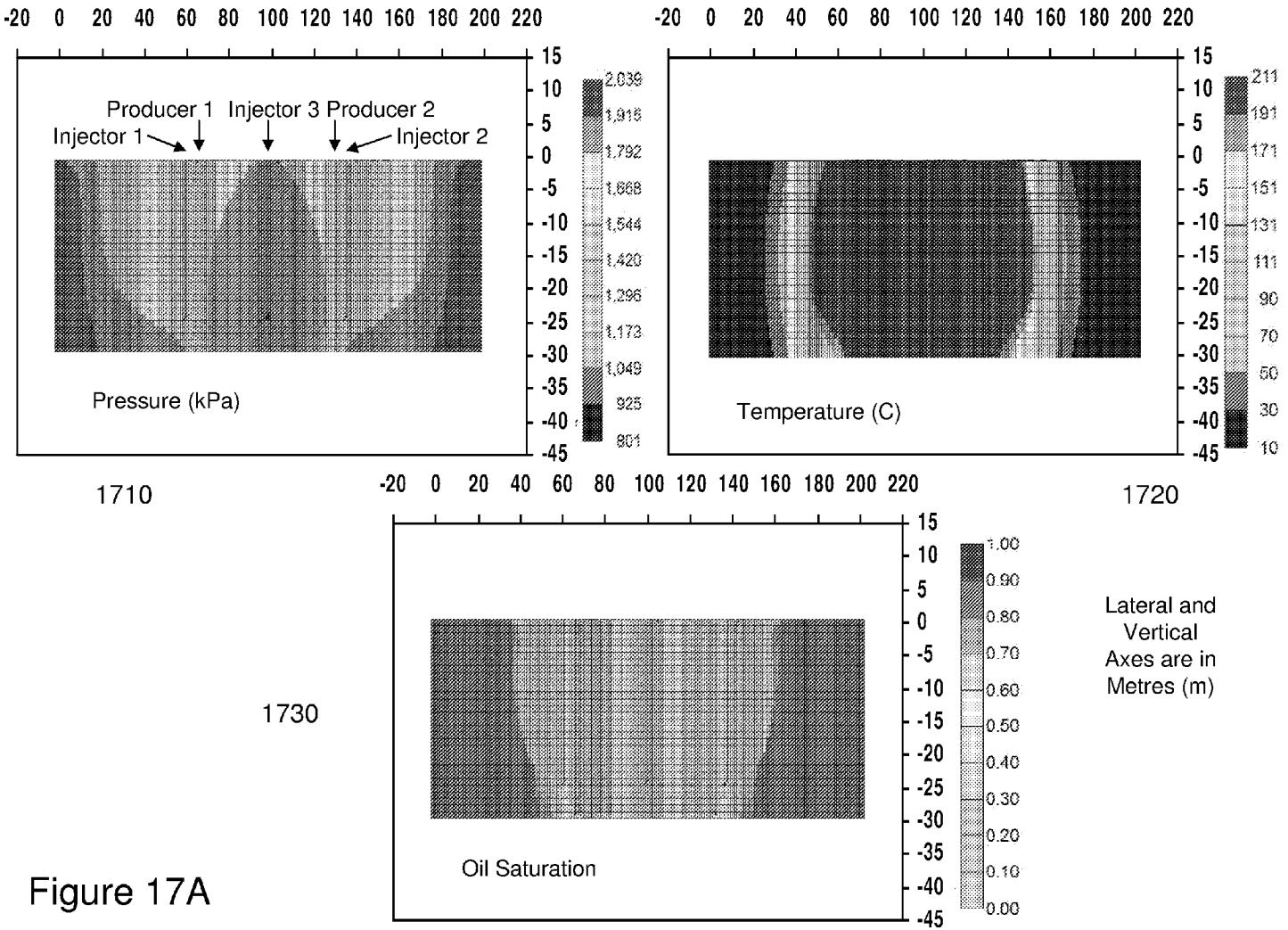
FIGS. 17A and 17B depict simulation results for a pressure assisted oil recovery process according to an embodiment of the invention with primary injectors within SAGD well pairs operated at a lower pressure than intermediate wells acting as secondary injectors.
Figure 17B:
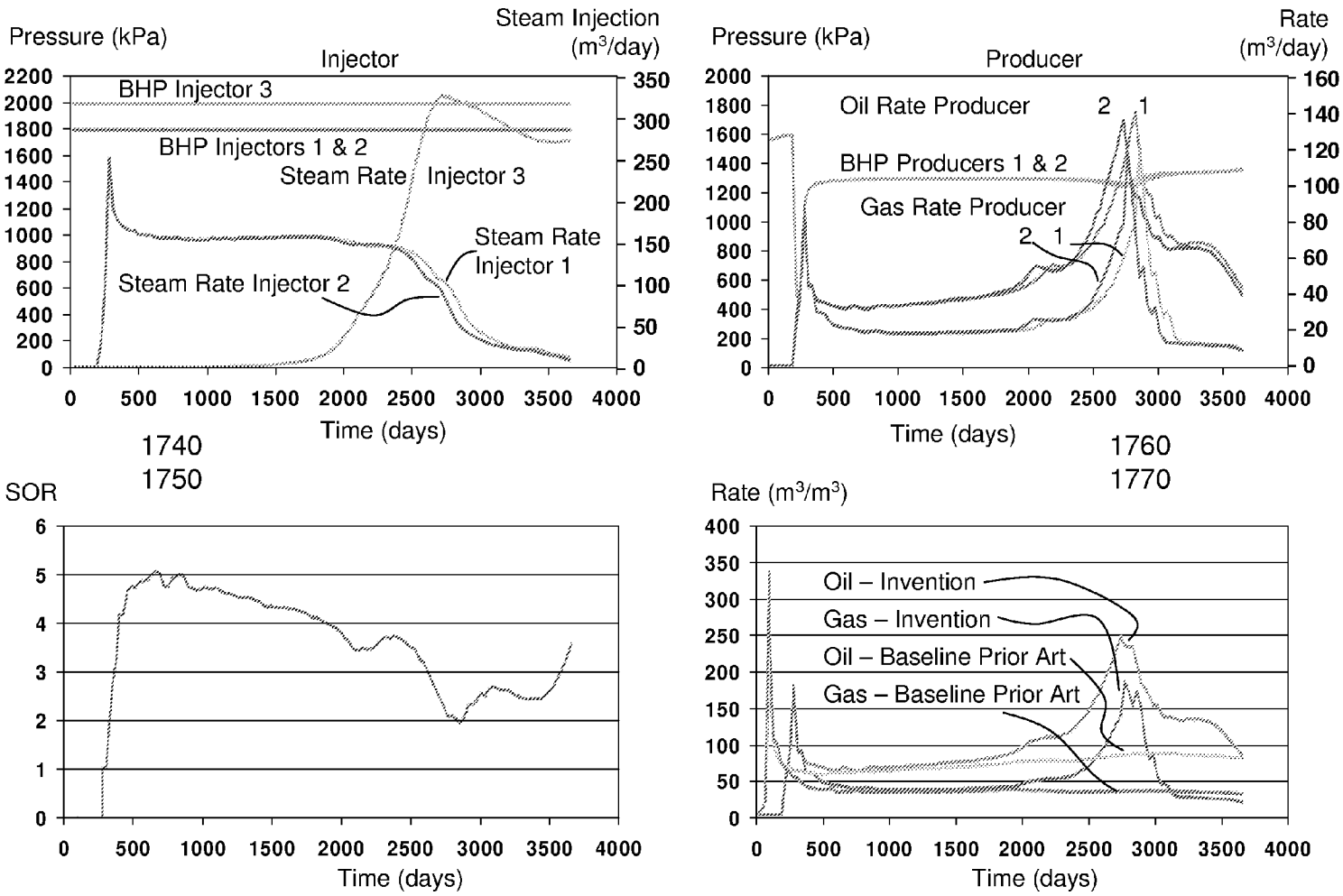
Figure 18A:
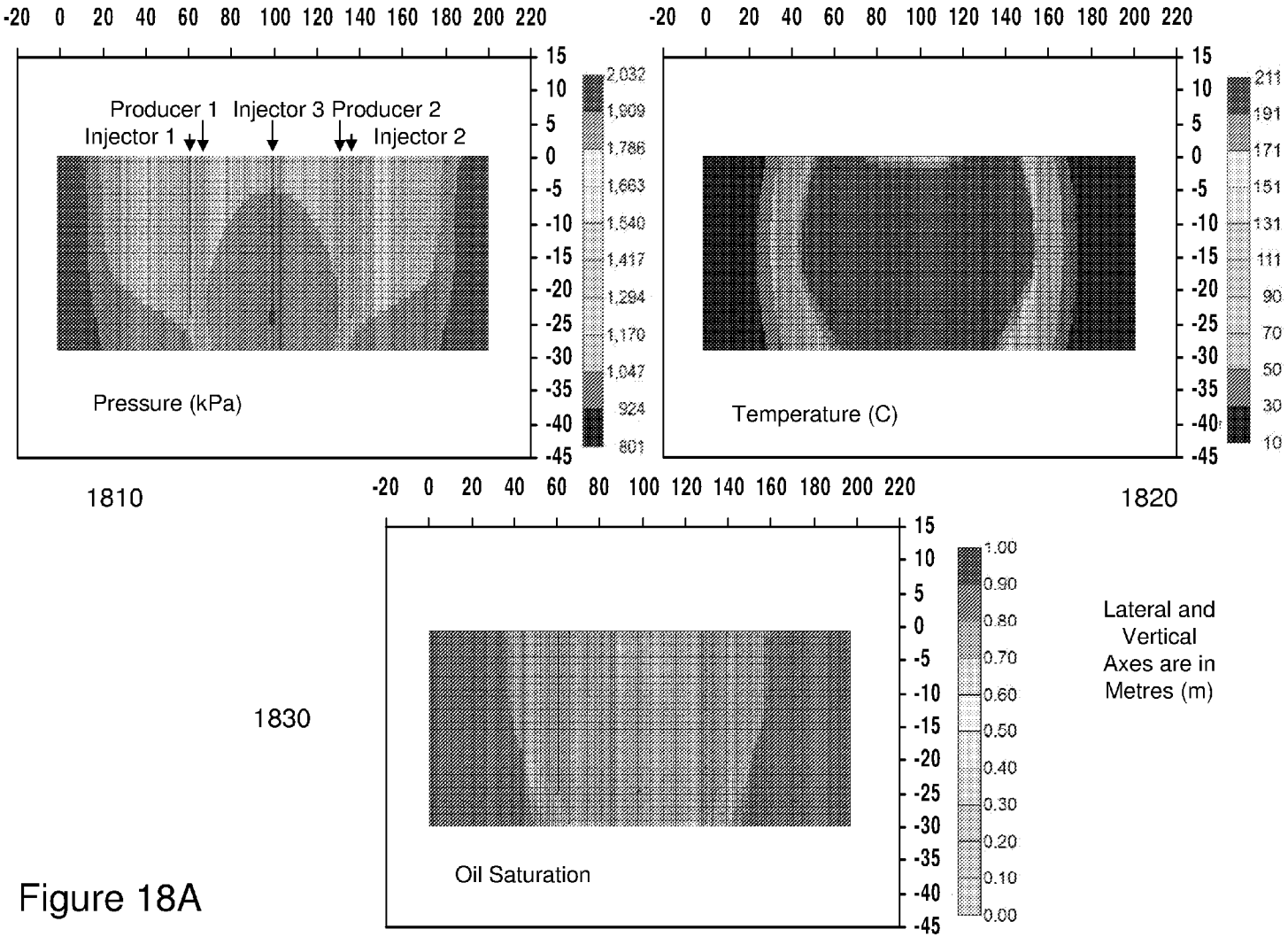
FIGS. 18A and 18B depict simulation results for a pressure assisted oil recovery process according to an embodiment of the invention with primary injectors within SAGD well pairs operated at a lower pressure than intermediate wells acting as secondary injectors with delayed injection.
Figure 18B:
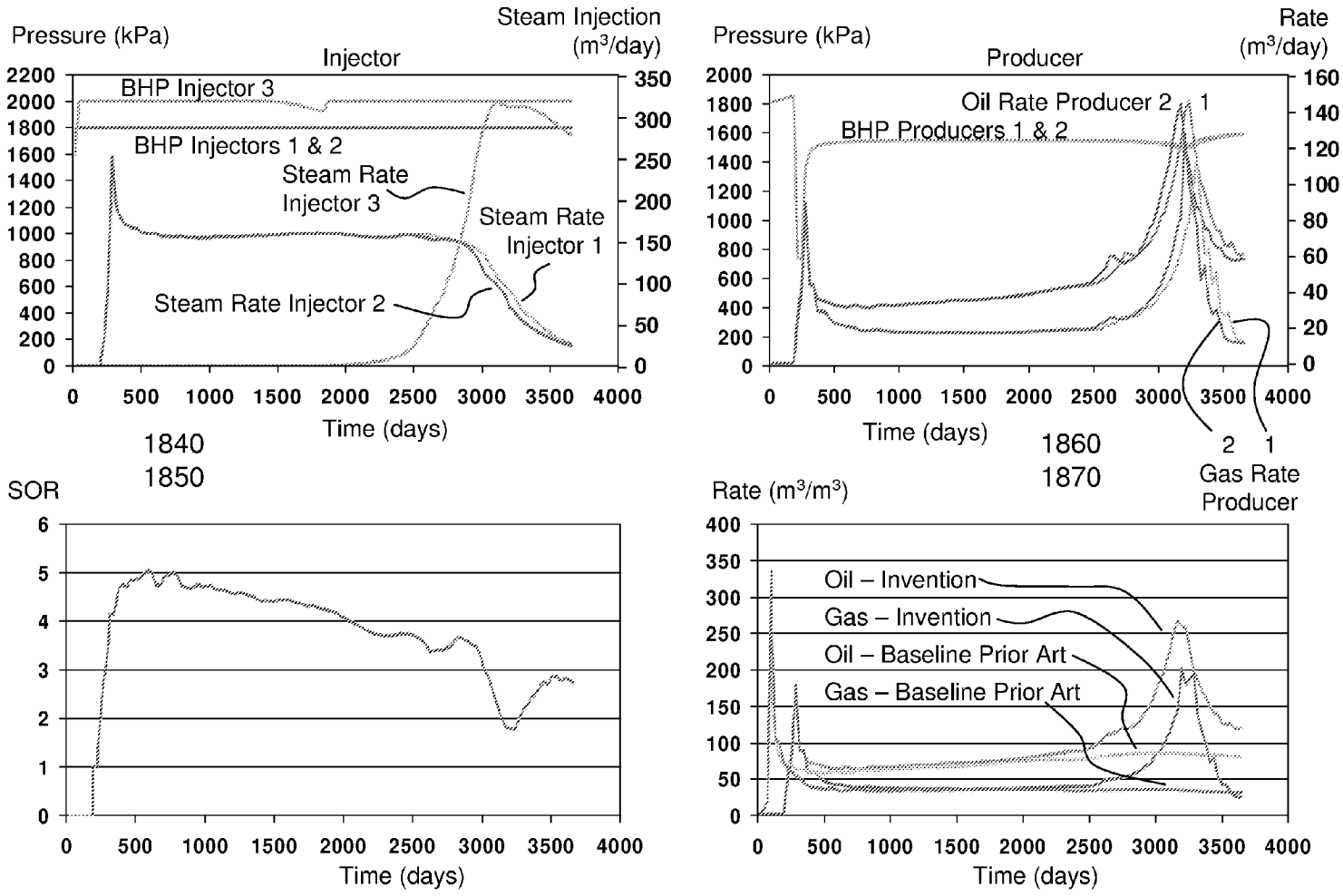

Now referring to FIG. 17A there are depicted first to third images 1710 through 1730 respectively depicting the pressure, temperature and oil depletion for a SAGD process according to an embodiment of the invention with a 75 m well-pair separation, 5 m offset between injector and producer wells within each well-pair, and intermediate pressure wells. Extracted data from the simulations was used to generate the first to fourth graphs 1740 through 1770 that depict injector and producer pressure and steam injection rates together with SOR and field production comparison. With the offset in injector and producer wells then as in previous case discussed above in respect of FIGS. 5C and 5D the start-up was delayed until approximately 250 days. However, also as a result of the inward shift of producers, earlier steam injectivity from the intermediate injector, i.e. before 2,500 simulation days, was achieved with considerable rates as depicted in first graph 1740 in FIG. 17B. Similarly, bitumen was produced from the untapped zone at high rates as evident from third graph 1760 in FIG. 17B and the increased production against a baseline SAGD process evident in fourth graph 1770. Further as evident from first and second graphs 1740 and 1750 respectively in FIG. 17B a decrease in steam injection rates for the injection wells is evident leading to a rise in SOR.

As the intermediate injector is approximately 37 m away from the producers within the SAGD well pairs establishing communication between the producers takes time as evident from the results presented within FIGS. 16A through 17B respectively. Now referring to FIG. 18A there are depicted first to third images 1810 through 1830 respectively depicting the pressure, temperature and oil depletion for a SAGD process according to an embodiment of the invention with a 75 m well-pair separation, 5 m offset between injector and producer wells within each well-pair, and intermediate pressure wells. However, unlike FIGS. 17A and 17B steam injection was delayed into the intermediate pressure well for 5 years to allow for the 37.5 m separation between outer injector well and intermediate pressure well. Extracted data from the simulations was used to generate the first to fourth graphs 1840 through 1870 that depict injector and producer pressure and steam injection rates together with SOR and field production comparison.

With the offset in injector and producer wells then as in previous case discussed above in respect of FIGS. 5C and 5D the start-up was delayed until approximately 250 days. Also as a result of the delayed initiation in injection to the intermediate pressure well the earlier steam injectivity depicted within first graph 1740 of FIG. 17B can be seen to be delayed in first graph 1840 of FIG. 18B. However, the considerable oil production rates are still evident as shown by third graph 1860 in FIG. 18B and the increased production against a baseline SAGD process evident in fourth graph 1870. The previously untapped zone from the prior art was swept as evident from third image 1830 of FIG. 18A. Further as evident from first and second graphs 1840 and 1850 respectively in FIG. 18B a decrease in steam injection rates for the injection wells is evident leading to a rise in SOR as the previously untapped zone is swept wherein the steam injection in the intermediate injector well may be terminated and optionally the injector well now operated as a producer. Similar options exist in respect of the previous embodiments of the invention described above in respect of FIGS. 16A through 17B. As evident the timing of the peak oil production is now timed comparably to that in FIG. 16B, approximately 3200 days as opposed to 3300 days. However, the intermediate injector is operated for a reduced period of time compared to the scenario in FIGS. 17A and 17B where extended steam injection of approximately 2000 days versus approximately 650 days in the scenarios of FIGS. 16A, 16B, 18A and 18B results in advancing peak oil by approximately 500 days and clearing the oil reservoir quicker.

Figure 19A:
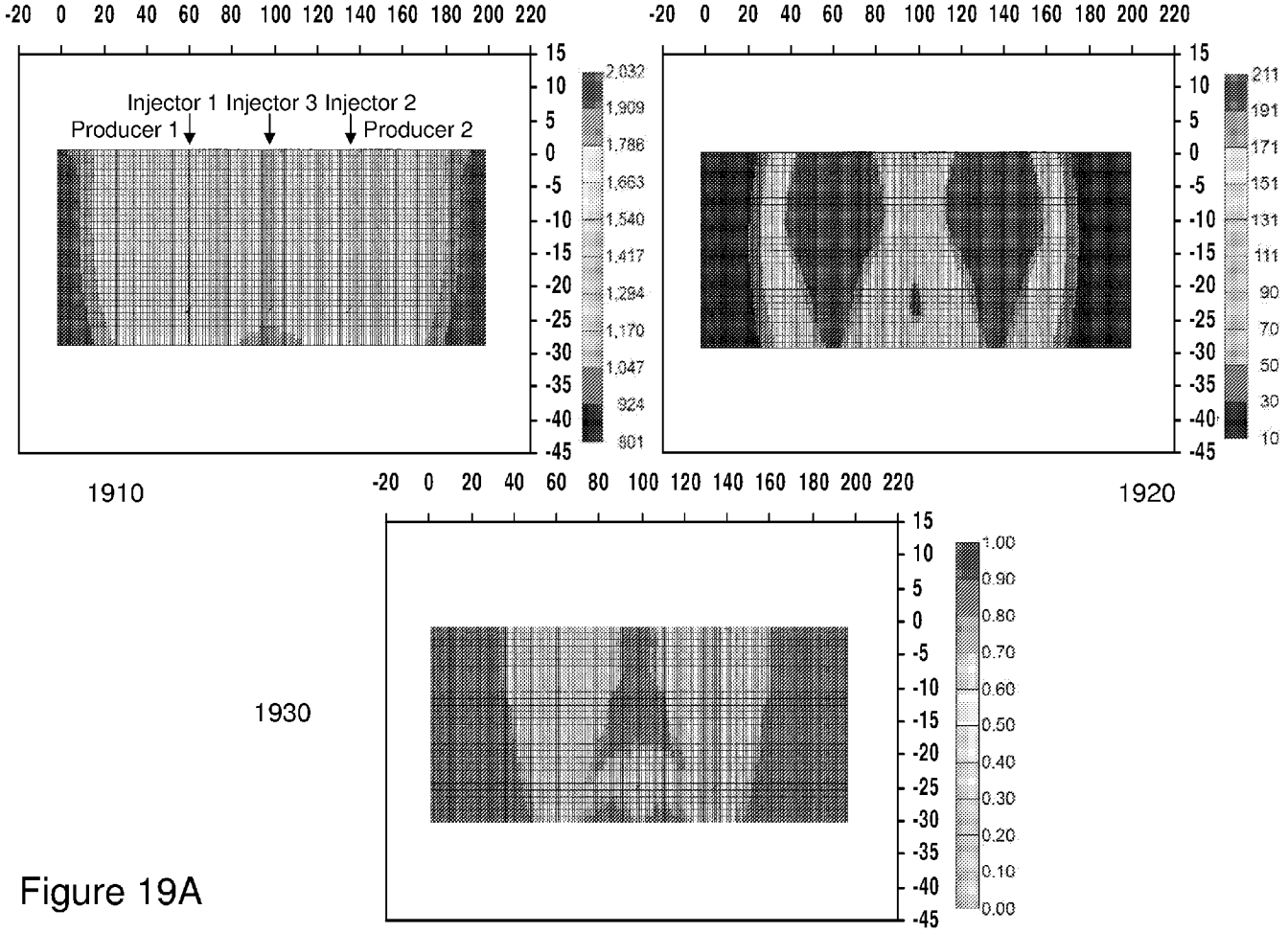
FIGS. 19A and 19B depict simulation results for a pressure assisted oil recovery process according to an embodiment of the invention with primary injectors within SAGD well pairs operated at the same 1800 kPa as intermediate wells acting as secondary injectors.
Figure 19B:
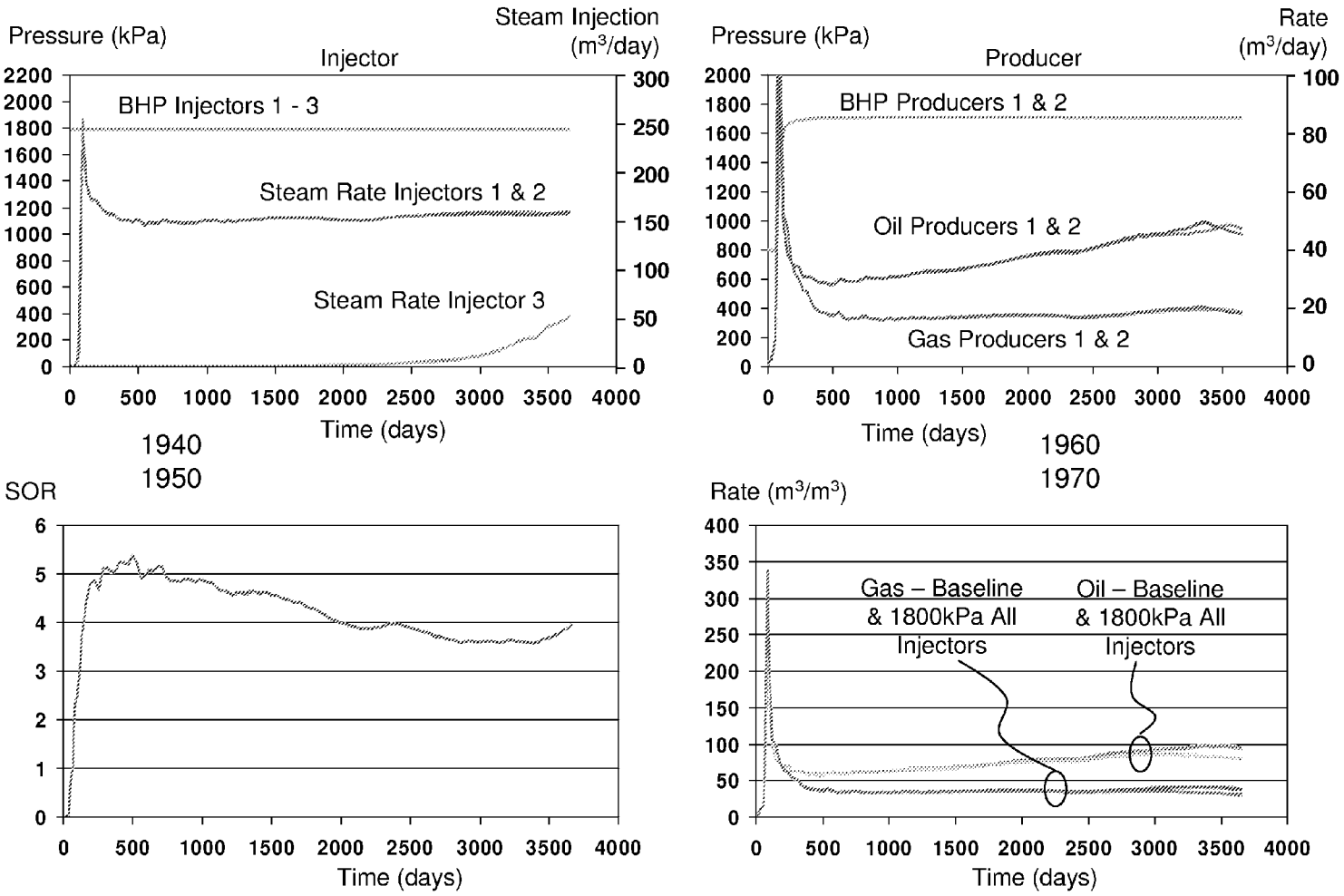

Referring to FIG. 19A there are depicted first to third images 1910 through 1930 respectively depicting the pressure, temperature and oil depletion for a SAGD process according to an embodiment of the invention with a 75 m well-pair separation, 0 m offset between injector and producer wells within each well-pair, and intermediate pressure well. However, in this case, the operating parameters of the intermediate injection well were matched with the exterior injection wells, wherein the pressure and steam quality were changed to 1800 kPa and 0.9 respectively. Accordingly it is evident from the first to third images 1910 through 1930 in FIG. 19A respectively depicting the pressure, temperature and oil depletion within the reservoir that recovery of the central zone was not possible to any substantial degree even in the 10 year simulation run performed to generate these first to third images 1910 through 1930. Similarly referring to first to fourth graphs 1940 through 1970 in FIG. 19B it can be seen that no significant steam injection occurs and the resulting oil and gas production volumes are essentially unchanged from those of the corresponding baseline analysis.

Figure 20A:
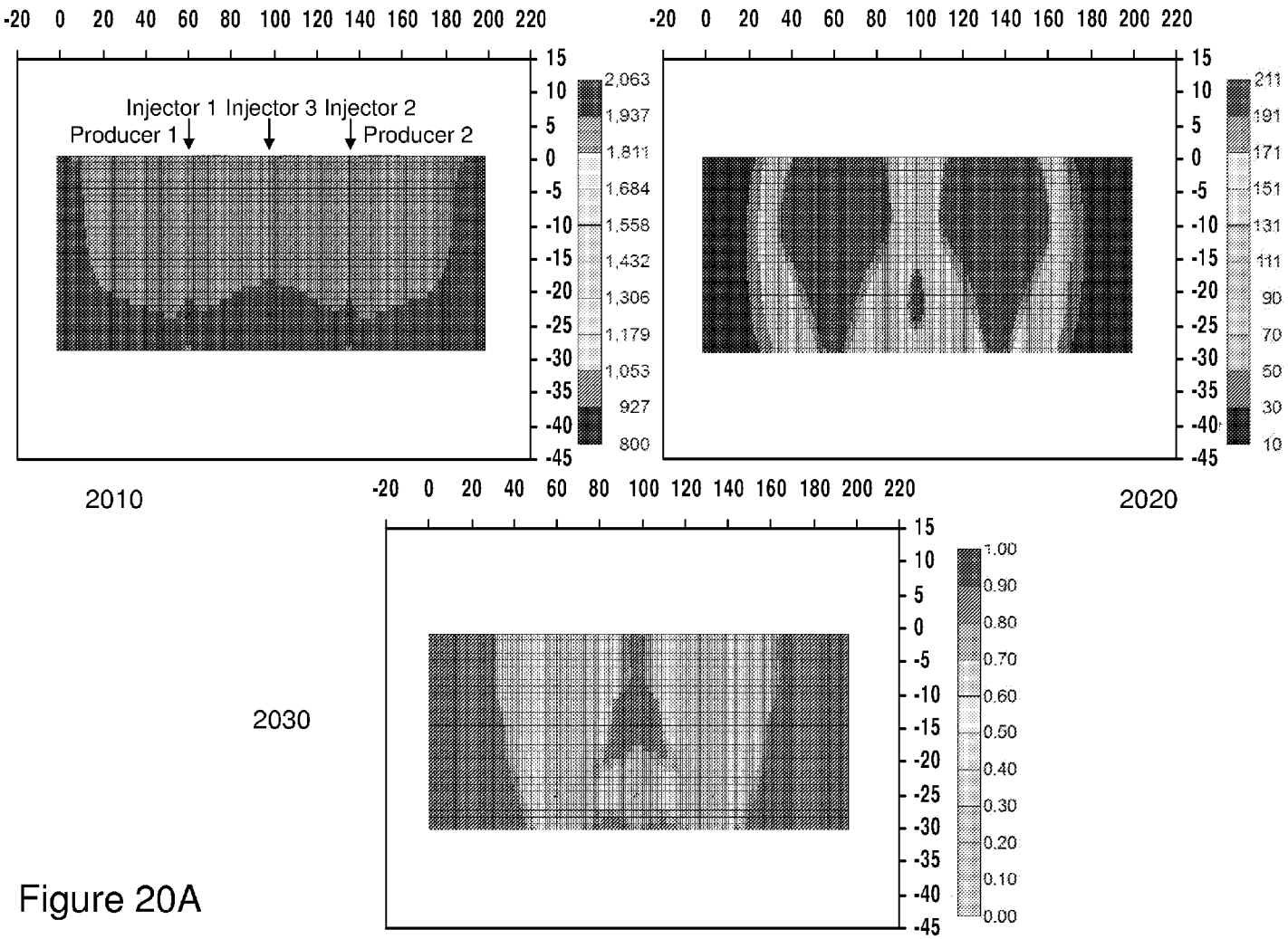
FIGS. 20A and 20B depict simulation results for a pressure assisted oil recovery process according to an embodiment of the invention with primary injectors within SAGD well pairs operated at the same 2000 kPa pressure as intermediate wells acting as secondary injectors.
Figure 20B:
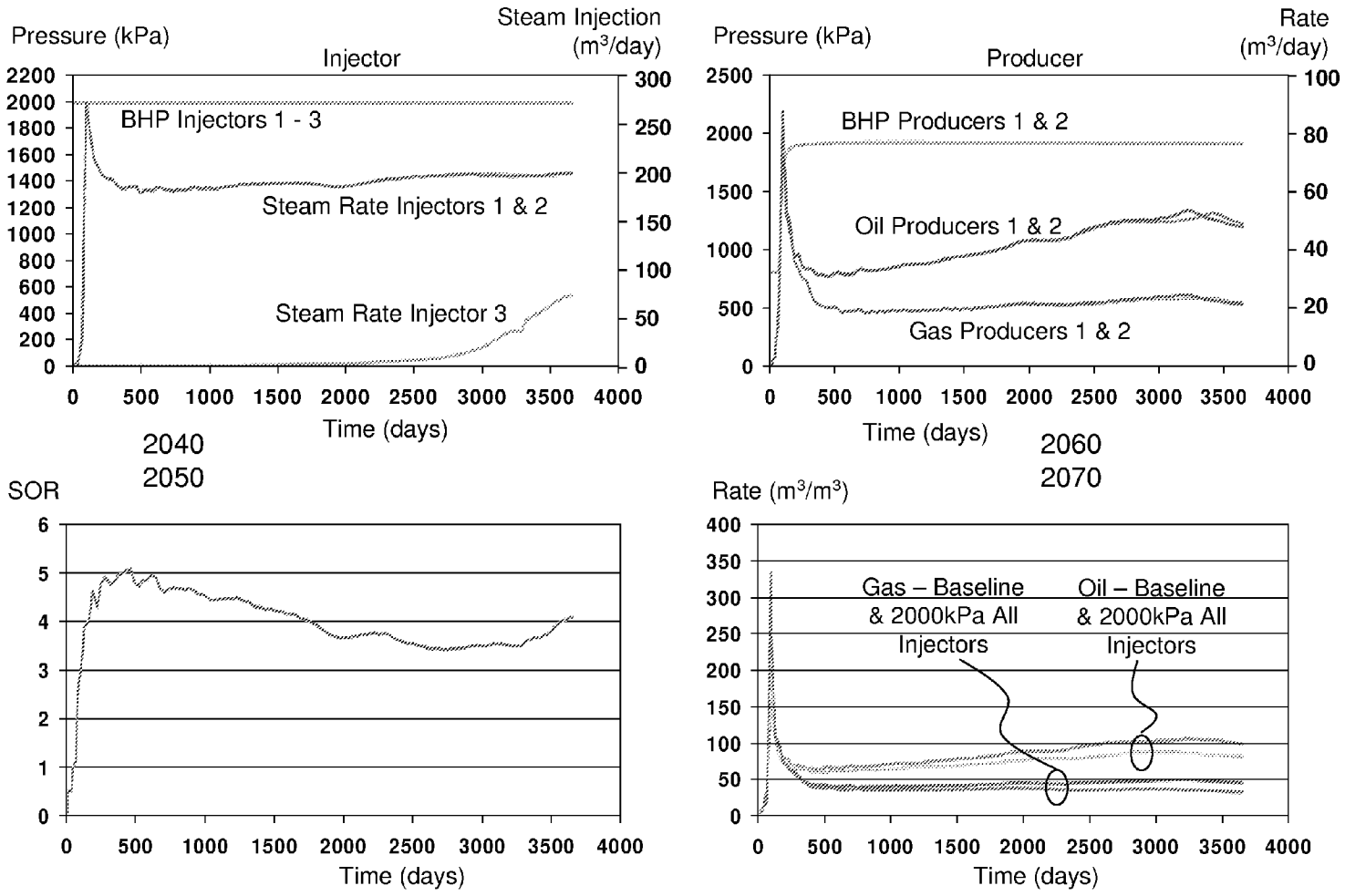

Now referring to FIG. 20A there are depicted first to third images 2010 through 2030 respectively depicting the pressure, temperature and oil depletion for a SAGD process according to an embodiment of the invention with a 75 m well-pair separation, 0 m offset between injector and producer wells within each well-pair, and intermediate pressure well. However, in this case, the operating parameters of the exterior injection wells were matched with the intermediate injection well, wherein the pressure and steam quality were changed to 2000 kPa and 0.99 respectively for the injector wells within the SAGD well pairs. Accordingly it is evident the operating pressure of the injector wells and the differential between them plays an important role in establishing the start-up of intermediate injector and the evolution of the temperature—pressure profile within the reservoir and the resulting oil and gas recovery. In FIG. 20B first to fourth graphs 2040 through 2070 depict the injector well characteristics, production well characteristics, SOR, and comparison of the process against a baseline process. Accordingly it can be seen that the intermediate injector was opened and operating since start of the simulation, it could be seen that approximately after 3000 days, it had some considerable injection rates. In comparison with the previous case of 1800 KPa, depicted in FIGS. 19A and 19B, it can be seen that it performed slightly better due to higher steam pressure and quality.

Referring to fourth graph 2070 in FIG. 20B presenting the field production comparison with the baseline simulations still shows that it was not as productive in 10 years. Accordingly in comparison to the preceding simulations in respect of FIGS. 16A through 18B it is evident that the intermediate injector pressure plays an important role in the start-up of the intermediate injector and that once the oil has been heated sufficiently and is ready to be mobilized, it is driven towards the producers by the higher pressure of the intermediate injector. Moreover, higher steam pressure from the intermediate injector overcomes the injection from the injectors of the SAGD pairs and reduces or terminates their injectivity by increasing the pressure in surrounding the reservoir, evident as adjacent well grid blocks within the profiles from the simulation run in FIG. 20A.

Figure 21A:
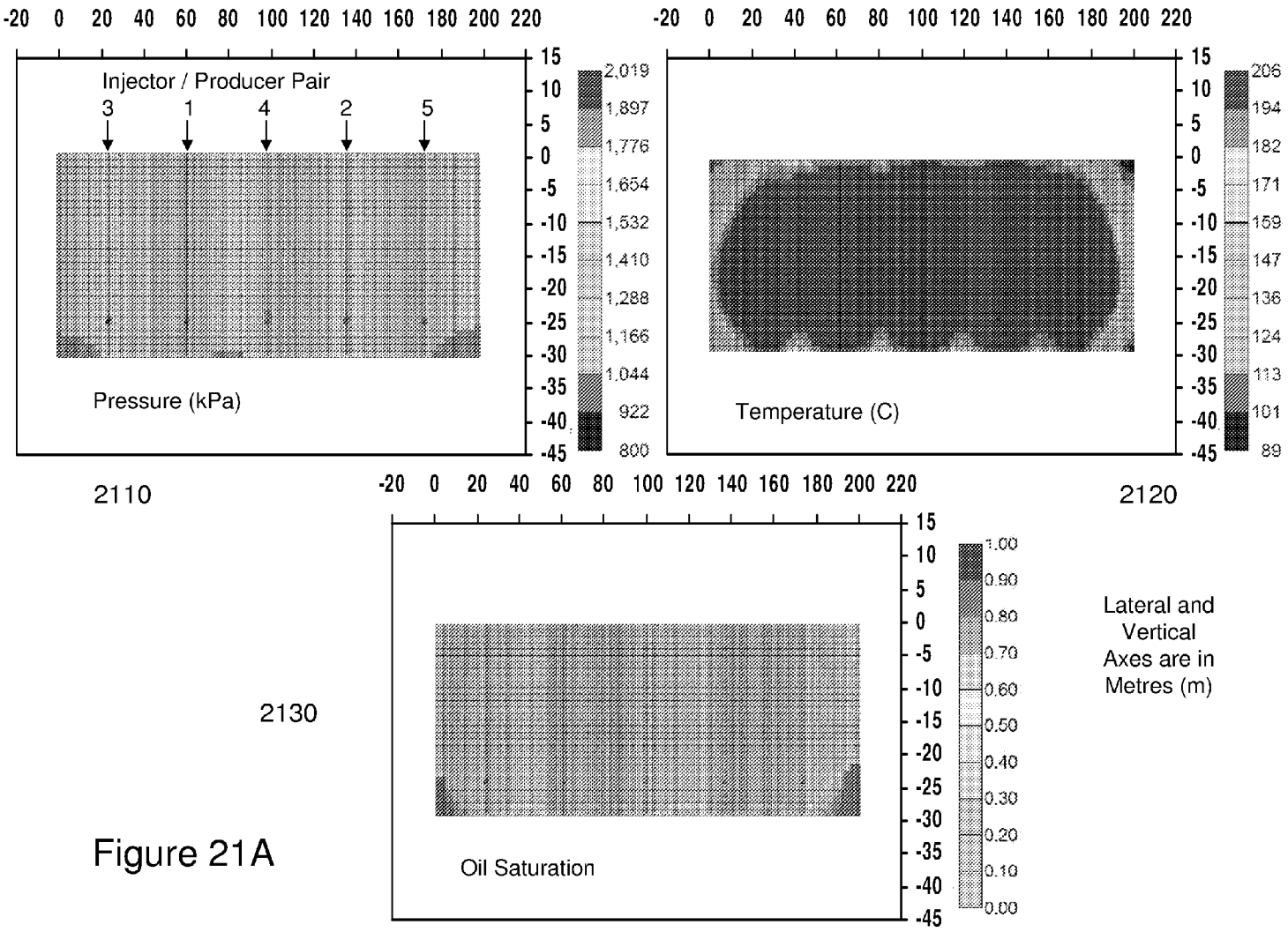
FIGS. 21A and 21B depict simulation results for a pressure assisted oil recovery process according to an embodiment of the invention with primary injectors within SAGD well pairs operated at a lower pressure than intermediate wells acting as secondary injectors with reduced spacing of 37.5 m.
Figure 21B:
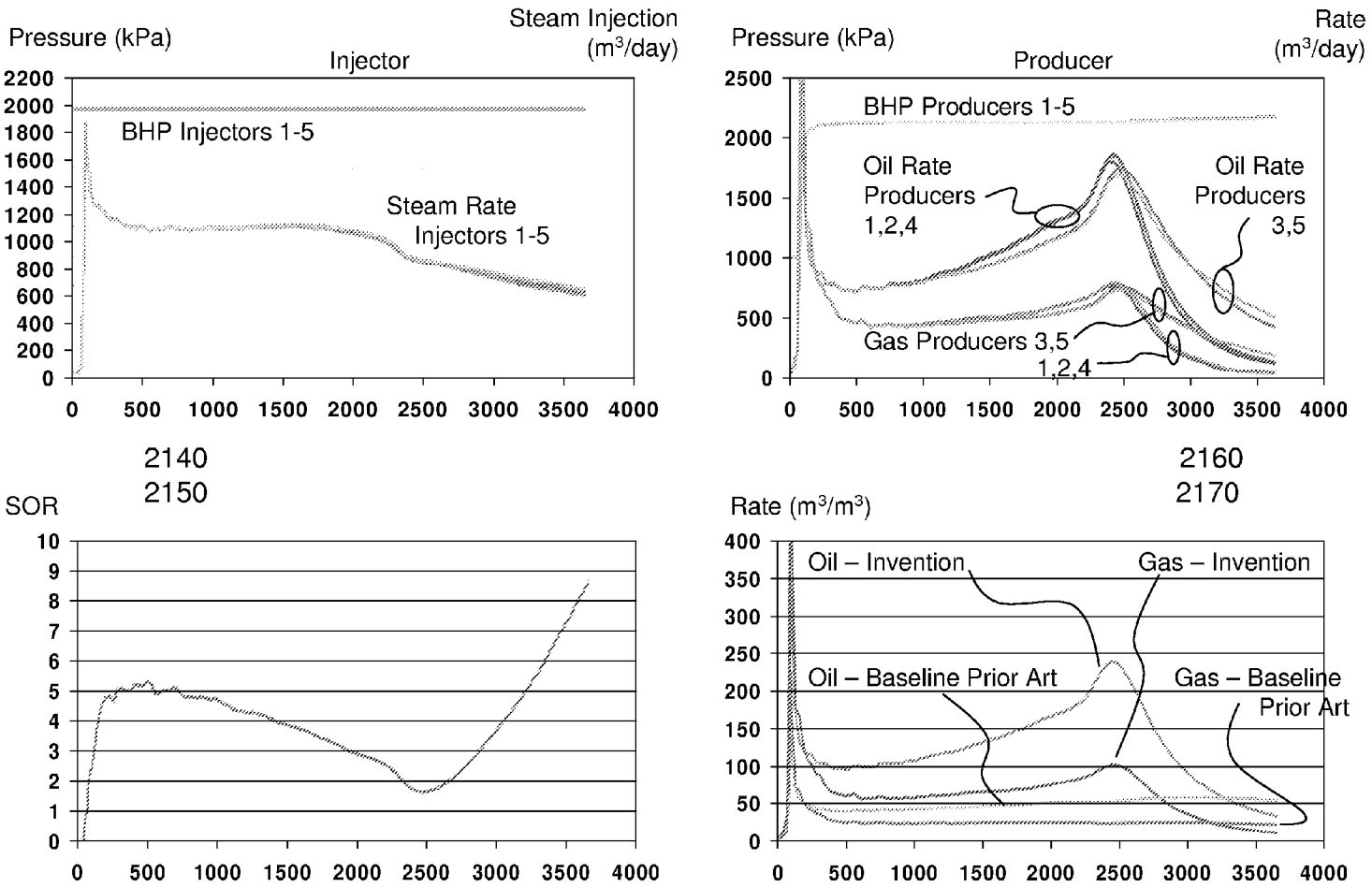

Now referring to FIG. 21A there are depicted first to third images 2110 through 2130 respectively depicting the pressure, temperature and oil depletion for a SAGD process according to an embodiment of the invention with a 37.5 m well-pair separation wherein there is no offset between injector and producer wells within each well-pair, and all injector wells are now operated at the same pressure. Extracted data from the simulations was used to generate the first to fourth graphs 2140 through 2170 in FIG. 21B that depict injector and producer pressure and steam injection rates together with SOR and field production comparison. Not surprisingly almost the entire reservoir has been swept by the end of the 10 year simulation and high oil and gas production are evident with very low SOR at peak production. However, SOR picks up rapidly after 2500 days as the production tails rapidly as evident from the very sharp drop in oil production of the first group of curves which represent producers 1, 2 and 4 (the central group). It is expected that similar behaviour would be evident in the other producers if the simulation was over a wider region such that the SOR would climb more rapidly in a large reservoir with small injector-producer well pair spacing. It would be evident to one skilled in the art that the reduced separation coupled with embodiments of the invention wherein SAGD well pairs are interspersed with injector wells operating at higher pressure than the injectors within each SAGD well paid would lead to similar sweeping of the complete reservoir but without the requirement for the additional producer wells to be drilled and populated.

Figure 25:
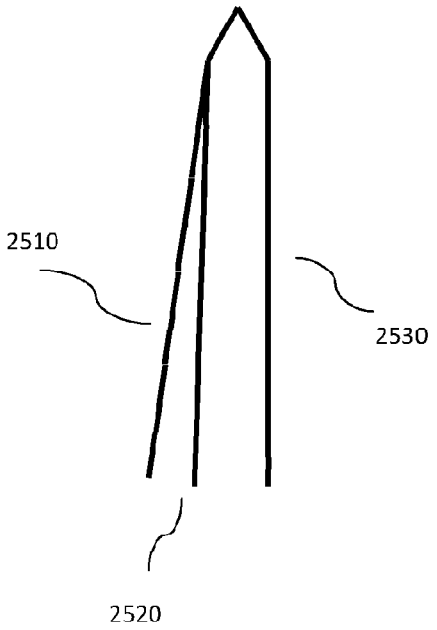
FIGS. 25-26 show top views of non-parallel well configurations. In both these configurations, the injector wells (2510 and 2610) are vertically spaced in a non-parallel relationship from the lower producer wells (2520 and 2620) with the secondary wells (2530 and 2630) laterally offset to both.
Figure 26:
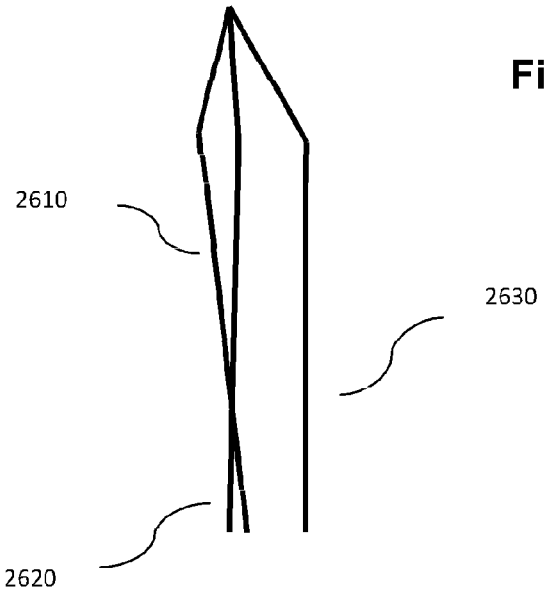

FIGS. 25-26 show top views of non-parallel well configurations. The injector wells (2510) and (2610) are vertically spaced from the lower producer wells (2520) and (2620) and are in a non-parallel relationship with them. The secondary wells (2530) and (2630) are laterally offset to both the injector wells and the producer wells.

Figure 22:
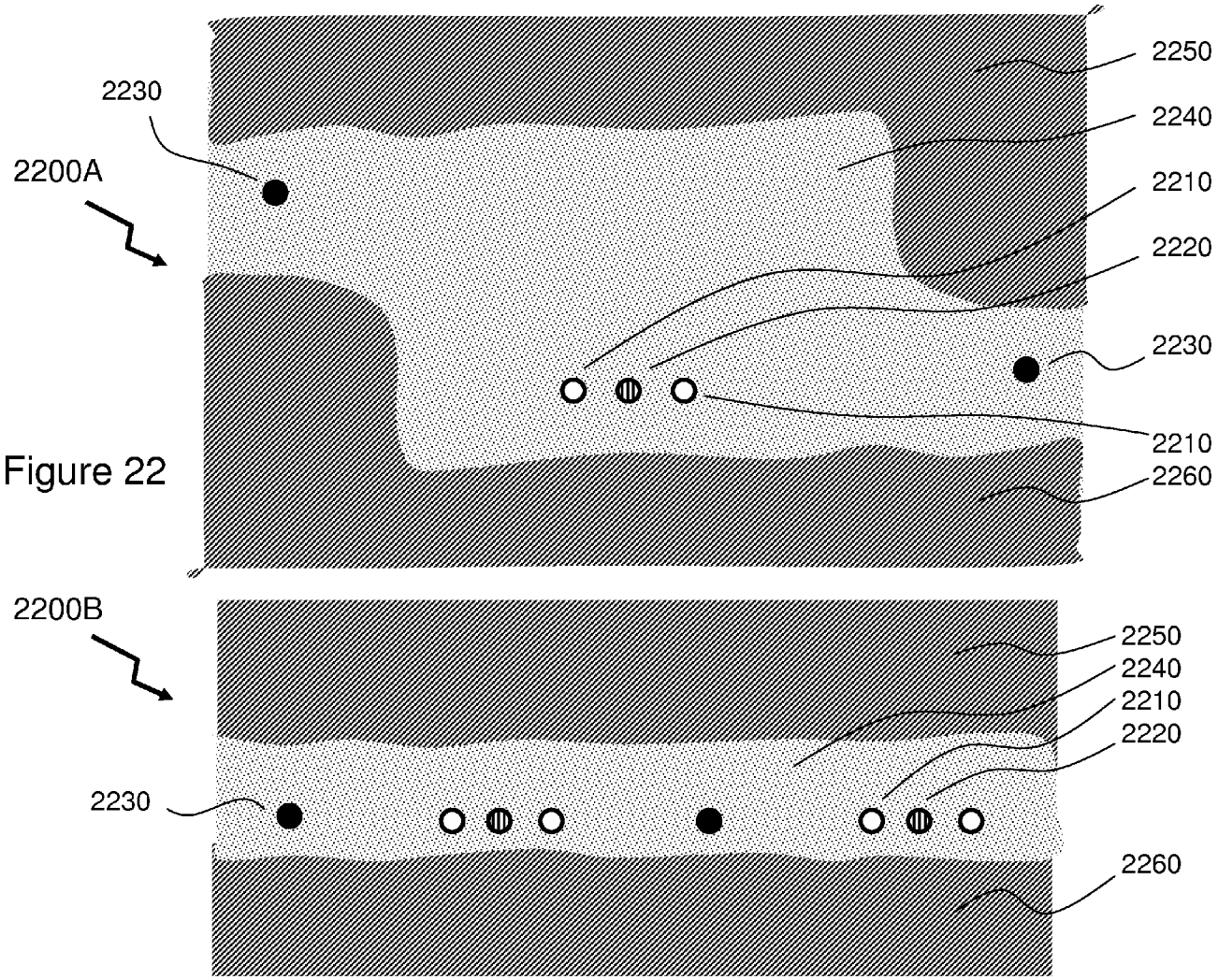
FIG. 22 depicts oil recovery scenarios and well structures according to embodiments of the invention.
Figure 23A:
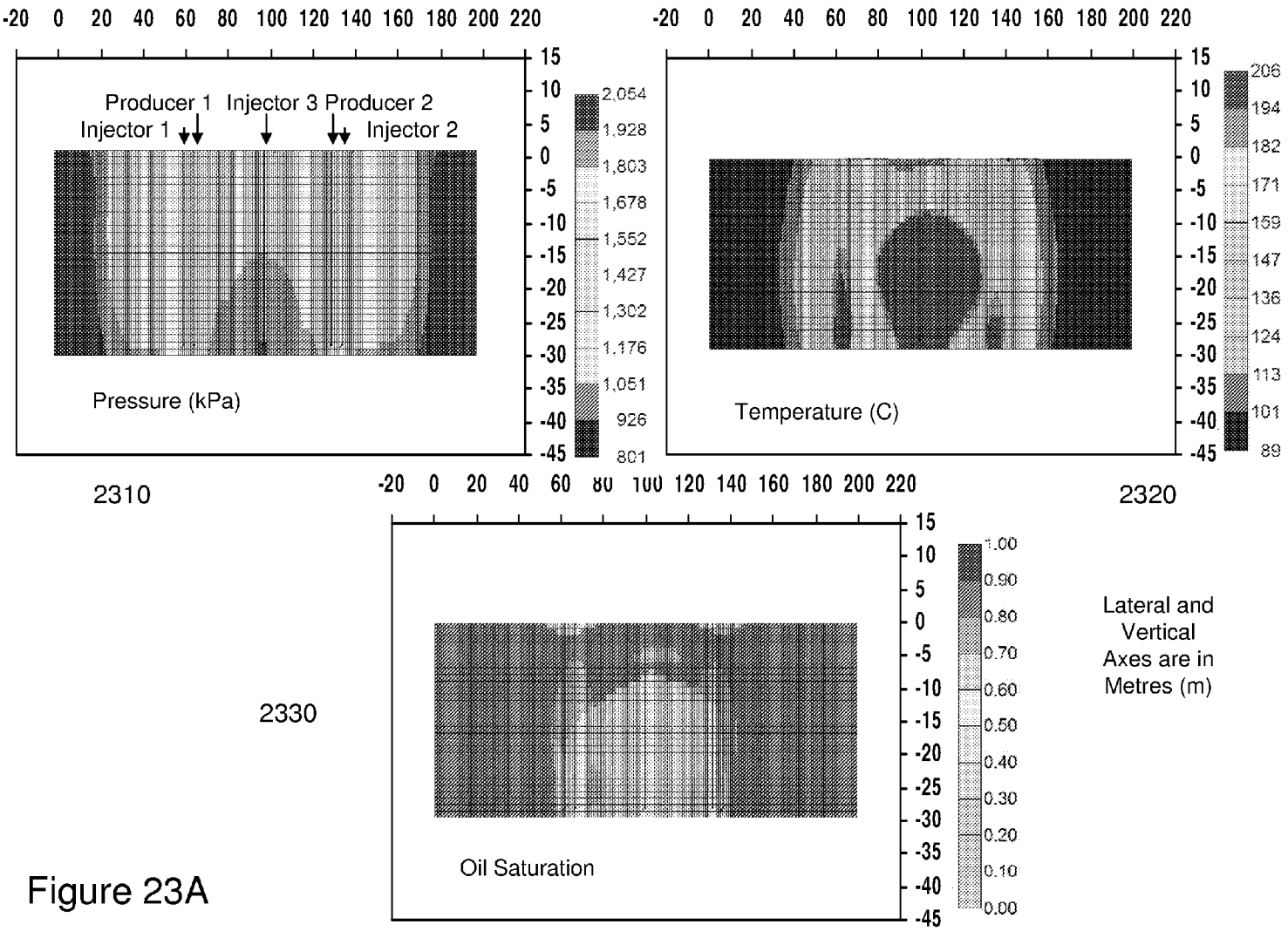
FIGS. 23A and 23B depict simulation results for a pressure assisted oil recovery process according to an embodiment of the invention with horizontally disposed SAGD well pairs operating with injectors at lower pressure than laterally disposed intermediate wells such as depicted in FIG. 22.

Now referring to FIG. 22 there are depicted first and second oil bearing structures 2200A and 2200B respectively wherein an oil bearing layer 2240 is disposed between upper and lower geological structures 2250 and 2260 respectively. Within the oil bearing layer 2240 injector wells 2220 are disposed together with production wells 2210 with low or zero vertical offset and laterally disposed from these groupings are pressure wells 2230. Referring to FIG. 23A there are depicted first to fourth images 2310 through 233 respectively depicting reservoir pressure, temperature and oil depletion after 10 years wherein all injector wells and producer wells are disposed on the same vertical plane within the reservoir wherein injectors 1 and 2 associated with each SAGD pair are 75 m apart, intermediate injector is symmetrically disposed between these, and the producer wells are offset towards the intermediate well by 5 m as in other simulations presented above but are on the same horizontal plane, i.e. no vertical offset.

Figure 23B:
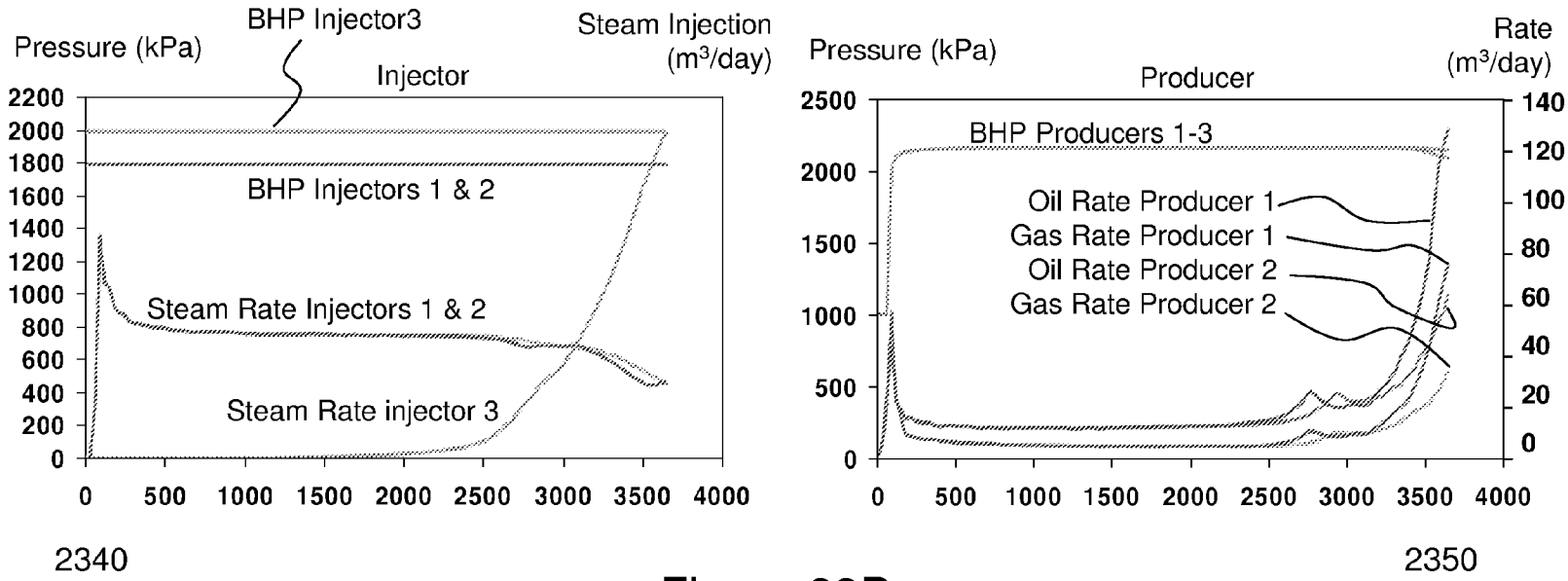

Referring to FIG. 23B first and second graphs 2340 and 2350 depict the injector and producer characteristics for the SAGD well pair/intermediate injector well configuration described above in respect of FIG. 23A wherein all wells were disposed 1 m away from the bottom of the same 30 m thick reservoir for simulation purposes. As with other embodiments of the invention described above in respect of FIGS. 16A through 18B the intermediate injector well was operated at 2000 KPa and 0.99 steam quality compared to 1800 kPa for the SAGD well pair injectors. As anticipated common vertical placement of the SAGD well pair has an initial adverse effect on the growth of steam chamber. Steam breakthrough occurs after 90 days of pre-heating in this case and as anticipated the steam chamber grows in a column between in the SAGD injector and producer wells. In the meantime, preheating of the intermediate injector was active and after 2500 days, bitumen was heated enough that it could be mobilized towards the producers by the intermediate injector in common with preceding simulations and consequently steam injection in the reservoir from the intermediate injectors is possible. It would be evident that if the simulated reservoir has been thin, for example 5m or 10 m, then the time to steam injection from the intermediate well at the same separation would occur earlier due to the modified pressure—temperature profile within the reservoir. However, in each instance the lateral SAGD well pair allows production to be achieved within a thin reservoir rather than the conventional thick reservoirs considered within the prior art.

Figure 24A:
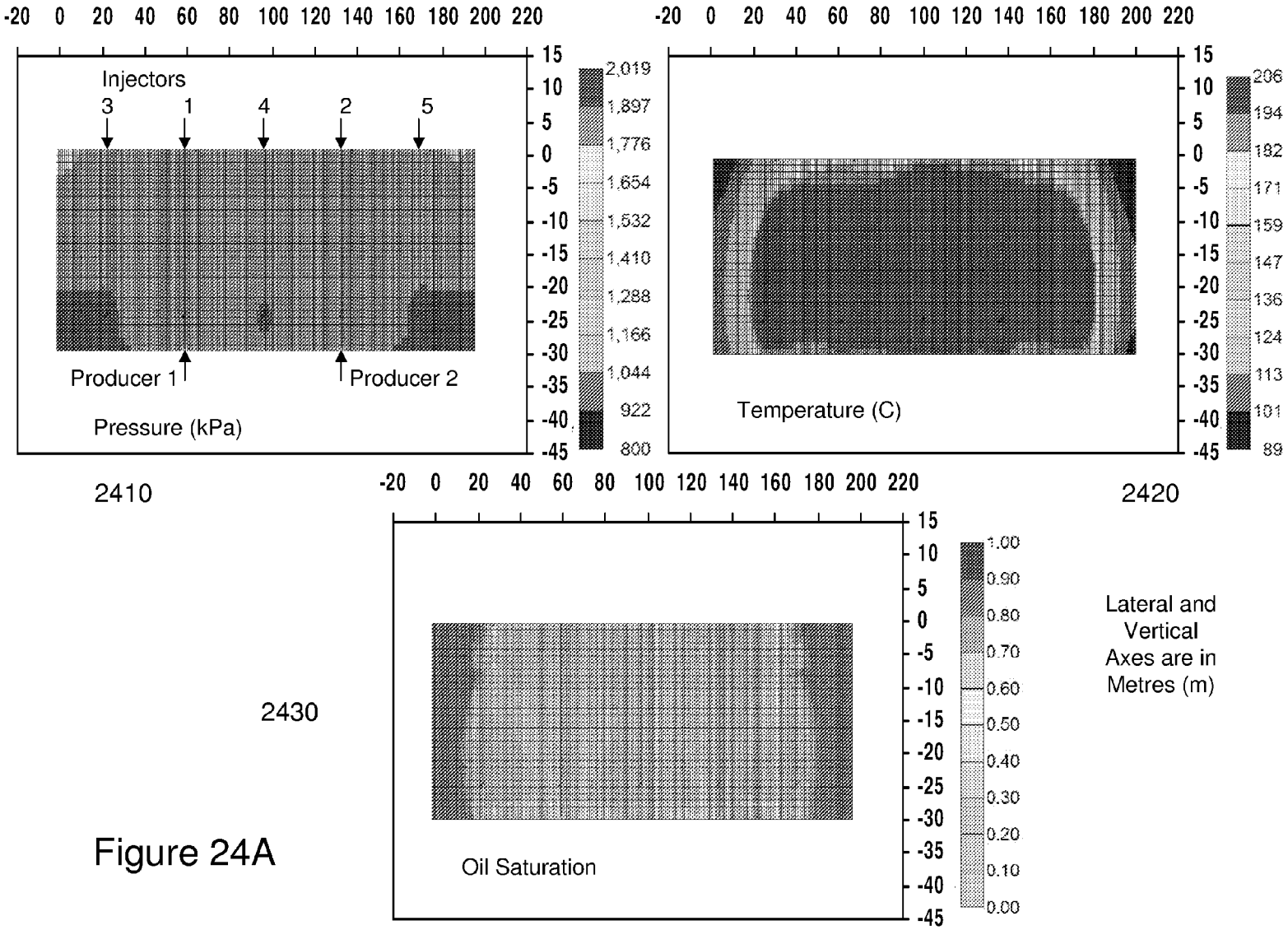
FIGS. 24A and 24B depict simulation results for a pressure assisted oil recovery process according to an embodiment of the invention with standard SAGD well pairs operating at lower pressure than additional injector wells laterally disposed to the SAGD well pairs.
Figure 24B:
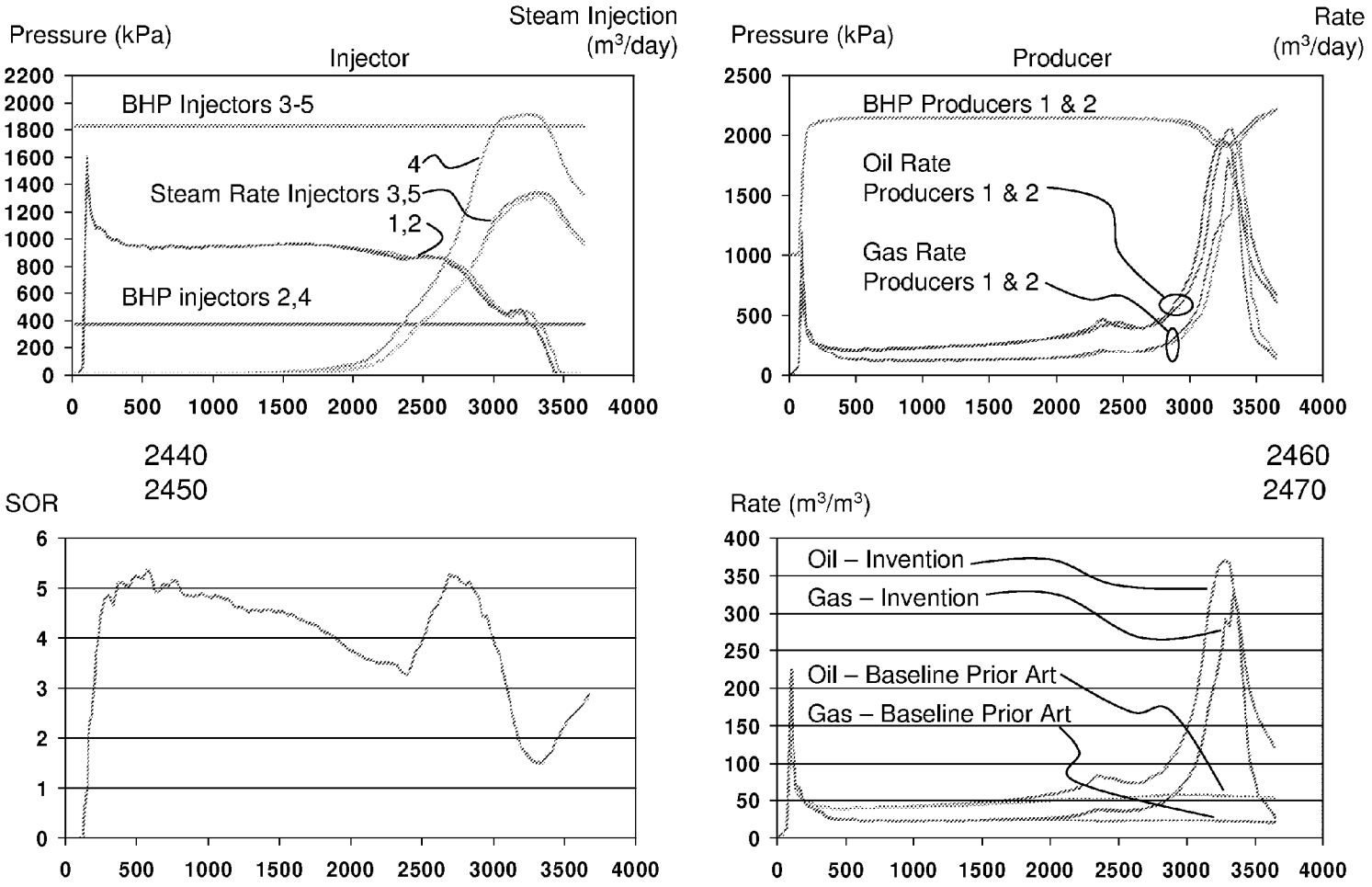

Now referring to FIG. 24A there are depicted first to third images 2410 through 2430 respectively depicting the pressure, temperature and oil depletion for a SAGD process according to an embodiment of the invention with a 75 m well-pair separation wherein there is no offset between injector and producer wells within each well-pair, and in addition to the intermediate injector, injector 4 disposed between injectors 1 and 2 forming the SAGD well pairs with producers 1 and 2 respectively, additional injectors, injectors 3 and 5 are disposed laterally offset to the other side of the SAGD pairs to the intermediate injector well to model a scenario representing a more extensive reservoir. Extracted data from the simulations was used to generate the first to fourth graphs 2440 through 2470 in FIG. 24B that depict injector and producer pressure and steam injection rates together with SOR and field production comparison. Non-SAGD well pair injectors, injectors 3 to 5 respectively, were operated at 2000 kPa as opposed to 1800 kPa for the injector wells within each SAGD pair. Not surprisingly almost the entire reservoir has been swept by the end of the 10 year simulation and high oil and gas production rates are evident with very low SOR at peak production around 3000-3500 days.

All simulations within the preceding analysis of the prior art and embodiments of the invention were run with a permeability of the oil bearing reservoir of 1 darcy ($9.869233\times10^{-13}$ $m^2$). Increased permeability of the oil bearing reservoir would reduce the timescales over which embodiments of the invention provide benefit of increased oil and/or gas production as well as allowing increased spacing between SAGD well pairs and intermediate injector wells.

Whilst the embodiments of the invention presented above in respect of FIGS. 6 to 23B have been primarily described in respect of oil sands (tar sands) the principles are applicable to other oil reservoirs_and reservoirs of chemicals recoverable from permeable formations including but not limited to sands. Within some embodiments of the invention the pressure applied to the pressure wells may vary from vacuum or near-vacuum to pressures that whilst significant in terms of atmospheric pressure are substantially less than those existing within the formation through which the well is bored. Further, as discussed supra in respect of some embodiments with the existence of multiple stages in these oil recovery systems including, but not limited, injection (of fluid), production (of oil) and resting (between injection and production) and the ability to vary the duration of each stage, the order of stages, and the repetitions thereof that multiple sequences of injection into injection wells, extraction from production wells, as well as operation of the pressure wells under low pressure, high pressure, injection and extraction or combinations thereof that a wide range of resulting combinations of operation sequences exist for the embodiments of the invention. The embodiments presented supra being exemplary in nature to present some combinations of these sequences.

Within the embodiments of the invention described above these have been described with respect to substantially horizontal and/or vertical injection, production, and pressure wells. It would be evident to one skilled in the art that the approaches described may be exploited with injection, production, and pressure wells that are disposed at angle with respect to the oil bearing formation.

However, in other embodiments of the invention the pressure applied to the pressure wells may be significantly higher than the pressure in the formation through which the well is bored such the pressure from the pressure well acts to increase the flow velocity of the oil within the reservoir thereby allowing the initial time from fluid injection to first oil production to be reduced. Equally in other embodiments of the invention the pressure wells may be initially employed with high pressure to reduce time to first oil or even reduce time for oil depletion within the chamber formed from fluid injection and then the pressure reduced to low pressure such that the secondary oil recovery from those regions of the reservoir not currently addressed through the injected fluid are accessed. In other embodiments of the invention such high pressure application may be employed to deliberately induce fracturing within the oil bearing structure. Subsequently the high pressure being replaced with low pressure or near-vacuum alone or in combination with injection of fluids from other wells.

It would also be evident that whilst the discussions supra have been for example in respect of oil bearing structures such as oil sands and convention oil reservoirs that the techniques presented may be exploited in other scenarios. Further, they may be exploited for primary production, secondary recovery, tertiary recovery, etc or combinations thereof. Further, it would be evident that in some scenarios the techniques may be applied to a previously worked oil bearing structure where economic factors and/or other factors such as sovereignty issues etc may make the re-opening of such previously worked oil bearing structures to recover oil previously unrecovered through prior primary, secondary, and even tertiary methods known in the prior art. Additionally, the ability to increase overall yield from an oil bearing structure may adjust the economic viability of particular oil bearing structures thereby allowing such reserves that were considered uneconomic to be exploited economically.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method of extracting oil from an oil sand reservoir comprising:

an initial step of drilling first and second well pairs separated by a predetermined separation, each well pair comprising:

a first well within the oil sand reservoir; and a second well within the oil sand reservoir at a predetermined vertical offset to the first well, substantially parallel to the first well and at a predetermined lateral offset to the first well;

a further step, prior to any production, of operating the first and second wells as a steam assisted gravity drainage (SAGD) well pair by selectively injecting a first fluid into at least the first well of each well pair according to a first predetermined schedule to create a zone of increased mobility within the oil sand reservoir; and drilling an infill well within the oil sand reservoir at a predetermined location between the first and second well pairs and generating a large singular zone of increased mobility between the well pairs by injecting a second fluid into the infill well according to a second predetermined schedule to establish thermal communication between the infill well and the zone between the SAGD well pairs prior to merging of steam chambers created by concurrent operation of adjacent SAGD well pairs; and the second predetermined schedule comprising converting the infill well for extracting reservoir fluids from the oil sand reservoir via the infill well; and continuing to operate the SAGD well pairs according to the first predetermined schedule.

2. A method according to claim 1 wherein, the second predetermined schedule begins injection of the second fluid into the infill well before a depletion zone resulting from injection of the first fluid into the first well merges with another depletion zone resulting from concurrent operation of a second well pair disposed in mirror relationship with respect of the infill well with the first well pair.

3. The method according to claim 1 wherein the first oil well injects the first fluid while the infill well is extracting fluids.

4. The method according to claim 1 wherein, injection into the infill well is made at a higher pressure than injection into the first wells of each well pair.

5. The method according to claim 1 wherein injection pressure is at a differential pressure relative to the pressure of the oil sand reservoir within which the second well is disposed; or the second predetermined schedule further comprises operating the infill well to extract oil from the oil sand structure, or operating the infill well to extract oil from the oil sand reservoir while injecting a second fluid into the first well.

6. The method according to claim 1 wherein:

first and second wells form a well pair comprising a predetermined portion of an array of well pairs and the infill well is disposed in predetermined relationship between two well pairs; and or the first and second wells are disposed towards the lower boundary of the oil sand reservoir, and the infill well is disposed vertically towards the upper boundary of the oil sand reservoir.

7. The method according to claim 1 further comprising; a second infill well in the same zone between the well pairs disposed in predetermined relationship to the original infill well.

8. The method according to claim 1 wherein, the large singular zone substantially depletes an oil bearing region between the first and second well pairs.

9. The method according to claim 1 further comprising a distributed temperature sensing apparatus in the at least one of the first or second well pairs.

10. The method according to claim 1 wherein the first fluid is at least one of steam, water, carbon dioxide, nitrogen, propane, solvents and methane, and the second fluid is at least one of steam, water, carbon dioxide, nitrogen, propane, solvents and methane.

11. The method according to claim 1 wherein the first predetermined schedule continues injection into the first well of each SAGD well pair to continuously develop SAGD steam chambers until at least a point in time that the adjacent SAGD steam chambers merge while continuing to extract reservoir fluids via the infill well.

12. A method for extracting oil from an oil sand reservoir comprising:

an initial step of drilling first and second well pairs separated by a predetermined separation, each well pair comprising:

a first well within the oil sand reservoir; and a second well within the oil sand reservoir at a predetermined vertical offset to the first well and at a predetermined lateral offset to the first well, in a continuously diverging non-parallel relationship to the first well;

a further step, prior to any production, of operating the first and second wells as a steam assisted gravity drainage (SAGD) well pair by selectively injecting a first fluid into at least the first well of each well pair according to a first predetermined schedule to create a zone of increased mobility within the oil sand reservoir; and drilling an infill well within the oil sand reservoir at a predetermined location between the first and second well pairs and generating a large singular zone of increased mobility between the well pairs by injecting a second fluid into the infill well according to a second predetermined schedule to establish thermal communication between the infill well and the zone between the SAGD well pairs prior to merging of steam chambers created by concurrent operation of adjacent SAGD well pairs; and the second predetermined schedule comprising converting the infill well for extracting reservoir fluids from the oil sand reservoir via the infill well; and continuing to operate the SAGD well pairs according to the first predetermined schedule.

13. The method according to claim 12 wherein, the second predetermined schedule begins injection of the second fluid into the infill well before a depletion zone resulting from injection of the first fluid into the first well merges with another depletion zone resulting from concurrent operation of a second well pair disposed in mirror relationship with respect of the infill well with the first well pair.

14. The method according to claim 12 wherein, said injecting of the first and second fluids does not exceed the predicted fracture threshold of the oil sand reservoir.

15. The method according to claim 12 wherein the first well injects the first fluid while the infill well is extracting reservoir fluids.

16. The method according to claim 12 wherein injection into the infill well is made at a higher pressure than injection into the first wells of each well pair.

17. The method according to claim 12 wherein, injection pressure is at a differential pressure relative to the pressure of the oil sand reservoir within which the second well is disposed.

18. The method according to claim 12 wherein, the second predetermined schedule further comprises operating the infill well to extract oil from the oil sand reservoir; or operating the infill well to extract oil from the oil sand reservoir while injecting a second fluid into the first well.

19. The method according to claim 12 wherein the first and second wells form a well pair comprising a predetermined portion of an array of well pairs, and the infill well is disposed in a predetermined relationship between two well pairs;

or the second well is disposed towards the lower boundary of the oil sand reservoir, and the infill well is disposed vertically towards the upper boundary of the oil sand reservoir.

20. The method according to claim 12 wherein, the large singular zone substantially depletes an oil bearing region between the first and second well pairs.

21. The method according to claim 12 further comprising a distributed temperature sensing apparatus in the at least one of the first or second well pairs.

22. The method according to claim 12 wherein the first fluid is at least one of steam, water, carbon dioxide, nitrogen, propane, solvents and methane, and the second fluid is at least one of steam, water, carbon dioxide, nitrogen, propane, solvents and methane.

23. The method according to claim 12 wherein the first predetermined schedule continues injection into the first well of each SAGD well pair to continuously develop SAGD steam chambers until at least a point in time that the adjacent SAGD steam chambers merge while continuing to extract reservoir fluids via the infill well.

* * * * *